United States Patent [19]

Shibahara et al.

[11] Patent Number: 4,952,485

[45] Date of Patent: Aug. 28, 1990

[54] SILVER HALIDE COLOR NEGATIVE PHOTOGRAPHIC MATERIALS

[75] Inventors: Yoshihiko Shibahara; Yasushi Nozawa; Keiji Mihayashi, all of Kanagawa, Japan

[73] Assignee: Fuji Photo Film Co., Ltd., Kanagawa, Japan

[21] Appl. No.: 442,449

[22] Filed: Nov. 28, 1989

Related U.S. Application Data

[63] Continuation of Ser. No. 102,518, Sep. 29, 1987, abandoned.

[30] Foreign Application Priority Data

| | | | |
|---|---|---|---|
| Sep. 29, 1986 | [JP] | Japan | 61-228441 |
| Oct. 17, 1986 | [JP] | Japan | 61-246983 |
| Oct. 17, 1986 | [JP] | Japan | 61-246984 |
| Jul. 15, 1987 | [JP] | Japan | 62-174784 |

[51] Int. Cl.[5] ..... G03C 1/46; G03C 7/52; G03C 1/84

[52] U.S. Cl. ..... 430/502; 430/505; 430/506; 430/510; 430/517; 430/522; 430/551; 430/558; 430/600; 430/607; 430/611

[58] Field of Search ..... 430/502, 503, 505, 506, 430/510, 517, 522, 551, 558, 567, 6040, 607, 611, 613

[56] References Cited

U.S. PATENT DOCUMENTS

| | | | |
|---|---|---|---|
| 3,698,901 | 10/1972 | Elins et al. | 430/264 |
| 4,241,168 | 12/1980 | Arai et al. | 430/503 |
| 4,421,845 | 12/1983 | Uemara et al. | 430/544 |
| 4,596,764 | 6/1986 | Ishimaru | 430/393 |
| 4,607,004 | 8/1986 | Ikenone et al. | 430/523 |
| 4,618,573 | 10/1986 | Ukamara et al. | 430/558 |
| 4,707,434 | 11/1987 | Koboshi et al. | 430/393 |

OTHER PUBLICATIONS

Abstract No. 83-00950k, JP 57 188035, Konishinoka, "Silver Halide Photographic Material . . . ", 11/18/82.
Abstract No. 83-714354, JP 58 98728, Konishinoka, "Silver Halide Photographic Material . . . ", 6/11/83.
Abstract No. 84-015426, JP 58 209736, Konishinoka, "Silver Halide Photographic Material . . . ", 12/6/83.
Abstract No. 84-015427, JP 58 209737, Konishinoka, "Silver Halide Photographic Material . . . ", 12/6/83.

*Primary Examiner*—Paul R. Michl
*Assistant Examiner*—Patrick A. Doody
*Attorney, Agent, or Firm*—Sughrue, Mion, Zinn, Macpeak & Seas

[57] ABSTRACT

A silver halide color negative photographic material having at least one blue-sensitive silver halide emulsion layer, at least one green-sensitive silver halide emulsion layer and at least one red-sensitive silver halide emulsion layer on a support, which is characterized in that the combined total of silver contents in the material is from 3.0 g/m$^2$ to 8.0 g/m$^2$ and the specific photographic sensitivity of the material is from 320 to less than 800. The material has improved sharpness and graininess and has high processability including pressure-resistance. Even after stored for long periods of time, the graininess of the material does not deteriorate.

17 Claims, 1 Drawing Sheet

FIGURE
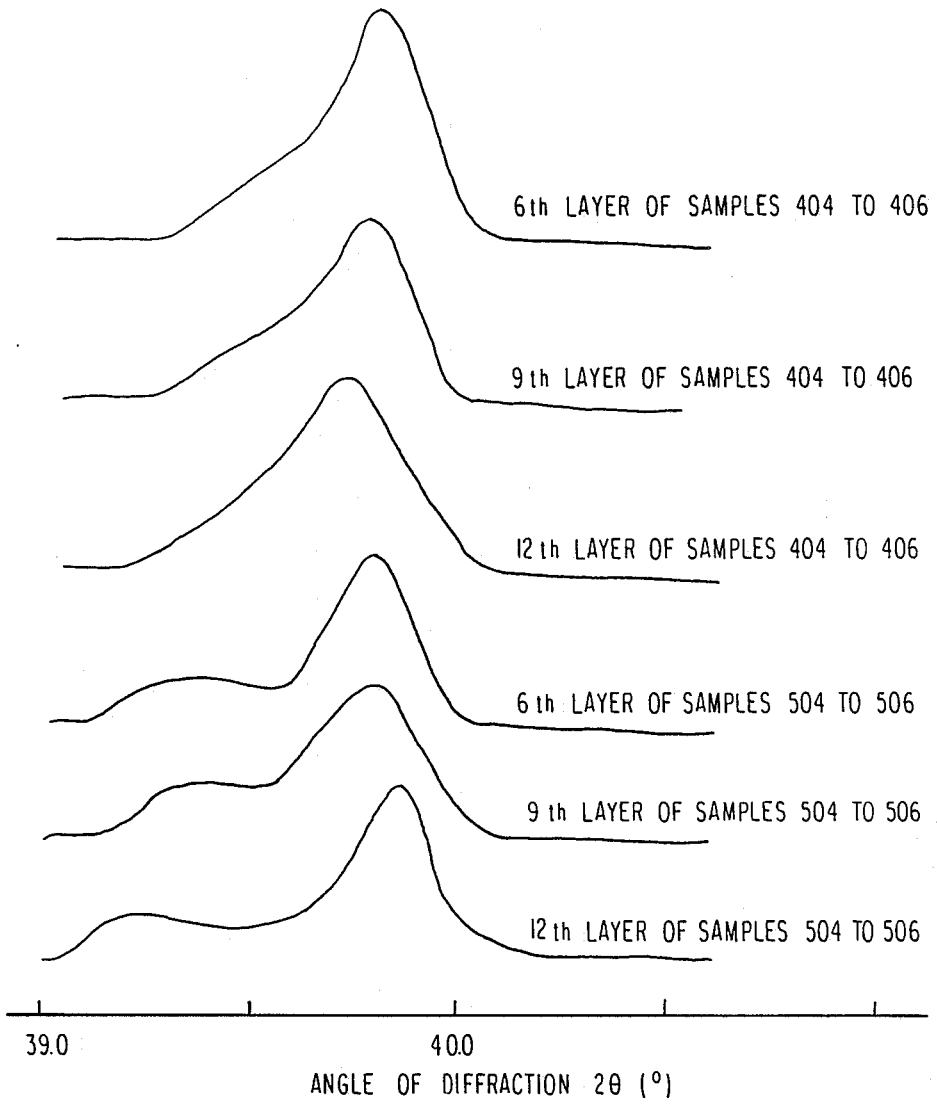

SILVER HALIDE COLOR NEGATIVE PHOTOGRAPHIC MATERIALS

This is a continuation of application Ser. No. 07/102,518 filed Sept. 29, 1987 now abandoned.

FIELD OF THE INVENTION

The present invention relates to color negative photographic light-sensitive materials, and in particular, to those for photograph-taking. The photographic light-sensitive materials of the present invention have intensified sharpness and high sensitivity which are improved to such an extent that the graininess does not deteriorate over the course of time after the manufacture of the materials. Further, photographic light-sensitive materials of the present invention have excellent pressure-resistance and have improved processability.

BACKGROUND OF THE INVENTION

Due to the recent progress in the art of photographic materials for photograph-taking use, newly developed photographic materials of high photographic speed have been highly commercialized. The expansion of the photographing environment depends on the attainment of high photographic speed in photographic materials, for instance, photographing in a dark room without a strobe light, photographing of., e.g., sports scenes, through a telephoto lens while rapidly handling the shutter, photographing requiring many hours of exposure, e.g., taking astrophotographs, and so on.

For the purpose of increasing the photographic speed of a photosensitive material, considerable efforts have been expended. A great number of methods for forming silver halide grains having a desired form and composition, chemical sensitization, spectral sensitization, additives, coupler structures, and so on have been developed. One method involves combining a method of enlarging the size of the silver halide grains with another method of increasing the photographic speed. This method has been a typical measure for producing a photosensitive material of high photographic speed in the photographic arts. However, the progress of the art of photography is still behind the requirements for photosensitive materials of a high photographic speed.

More specifically, although enlargement of the size of the silver halide emulsion grains can increase the photographic speed to some extent, it necessarily leads to a decrease in the number of silver halide emulsion grains, provided that the content of silver halide in the emulsion is maintained constant. As a results, the number of development initiation centers is decreased. Therefore, the increase in size of the silver halide grains entails a disadvantage in that the graininess is greatly spoiled. In order to offset this disadvantage, various methods have been proposed. For instance, a method of using a photosensitive material containing at least two emulsion layers which has the same color sensitivity, but different photographic speeds, that is, different grain sizes, respectively, as described in British Patent No. 923,045 and Japanese Patent Publication No. 15495/74; a method of using a rapidly reacting coupler, as described in Japanese Patent Application (OPI) No. 62454/80 (the term "OPI" as used herein means an "unexamined published application"); a method of using a so-called DIR coupler or DIR compound, as described in U.S. Pat. Nos. 3,227,554 and 3,632,435; a method of using a coupler capable of producing a diffusible dye, as described in British Patent No. 2,083,640; a method of using silver halide grains having a high mean silver iodids content, as described in Japanese Patent Application (OPI) No. 128443/85; and so on are well-known. Although these methods each has a great effect and can be said to be an excellent invention, they are still insufficient to meet many of the requirements for heightening both the photographic speed and the image quality. Therefore, in order to increase the grain size of the silver halide emulsion and at the same time, to increase the number of development initiation centers to as large as possible, high-speed color negative photosensitive materials have been designed to contain silver halide emulsion grains in the largest amount as possible so that various properties, such as the desilvering capacity at the time of bleach-fix processing, are not adversely effected.

It has recently been noted that high sensitivity photographic materials are unsatisfactory for the following reasons: First, these photographic materials often suffer from a deterioration of the photographic characteristics, including an increase of fog, a lowering of sensitivity, a deterioration of graininess, etc., over the course of time after the manufacture thereof until the use thereof. Second, the sharpness can not be sufficiently elevated, and hence the photographic materials can not meet the severe requirements as to the image quality of recent photographic materials. Third, the pressure-resistance is poor, and hence there is a high danger of causing unfavorable sensitization of the photographic materials under the present-day situation where the processing step in the laboratory is being speeded up and where automatic film-winding devices in cameras are being employed. Fourth, there also is a high danger of an insufficient fixation or insufficient silver-removal arising in the conventional high sensitivity photographic materials, since the developing time is being shortened and the amount of the processing solution replenisher is also being reduced in today with the popularization of mini-laboratories.

SUMMARY OF THE INVENTION

Accordingly, one object of the present invention is to provide color negative photographic materials for photograph-taking having intensified sharpness and high sensitivity such that the graininess does not deteriorate over the course of after the manufacture of the materials.

Another object of the present invention is to provide high sensitivity color negative photographic materials having excellent pressure-resistance and improved processability.

More specifically the present invention provides a silver halide color negative photographic material having at least one red-sensitive silver halide emulsion layer, at least one green-sensitive silver halide emulsion layer and at least one blue-sensitive silver halide emulsion layer on a support, which is characterized in that the combined total of silver contents in the material is from 3.0 g/m$^2$ and 8.0 g/m$^2$ and the specific photographic sensitivity of the material is from 320 to less than 800.

The "combined total of silver contents" herein refers to the total amount of the silver halide (as silver) contained in the emulsion layers and the colloidal silver contained in any other layers.

Although the present-day commercial high-sensitivity color negative films which are said to have an ISO-sensitivity of 400 have a silver content of 9 g/m$^2$ or more so as to have the necessary high sensitivity, the present inventors have found that the above-mentioned objects of the present invention can be achieved by adequately combining various high sensitivity-imparting techniques, as mentioned below, to thereby provide silver halide color negative photographic materials which have a specific photographic sensitivity of from 320 to less than and to have a combined total of silver contents of from 3.0 g/m$^2$ to 8.0 g/m$^2$.

The high sensitivity-imparting techniques include:

(1) Use of a yellow-filter dye as mentioned below.

(2) Use of a sensitizing dye (especially, a supersensitizing dye as mentioned below).

(3) Use of silver iodide or silver iodide-containing silver halide grains, especially, core-shell type two-layer silver halide grains in which the silver iodide concentration in the core part is large and the silver iodide concentration in the shell part is small.

(4) Use of a 2-equivalent coupler.

(5) Use of a high reactive coupler.

(6) The respective color-sensitive layers have a multilayer constitution comprising two or more layers where the upper layer (which is in the position most remote from the support) contains a smaller amount of silver so that the light-utilizing effect of the lower layer is improved.

(7) Use of silver halide grains in which the content of metal impurities, other than gold and iridium, is reduced to 3 ppm or less.

BRIEF DESCRIPTION OF DRAWING

The FIGURE shows X-ray diffraction profiles of the respective emulsions used in the emulsion layers in Samples Nos. 404 to 406 and 504 to 506 in Example 11.

DETAILED DESCRIPTION OF THE INVENTION

It has previously been noted that high sensitivity color negative photographic materials having a specific photographic sensitivity, which is specifically defined hereinafter, of 800 or more are adversely affected by natural radiation whereby the graininess of the materials is deteriorated. It was found that the abovementioned problems could be solved by employing high sensitivity color negative photographic materials having a combined total of silver contents of from 3 g/m$^2$ to 9 g/m$^2$, and a specific photographic sensitivity of from 800 to 6200 or so (Japanese Patent Application No. 201756/86).

It has been found in the present invention that high sensitivity color negative photographic materials having a specific photographic sensitivity of from 320 to less than 800 also exhibit deterioration of the graininess of the materials by natural radiation which is exposed thereto during storage for a long period of time of one year or more. It has been found in the present invention that this deterioration can be prevented and the color reproducibility and the sharpness of the materials can be improved and further there is no problem of generation of fog or deterioration of graininess when being exposed X-ray irradiation in, e.g. airports.

In the silver halide color negative photographic materials of the present invention, the specific photographic sensitivity is preferably from 400 to less than 800, and is more preferably from 500 to less than 800.

In the present invention, the specific photographic sensitivity, which is defined in detail hereinafter, is used as the definition of the sensitivity of the photographic materials, and this is because of the following reasons.

In general, the ISO speed, which is the international standard, is used as the photographic speed of photographic light-sensitive materials. In determining the ISO speed, the photosensitive materials are subjected to development-processing on the fifth day after exposure, using the developing process specified by each company. In the present invention the period from the conclusion of exposure to the start of development is reduced to 0.5 to 6 hours. The specific photographic sensitivity described below is the photographic speed then determined under the definite development-processing condition.

More specifically the term "specific photographic sensitivity" of a photosensitive material as used in the present invention refers to the photographic sensitivity determined according to the testing method described below, which follows the ISO speed, more specifically follows JIS K 7614-1981.

(1) Testing Condition

The test is carried out in a room kept at a temperature of 20°±5° C. and a relative humidity of 60±10%, and a photosensitive material is submitted to the test after it is allowed to stand for at least one hour under the above-mentioned condition.

(2) Exposure (i) The relative spectral energy distribution of the standard light on the exposed surface is so designed as to have the distribution described in Table A below.

TABLE A

| Wavelength (nm) | Relative Spectral Energy[1] |
|---|---|
| 360 | 2 |
| 370 | 8 |
| 380 | 14 |
| 390 | 23 |
| 400 | 45 |
| 410 | 57 |
| 420 | 63 |
| 430 | 62 |
| 440 | 81 |
| 450 | 93 |
| 460 | 97 |
| 470 | 98 |
| 480 | 101 |
| 490 | 97 |
| 500 | 100 |
| 510 | 101 |
| 520 | 100 |
| 530 | 104 |
| 540 | 102 |
| 550 | 103 |
| 560 | 100 |
| 570 | 97 |
| 580 | 98 |
| 590 | 90 |
| 600 | 93 |
| 610 | 94 |
| 620 | 92 |
| 630 | 88 |
| 640 | 89 |
| 650 | 86 |
| 660 | 86 |
| 670 | 89 |
| 680 | 85 |
| 690 | 75 |
| 700 | 77 |

Note

[1]The energy at 560 nm was standardized and taken as 100 and the other energy values were determined relative thereto.

(ii) The illumination on the exposed surface is changed by using an optical wedge, and the optical wedge to be employed is one which is designed so that fluctuation of the spectral transmission density in any part thereof is not more than 10% in the wavelength region of from 360 nm to less than 400 nm, and not more than 5% in the wavelength region of from 400 nm to 700 nm.

(iii) The exposure time is adjusted to 1/100 second.

(3) Development Processing (i) The photosensitive material to be tested is preserved in an atmosphere controlled to a temperature of 20°±5° C. and a relative humidity of 60±10% during the period from exposure to development processing.

(ii) The development processing is concluded within 30-minute to 6-hour after exposure.

(iii) The development processing is achieved by carrying out the following steps:

| | | |
|---|---|---|
| 1. | Color development | 3 min. 15 sec., 38.0 ± 0.1° C. |
| 2. | Bleaching | 6 min. 30 sec., 38.0 ± 3.0° C. |
| 3. | Washing | 3 min. 15 sec., 24~41° C. |
| 4. | Fixation | 6 min. 30 sec., 38.0 ± 3.0° C. |
| 5. | Washing | 3 min. 15 sec., 24~41° C. |
| 6. | Stabilization | 3 min. 15 sec., 38 ± 3.0° C. |
| 7. | Drying | below 50° C. |

The compositions of processing solutions used in the foregoing steps, respectively, are as follows.

| | |
|---|---|
| Color Developing Solution | |
| Diethylenetriaminepentaacetic Acid | 1.0 g |
| 1-Hydroxyethylidene-1,1-diphosphonic Acid | 2.0 g |
| Sodium Sulfite | 4.0 g |
| Potassium Carbonate | 30.0 g |
| Potassium Bromide | 1.4 g |
| Potassium Iodide | 1.3 mg |
| Hydroxylamine Sulfate | 2.4 g |
| 4-(N-Ethyl-N-β-hydroxyethylamino)-2-methyl-aniline Sulfate | 4.5 g |
| Water to make | 1.0 l |
| | pH 10.0 |
| Bleaching Solution | |
| Ammonium Ethylenediaminetetraacetato-ferrate (III) | 100.0 g |
| Disodium Ethylenediaminetetraacetate | 10.0 g |
| Ammonium Bromide | 150.0 g |
| Ammonium Nitrate | 10.0 g |
| Water to make | 1.0 l |
| | pH 6.0 |
| Fixing Solution | |
| Disodium Ethylenediaminetetraacetate | 1.0 g |
| Sodium Sulfite | 4.0 g |
| Aqueous Solution of Ammonium Thiosulfate (70%) | 175.0 ml |
| Sodium Bisulfite | 4.6 g |
| Water to make | 1.0 l |
| | pH 6.6 |
| Stabilizing Solution | |
| Aqueous Solution of Formaldehyde (40%) | 2.0 ml |
| Polyoxyethylene-p-monononylphenyl Ether (average polymerization degree: 10) | 0.3 g |
| Water to make | 1.0 l |

(4) Measurement of Density

The density is represented by $\log_{10}(\phi_0/\phi)$. $\phi_0$ is the luminous flux of lighting for the density measurement, and $\phi$ is the luminous flux transmitted by the area to be measured. A geometric relationship of the density measurement is as follows: The luminous flux for lighting is the parallel flux whose incident direction is perpendicular to the surface to be luminated, and all of the luminous flux transmitted by the photosensitive material, and diffusing into the half-space, is adopted as the standard of the transmitted luminous flux. When the measurement is carried out using a method other than the above-described one, correction is made using the standard density. When the measurement is carried out, the emulsion film surface is set so as to face the light-receiving apparatus. In determining the density, standard M densities of blue, green and red, respectively, are adopted, and spectral characteristics thereof are so designed as to become the values shown in Table B by taking into account collectively the characteristics of a light source installed in the densitometer used, the optical system used, the optical filters used and the light-receiving apparatus used.

TABLE B

Spectral Characteristics of Standard M Density (logarithmic scale, standardization of peak as 5.00)

| Wavelength (nm) | Blue | Green | Red |
|---|---|---|---|
| 400 | * | ↓ | ↓ |
| 410 | 2.10 | ↓ | ↓ |
| 420 | 4.11 | ↓ | ↓ |
| 430 | 4.63 | * | * |
| 440 | 4.37 | ↓ | ↓ |
| 450 | 5.00 | ↓ | ↓ |
| 460 | 4.95 | ↓ | ↓ |
| 470 | 4.74 | 1.13 | ↓ |
| 480 | 4.34 | 2.19 | ↓ |
| 490 | 3.74 | 3.14 | ↓ |
| 500 | 2.99 | 3.79 | ↓ |
| 510 | 1.35 | 4.25 | ↓ |
| 520 | ↓ | 4.61 | ↓ |
| 530 | ↓ | 4.85 | ↓ |
| 540 | ↓ | 4.98 | ↓ |
| 550 | ** | 4.98 | ↓ |
| 560 | ↓ | 4.80 | ↓ |
| 570 | ↓ | 4.44 | ↓ |
| 580 | ↓ | 3.90 | * |
| 590 | ↓ | 3.15 | ↓ |
| 600 | ↓ | 2.22 | ↓ |
| 610 | ↓ | 1.05 | ↓ |
| 620 | ↓ | ↓ | 2.11 |
| 630 | ↓ | ↓ | 4.48 |
| 640 | ** | ** | 5.00 |
| 650 | ↓ | ↓ | 4.90 |
| 660 | ↓ | ↓ | 4.58 |
| 670 | ↓ | ↓ | 4.25 |
| 680 | ↓ | ↓ | 3.88 |
| 690 | ↓ | ↓ | 3.49 |
| 700 | ↓ | ↓ | 3.10 |
| 710 | ↓ | ↓ | 2.69 |
| 720 | ↓ | ↓ | 2.27 |
| 730 | ↓ | ↓ | 1.86 |
| 740 | ↓ | ↓ | 1.45 |
| 750 | ↓ | ↓ | 1.05 |
| | | | ** |

Note
*Slope of Red: 0.260/nm, Slope Green: 0.106/nm, and Slope of Blue: 0.250/nm.
**Slope of Red: 0.040/nm, Slope of Green: 0.120/nm, and Slope of Blue: 0.220/nm.

(5) Determination of Specific Photographic Sensitivity

The specific photographic sensitivity is determined using the results obtained by processing and submitting the photosensitive material to the density measurement under the foregoing conditions (1) to (4) in accordance with the following procedure.

(i) Exposures corresponding to the densities higher than the minimum densities of their respective colors, blue, green and red, by 0.15, are expressed in terms of lux sec, and represented by $H_B$, $H_G$ and $H_R$, respectively.

(ii) Of values $H_B$ and $H_R$, one having the larger value (lower sensitivity) is taken as $H_S$.

(iii) The specific photographic sensitivity S is calculated according to the following equation.

$$S = \sqrt{\frac{2}{H_G \times H_S}}$$

In the photographic materials of the present invention, the specific photographic sensitivity as determined by the above-mentioned method is from 320 to less than 800. As apparent from the experimental examples to follow hereinafter, if the sensitivity is less than 320, not only the photograph-taking in a dark room without the use of strobe flash, photograph-taking with a telephoto lens and high-speed shutter for sports photographs and the photograph-taking of astrophotographs would be impossible but, also, the failure probability in general photograph-taking, including out-of-focus or under-exposure, would increase.

In the photographic materials of the present invention, the specific photographic sensitivity is preferably from 400 to less than 800, and is more preferably from 500 to less than 800.

The combined total of silver contents in the photographic materials of the present invention is from 3.0 g/m$^2$ to 8.0 g/m$^2$. Hitherto, the combined total of silver contents in commercial high-sensitivity color negative films having a sensitivity of 320 or more is set relatively large so as to intensify the sensitivity and the graininess, as described, for example, in Japanese Patent Application (OPI) No. 147744/83. (The term "OPI" as used herein refers to a "published unexamined Japanese patent application".) If, however, the combined total of silver contents is 8.0 g/m$^2$ or more, the graininess was found to deteriorate to such a degree that a practical problem arose caused exposure to by natural radiation after about a half year to two years. Despite the fact, it is surprising that the deterioration of the graininess by natural radiation could remarkably be suppressed when the combined total of silver contents is reduced to 8.0 g/m$^2$ or less. Further, although improvement of the sharpness by the reduction of the combined total of silver contents is expected to some degree, the degree of the improvement was actually far higher than that expected. However, if the combined total of silver contents is less than 3.0 g/m$^2$, the maximum density to be required for color negative photographic materials could not be ensured.

The combined total of silver contents in the photographic materials of the present invention is more preferably from 3.0 g/m$^2$ to 7.0 g/m$^2$.

The "combined total of silver contents" as referred to herein means the total amount of the silver in the silver halides and metallic silver in the photographic materials. For analysis of the combined total of silver contents in photographic materials, a number of methods are known. In the present invention, although any known method can be used, a fluorescent X-ray method is conveniently employed because of its simplicity.

Although the photographic materials of the present invention comprise one or more red-sensitive silver halide emulsion layers, one or more green-sensitive silver halide emulsion layers and one or more blue-sensitive silver halide emulsion layers, it is preferred that any of the emulsion layers having the same color-sensitivity comprise two or more emulsion layers each having a different sensitivity degree, and in particular, it is more preferred that any of the emulsion layers have a three-layer constitution so as to further improve the graininess. Such a technique is described in British Patent No. 932,045 and Japanese Patent Publication No. 15495/74. When a photographic material has a color-sensitive emulsion layer comprises two constituent layers the toe sensitivity difference of these two layers is preferably from 0.05 to 1.5 by Δlog E unit (E: exposure), and when a photographic material has a color-sensitive layer comprises three constituent layers each toe sensitivity difference between two adjacent layers thereof is preferably from 0.05 to 1.0 by Δlog E unit. These arts are described in British Patent No. 923,045 and Japanese Patent Publication No. 15495/74, respectively.

It is known in the art that in producing a color negative photographic material comprising emulsion layers sensitive to the same color and being constituted with two or more layers differing in photographic speed, that in order to ensure high image quality the constituent layer having a higher (faster) photographic speed is designed so as to have the higher silver content because a so-called graininess disappearing effect can be utilized. However, the high-speed color negative photographic materials having a specific photographic sensitivity from 320 to less than 800 have turned out to suffer from an unexpected disadvantage that deterioration in the photographic properties due to storage is more serious in the case where silver is contained in a larger amount in the constituent layer of a higher photographic speed than in the case where silver is contained in a larger amount in the constituent layer of a lower photographic speed. Accordingly, it is preferred to design the constituent layer having the highest photographic speed among those having the same color sensitivity so as not to contain as much silver. The combined total of silver coverages of the constituent layer having the highest photographic speed among those having the same color sensitivity, that is, red sensitivity, green sensitivity or blue sensitivity, ranges from 0.3 g/m$^2$ to 1.8 g/m$^2$, preferably from 0.3 g/m$^2$ to 1.6 g/m$^2$, and more preferably from 0.3 g/m$^2$ to 1 4 g/m$^2$.

In order to acquire both high photographic speed and high image quality, various inventions regarding the order of the layer arrangement have been made. The techniques proposed in these invention may be used in combination. The inventions regarding the order of the layer arrangement are described, e.g., in U.S. Pat. Nos. 4,184,876, 4,129,446 and 4,186,016, British Patent No. 1,560,965, U.S. Pat. Nos. 4,186,011, 4,267,264, 4,173,479, 4,157,917 and 4,165,236, British Patent Nos. 2,138,962, and 2,137,372. Japanese Patent Application (OPI) Nos. 177,552/84, 180556/84 and 204038/84, and so on.

In addition, a light-insensitive layer may be arranged between any two of the constituent layers having the same color sensitivity.

A reflecting layer comprising fine-grained silver halide or the like may be provided beneath a high-speed constituent emulsion layer, particularly the high-speed blue-sensitive constituent emulsion layer for the purpose of further enhancement of the photographic speed, e.g., as described in Japanese Patent Application (OPI) No. 160135/84.

Although it is general to incorporate a cyan forming coupler in a red-sensitive emulsion layer, a magenta forming coupler in a green-sensitive emulsion layer, and a yellow forming coupler in a blue-sensitive emulsion layer, combinations other than the above-described one can be employed, if needed. For instance, a pseudocolor photographic material or photographic materials suitable for exposure to a semiconductor laser can be obtained by combining an infrared-sensitive emulsion layer with green- and red-sensitive emulsion layers.

Other specific examples of photographic materials which can be used, in the present invention include a photographic material having RL, GL and BL as described above and an emulsion layer containing neutral-dye forming coupler provided at the position farthest away from the support, as described in U.S. Pat. No. 3,497,350, or a photographic material having a light-sensitive layer unit in the high sensitivity color emulsion layer area wherein the light-sensitive layer unit is capable of producing a color density of from 0.05 to 0.4 upon development, the remaining color density being produced by a second light-sensitive layer unit comprising a blue-sensitive layer, a green-sensitive layer and a red-sensitive layer which is provided between the light-sensitive layer unit and the support. The unit comprises:

(a) a silver halide light-sensitive layer which contains a color-forming combination of (a-1) a yellow image-forming coupler, (a-2) a magenta image forming coupler, and (a-3) a cyan colored coupler, and which is blue-sensitive and green sensitive; and (b) a silver halide light-sensitive layer which contains a color-forming combination of (b-1) a cyan image-forming coupler, (b-2) a magenta image-forming coupler, and (b-3) a yellow colored coupler, and which is green-sensitive and red-sensitive, as described in U.S. Pat. No. 4,647,527 (corresponding to Japanese Patent Application (OPI) No. 214853/84) can be employed.

In the photographic emulsion layer of the silver halide photographic material of the present invention, silver bromide, silver iodobromide, silver iodochlorobromide, silver chlorobromide or silver chloride may be used as the silver halide. The preferred silver halide is silver iodobromide having an iodide content of less than 30 mole %. In particular, silver iodobromide having an iodide content ranging from 2 to 20 mole % is advantageously employed in the present invention. In order to obtain both high photographic speed and high image quality, the average of iodide contents in all of the silver halides contained in all of the emulsion layers is preferably adjusted to 8 mole % or more, as described in Japanese Patent Application (OPI) No. 128443/85. It is known that graininess can be greatly improved by an increase in the average silver iodide content. On the other hand, an increase in the silver iodide content beyond a certain limit retards the progress of development, desilvering, fixation and so on. In the present invention, however, these defects do not arise even when the silver iodide content is increased more and more. This is believed to be because the total content of silver in the photographic material of the present invention is low. This matter is also favorable.

It is to be desired that silver halide grains used for photographic emulsions which constitute the silver halide photographic material of the present invention should have a double-layer structure constructed by a core made up substantially of silver iodobromide having silver iodide content of more than 5 mole %, and a shell surrounding the core, which is made up substantially of silver iodobromide having a silver iodide content lower than that in the core or silver bromide. A preferred silver iodide content in the core is at least 10 mole %, and a particularly preferred one is within the range of from 20 mole % to 44 mole %. A preferred silver iodide content in the shell is not more than 5 mole %.

The core may contain silver iodide homogeneously, or may have a multiple structure consisting of some phases differing in silver iodide content. In the latter case, the silver iodide content in the phase having the highest silver iodide content is 5 mole % or more, more preferably 10 mole % or more, while the silver iodide content in the shell may be lower than the highest silver iodide content among those in the core phases. The expression "made up substantially of silver iodobromide" means that the main component is silver iodobromide, but another component may be contained in a fraction of at most about 1 mole % or so.

A more preferred embodiment of silver halide grains to be used for the photographic emulsion layers to constitute the silver halide photographic material of the present invention is as follows: When the intensities of diffraction of Cu-K$\beta$ rays taking place at the (220) face of the silver halide are plotted against the diffraction angles ($2\theta$) ranging from 38° to 42°, a diffraction peak corresponding to the core part, and a diffraction peak corresponding to the shell part and having two diffraction maxima and one minimum present therebetween appear. As for these two peaks, it is desirable for the structure of the silver halide grains that the diffraction intensity corresponding to the core part is controlled to 1/10 to 3/1 times, preferably 1/5 to 3/1 times, and more preferably $\frac{1}{3}$ to 3/1 times, that corresponding to the shell part.

Owing to the above-described double structure, it becomes feasible to use a silver iodobromide emulsion having a high iodide content without being accompanied by a decrease in the developing speed. As a result, a photosensitive material having excellent graininess, notwithstanding the smallness of the combined total of silver coverages, can be attained.

The silver halide grains to be used for the photographic emulsion layers to constitute the silver halide photographic material of the present invention are preferably monodisperse. The terminology "emulsion made up of monodisperse silver halide grains" as used in the present invention refers to the emulsion made up of silver halide grains having a variation coefficient of not more than 16%. The variation coefficient is defined as the value obtained by dividing the standard deviation of the grain sizes (S) by a mean grain size ($\bar{r}$) and further multiplying the quotient by 100, as shown by the following equation:

$$\frac{S}{\bar{r}} \times 100 \leqq 16\%$$

In the above formula, S is the general standard deviation used in statistics. The grain size as used herein refers to the diameter of the grain, in case of spherical silver halide grains, while it refers to the diameter of the circle having the same area as the projected area of the grain, in case of grains having a shape other than spherical one. The average grain size is the average value of the diameters defined above. When the number of grains having a grain diameter of $r_1$ is $n_1$, the average grain size ($\bar{r}$) is defined by the following equation:

$$r = \frac{\Sigma n_1 r_1}{\Sigma n_1}$$

In the photographic materials of the present invention, if the grain size variation factor exceeds 16%, there are some cases that the graininess deterioration by natural radiation can not be sufficiently suppressed even though the combined total of silver contents is set within the range of from 3.0 g/m$^2$ to 8.0 g/m$^2$. Although the reason for this is not clear, it is believed that the emulsion of a high mono-dispersion would hardly be affected by natural radiation as such does not contain any large grains having a high probability of trapping secondary electrons generated in the photographic material by exposure to natural radiation. In addition, if the grain size variation factor exceeds 16%, sufficient fixation speed and bleaching speed can not be attained in the development procedure, even though the combined total of silver contents is set within the range of from 3.0 g/cm$^2$ to 8.0 g/m$^2$, and hence there is a possibility of problems, including fixation insufficiency or bleaching insufficiency, upon acceleration of the rapid processing and reduction of the replenisher amount of processing solutions. Furthermore, if the grain size variation factor exceeds 16%, any sufficient pressure-resistance can not be imparted to the photographic materials, even through the combined total of silver contents is set within the range of from 3.0 g/m$^2$ to 8.0 g/m$^2$, and hence there is a possibility of a pressure accident, such as problem sensitization of the photographic material when the processing step in the laboratory is speed-up or when a camera with an automatic high-speed winding mechanism is used.

Accordingly, it is preferred in the photographic materials of the present invention that each of the blue-sensitive, green-sensitive and red-sensitive silver halide emulsion layers contain at least one emulsion having the above-mentioned monodisperse silver halide grains. Further, it is especially preferable that all of the emulsion layers contain an emulsion having the above-mentioned monodisperse silver halide grains.

In the manufacture of the photographic materials of the present invention, although the method for preparing the monodisperse silver halide emulsions is not specifically limitating, a so-called double-jet method where an aqueous solution of a silver nitrate and an aqueous solution of a mixture comprising an alkali metal iodide and bromide are blended in the presence of a protective colloid is generally employed. It is desired that the pAg value in the reaction system is kept constant within the range of from 7.0 to 10.0, more preferably from 8.0 to 9.0, during the addition of the solutions. In addition, the degree of supersaturation of the solutions being added is preferably higher, and for example, it is effective to add the solutions with an increase of the concentration of the solutions being added so that the crystal growth rate may be from 30 to 100% of the critical growth rate, as described in U.S. Pat. No. 4,242,445. Further, it is preferred to incorporate an adequate amount of a silver halide solvent such as ammonia, thiocyanates and thioether compounds into the reaction system during the addition of the solutions.

The size of the silver halide grains for use in the photographic materials of the present invention is preferably from 0.2 μm to 10 μm, as the diameter of the corresponding spheres. In the case where the specific photographic sensitivity is from 320 to less than 800, the size of the silver halide grains for use in the blue-sensitive emulsion layer is preferably from 0.3 pm to 1.8 μm, more preferably from 0.3 μm to 1.4 μm, as the diameter of the corresponding spheres. The size of the silver halide grains for use in the green-sensitive and red-sensitive emulsion layers is preferably from 0.3 μm to 1.4 μm, more preferably from 0.3 μm to 1.1 μm, as the diameter of the corresponding spheres. If emulsion grains which are larger than the above upper limit are used, the graininess is poor and further the graininess deterioration by natural radiation becomes great. As a result, the use of such large emulsion grains is unfavorable. If, on the contrary, emulsion grains which are smaller than 0.3 μm are used, the interlayer effect becomes poor and the color-reproducibility also becomes poor.

The silver halide grains in the photographic emulsions in the photographic materials of the present invention may have a regular crystal form such as cubic or octahedral form or an irregular crystal form such as spherical or tabular form, or a composite form of these crystal forms. In particular, normal crystals are especially preferred. The emulsion for use in the present invention may be a mixture of silver halide grains of different crystal forms.

Moreover, emulsions containing super-tabular silver halide grains having a diameter greater than its thickness by a factor of at least 5 in an amount of at least 50% of the entire silver halide grains therein on a projective area basis may be used.

Further, the silver halide emulsion layers for use in the present invention preferably contain chemically-sensitized silver halide grains which have a total content of metal impurities, other than gold and iridium, of 3 ppm or less. By the use of such silver halide emulsions, it is possible to obtain silver halide photographic materials with high sensitivity.

For preparation of silver halide emulsions where the content of metal impurities (except gold and iridium) contained in the silver halide grains is extremely small as mentioned above, various techniques can adequately be combined, including purification of raw materials which are indispensable for the preparation of the silver halide emulsions, such as water, hydrophilic colloids, e.g., gelatin, soluble silver salts, e.g., silver nitrate, soluble alkali halides, e.g., KBr, KCl, KI, NaBr, NaCl, etc., so as to remove any metal impurities from the said raw materials, prevention of transference of any metal impurities from the reaction container into the silver halide emulsion during the preparation of the emulsion and control of the reaction temperature and the reaction conditions.

These photographic emulsions can be prepared using various methods as described, e.g., in P. Grafkides, *Chimie et Physique Photographique,* Paul Montel, Paris (1967), G. F. Duffin, *Photographic Emulsion Chemistry,* The Focal Press, London (1966), V. L. Zelikman, et al, *Making and Coating Photographic Emulsion,* The Focal Press, London (1966) and so on. More specifically, any processes, e.g., the acid process, the neutral process, the ammoniacal process and so on, can be employed.

Suitable methods for reacting a water-soluble silver salt with a water-soluble halide include, e.g., a single jet method, a double jet method or a combination thereof.

Also, a method in which the silver halide grains are produced in the presence of excess silver ion (the so-called reverse mixing method) can be employed. Moreover, the so-called controlled double jet method, in which the pAg of the liquid phase in which the silver halide grains are to be precipitated is maintained constant, may be employed. According to this method, silver halide emulsions having a regular crystal form and an almost uniform grain size can be obtained.

Two or more kinds of silver halide emulsions prepared separately may be used in a form of mixture.

Silver halide grains having a crystal face defined by Miller indices (n n 1) (n is an integer number of 2 or more) at the outer surface, as described in Kokai Giho No. 86-9598, are preferably contained in the silver halide emulsion to be used in the present invention.

Also, silver halide emulsion grains the insides of which have cavities running from the surface towards the inner part, as described in Japanese Patent Application (OPI) No. 75337/86, can be used. As the above-described silver halide emulsion grains have a great specific surface area, they can easily acquire high sensitivity by color sensitization, compared with those having the same volume. Therefore, the silver halide emulsion grains of the foregoing kind can achieve fully their effect in the combination with the present invention.

In addition, composite grains obtained by using a silver salt differing in composition from the host grains and producing the epitaxial growth of the silver salt on the individual surfaces of the host grains, as described in Japanese Patent Application (OPI) Nos. 133540/82, 108526/83 and 162540/84, can be preferably used in the present invention. Since such composite grains possess high sensitivity and high contrast, they are favorable for use in the present invention.

Further, silver halide emulsion grains made to grow in the presence of tetrazaindenes, as described in Japanese Patent Application (OPI) Nos. 14630/86 and 122935/85, can be favorably employed as those for the present invention because they can attain a high iodide content and excellent monodispersibility and thereby, can provide a high photographic speed and excellent graininess.

Furthermore, silver halide emulsions which have undergone gold-sulfur sensitization or gold-selenium sensitization in the presence of a nitrogen-containing heterocyclic compound, as described in Japanese Patent Application (OPI) No. 126526/83, are used to advantage in the present invention because they can achieve low fog density and high photographic sensitivity.

Moreover, slightly roundish cubic or tetradecahedral grains, as described in Japanese Patent Application (OPI) Nos. 149345/84 and 149344/84, are used to advantage in the present invention because they can attain high photographic sensitivity.

In a process of producing silver halide grains or allowing the produced silver halide grains to ripen physically, cadmium salts, zinc salts, lead salts, thallium salts, iridium salts or complexes, rhodium salts or complexes, iron salts or complexes and/or the like may be present.

In particular, silver halide emulsions comprising grains produced in the presence of iridium (as described Japanese Patent Publication Nos. 4935/68 and 32738/70) are preferred over others in the present invention because of their high photographic sensitivity.

After formation of silver halide precipitates or physical ripening thereof, soluble salts are removed from the emulsion. The removal can be effected using the noodle washing method which comprises gelling the gelatin, or using a sedimentation process (thereby causing flocculation in the emulsion) taking advantage of an inorganic salt comprising a polyvalent anion, such as sodium sulfate, an anionic surface active agent, an anionic polymer (e.g., polystyrene sulfonic acid), or a gelatin derivative (e.g., an aliphatic acylated gelatin, an aromatic acylated gelatin, an aromatic carbamoylated gelatin, etc.).

In general, the silver halide emulsions are chemically sensitized. Chemical sensitization can be carried out using processes described, for example, in H. Frieser, *Die Grndlagen der Photographischen Prozesse mit Sibler-halogeniden,* pp. 675–734, Akademische Verlagsgesellschaft (1968).

More specifically, sulfur sensitization using active gelatin, or compounds containing sulfur capable of reacting with silver ions (e.g., thiosulfates, thioureas, mercapto compounds, and rhodanines); reduction sensitization using reducing materials (e.g., stannous salts, amines, hydrazine derivatives, formamidine sulfinic acid, and silane compounds); noble metal sensitization using noble metal compounds (e.g., gold complexes, and complexes of other Group VIII metals such as Pt, Ir, Pd, etc.); and so on can be employed individually or as a combination thereof.

The photographic emulsions to be used in the present invention are spectrally sensitized using methine dyes or other dyes, if desired. Suitable spectral sensitizing dyes which can be used include cyanine dyes, merocyanine dyes, complex cyanine dyes, complex merocyanaine dyes, holopolar cyanine dyes, hemicyanine dyes, styryl dyes, and hemioxonol dyes. Especially useful dyes are cyanine dyes, merocyanine dyes and complex merocyanine dyes. Any nuclei usually present in cyanine dyes can be the basic heterocyclic nuclei of these dyes. More specifically, basic heterocyclic nuclei include pyrroline, oxazoline, thiazoline, pyrrole, oxazole, thiazole, selenazole, imidazole, tetrazole, pyridine and like nuclei; nuclei formed by fusing together one of the above-described nuclei and an alicyclic hydrocarbon ring; and nuclei formed by fusing together one of the above-described nuclei and an aromatic hydrocarbon ring. Specific examples of these nuclei include indolenine, benzindolenine, indole, benzoxazole, naphthoxazole, benzothiazole, naphthothiazole, benzoselenazole, benzimidazole, quinoline and like nuclei. Each of these nuclei may also be substituted on a carbon atom of each of these nuclei.

The merocyanine and complex merocyanine dyes can contain 5- or 6-membered heterocyclic nuclei such as pyrazoline-5-one, thiohydantoin, 2-thioxazolidine-2,4-dione, thiazolidine-2,4-dione, rhodanine, thiobarbituric acid and the like nuclei, as ketomethylene structure-containing nuclei.

Specific examples of useful sensitizing dyes include those described in German Pat. No. 929,080, U.S. Pat. Nos. 2,231,658, 2,493,748, 2,503,776, 2,519,001, 2,912,329, 3,656,959, 3,672,897, 3,694,217, 4,025,349 and 4,046,572, British Pat. No. 1,242,588, and Japanese Patent Publication Nos. 14030/69 and 24844/77.

These sensitizing dyes may be used individually or in combination. A combination of sensitizing dyes are often used for the purpose of supersensitization. Typical examples of supersensitizing combinations are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Pat. Nos. 1,344,281 and 1,507,803, Japanese Patent Publication Nos. 4936/68 and 12375/78, and Japanese Patent Application (OPI) Nos. 110618/77 and 109925/77.

Materials which can exhibit a supersensitizing effect in combination with a certain sensitizing dye, although they themselves do not spectrally sensitize silver halide emulsions or do not absorb light in the visible region, may be incorporated in the emulsion. For example, aminostyryl compounds substituted with a nitrogen-containing heterocyclic group (such as those described in U.S. Pat. Nos. 2,933,390 and 3,635,721), aromatic organic acid-formaldehyde condensates (e.g., those described in U.S. Pat. No. 3,743,510), cadmium salts, azaindene compounds and so on may be incorporated. Combinations which are disclosed in U.S. Pat. Nos. 3,615,613, 3,615,641, 3,617,295 and 3,635,721 are especially useful.

Silver halide emulsions to be used in the color negative photographic materials of the present invention, which are characterized by their specific photographic sensitivity of from 320 to less then 800, are spectrally sensitized using the above-described methods in order to heighten their sensitivities to visible rays of the wavelengths required. For the purpose of minimizing deterioration of the photographic properties by natural radiations, it is desired that the radiation sensitivity of the silver halide emulsions should be controlled to the lowest possible level. It has been found in the present invention that the radiation sensitivity of a silver halide emulsion has good correlation with the so-called intrinsic sensitivity, but a correlation is not always present between the radiation sensitivity and the so-called dye-sensitized sensitivity. Therefore, emulsions having high dye-sensitized sensitivity but low intrinsic sensitivity are used to advantage in order to diminish the extent of deterioration caused in the photographic properties by natural radiations. Specifically, the above-described supersensitizing agents which can increase the dye-sensitized sensitivity alone without changing the intrinsic sensitivity can be particularly preferably employed for the above purpose. On the other hand, it is also advantageous that the intrinsic sensitivity is reduced by the so-called intrinsic desensitization which consists of the addition of a sensitizing dye in the largest possible amount so that the addition causes only a small lowering of the dye-sensitized sensitivity. Further, tabular silver halide grains having an aspect ratio of 5 or above, which can be spectrally sensitized by sensitizing dyes at high efficiency, are favorably employed in a photographic material of a high photographic speed of the present invention.

Tabular grains can be prepared with ease using methods as described, e.g., Gutoff, *Photographic Science and Engineering,* Vol. 14, pp. 248–257 (1970), U.S. Pat. Nos. 4,434,226, 4,414,310, 4,433,048 and 4,439,520, British Pat. No. 2,112,157, and so on.

In the present invention, the silver halide emulsions which have received supersensitization using the compounds represented by the following general formula (I), which are disclosed in Japanese Patent Application No. 122759/85, are employed to particular advantage:

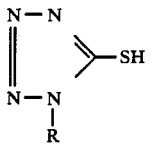

(I)

(wherein R represents an aliphatic, aromatic or heterocyclic residue substituted with at least one —COOM or —$SO_3M$; M represents a hydrogen atom, an alkali metal, a quaternary ammonium or a quaternary phosphonium).

Specific examples of the compounds represented by the foregoing general formula (I) which can be preferably used in the present invention are illustrated below. However, the invention should not be construed as being limited to these examples.

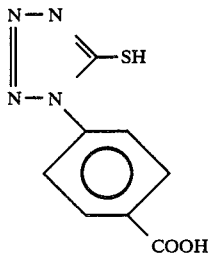

(1)

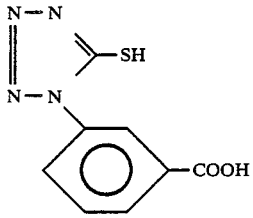

(2)

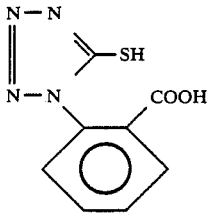

(3)

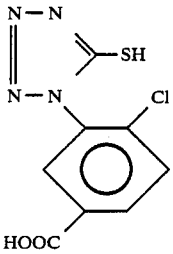

(4)

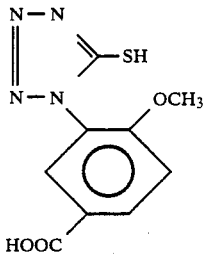

(5)

-continued (6)

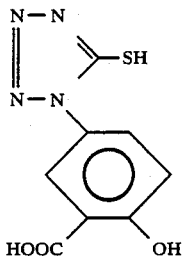

(7)

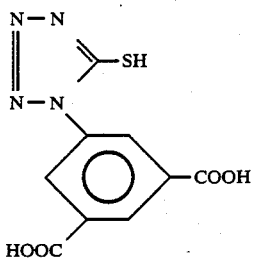

(8)

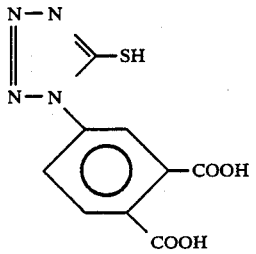

(9)

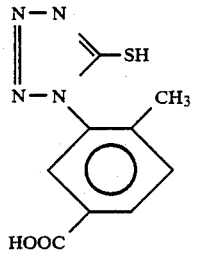

(10)

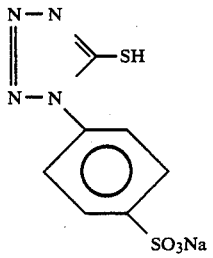

(11)

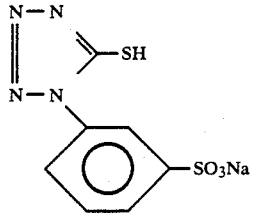

-continued (12)

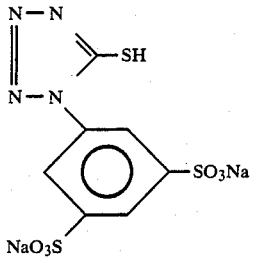

(13)

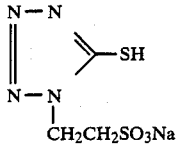

(14)

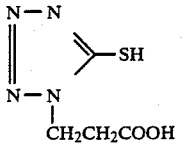

(15)

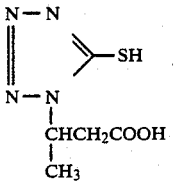

Into the photographic emulsion layers to be used in the present invention, color couplers are incorporated as dye image forming substances.

Suitable examples of magenta couplers include 5-pyrazolone couplers, pyrazolobenzimidazole couplers, cyanoacetylcoumarone couplers, open-chain acylacetonitrile couplers and so on. Examples of yellow couplers include acylacetoamide couplers (e.g., benzoylacetoanilides and pivaroylacetoanilides) and so on. Examples of cyan couplers include naphthol couplers, phenol couplers and so on. It is desired that these couplers are rendered nondiffusible by containing a hydrophobic group called a ballast group or being in a polymerized form. Moreover, though couplers may be either two-equivalent or four-equivalent to the silver ion, two-equivalent color couplers are preferred to four-equivalent couplers in order to reduce the silver coverage, because the former has higher efficiency in utilizing silver. When the color sensitive emulsion layers each, that is, a red-sensitive layer, a green-sensitive layer and a blue-sensitive layer each, is constituted by two or more layers having the same color sensitivity but different photographic speeds, it is advantageous in the invention that the constituent layer having the highest photographic speed among those having the same color sensitivity contains a two-equivalent coupler.

Conversion of four-equivalent couplers to two-equivalent couplers has been studied, and a number of two-equivalent cyan and yellow couplers are put to practical use owing to their high color-formability and high stability. As for the two-equivalent magenta couplers, however, they are difficult to use practically because of their inferiority in terms of stability and color formability. For instance, there have been proposed many attempts to convert 5-pyrazolone type couplers, which have mainly been used as magenta couplers, to two-equivalent ones. Specifically, they are substituted at the 4-position by a thiocyano group as described in U.S. Pat. Nos. 3,214,437 and 3,253,924, by an aryloxy group as described in U.S. Pat. No. 3,419,391, by a 2-triazol group as described in U.S. Pat. No. 3,617,291, by a halogen atom as described in U.S. Pat. No. 3,522,052, and by an alkylthio group, an arylthio group or a heterocyclylthio group as described in U.S. Pat. No. 3,227,554, respectively.

However, these pyrazolone couplers substituted at the 4-position have disadvantages in that they cause marked generation of color fog, their coupling activities are too small to be used practically, they are unstable chemically and change to compounds incapable of forming colors over the course of time, they are difficult to synthesize, and/or so on.

The above-described disadvantages of two-equivalent couplers can be overcome by using magenta couplers represented by the following general formula (II) or (III). Accordingly, it is preferred to use the magenta couplers represented by the general formula (II) or (III) as a two-equivalent magenta coupler to be employed in the green-sensitive constituent layer having the highest photographic speed.

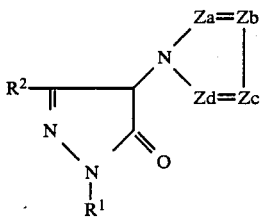

(II)

wherein $R^1$ represents an aromatic, aliphatic or heterocyclic group; $R^2$ represents a substituent group; and Za, Zb, Zc and Zd each represents an unsubstituted or substituted methine group, or —N=.

Suitable substituent groups for the magenta couplers of formula (II) are described in detail below.

In general formula (II), the aliphatic group represented by $R^1$ is one which has 1 to 32, preferably 1 to 22, carbon atoms, with specific examples including straight or branched chain alkyl groups (such as methyl, isopropyl, tert-butyl, hexyl, dodecyl, etc.), alkenyl groups (such as allyl), cyclic alkyl groups (such as cyclopentyl, cyclohexyl, norbornyl, etc.), aralkyl groups (such as benzyl, β-phenylethyl, etc.), and cyclic alkenyl groups (such as cyclopentenyl, cyclohexenyl, etc.). These aliphatic groups each may be substituted by a halogen atom, a nitro group, a cyano group, an aryl group, an alkoxy group, an aryloxy group, a carboxyl group, an alkylthiocarbonyl group, an arylthiocarbonyl group, an alkoxycarbonyl group, an aryloxycarbonyl group, a sulfo group, a sulfamoyl group, a carbamoyl group, an acylamino group, a diacylamino group, an ureido group, an urethane group, a thiourethane group, a sulfonamido group, a heterocyclic group, an arylsulfonyl group, an alkylsulfonyl group, an arylthio group, an alkylthio group, an alkylamino group, a dialkylamino group, an anilino group, an N-arylanilino group, an N-alkylanilino group, an N-acylanilino group, a hydroxy group, a mercapto group, or so on.

When $R^1$ represents an aromatic group (e.g., a phenyl group, α- or β-naphtyl group, etc.), it may be substituted by one or more groups. Specific examples of substituent groups suitable for the aromatic group include an alkyl group, an alkenyl group, a cyclic alkyl group, an aralkyl group, a cyclic alkenyl group, a halogen atom, a nitro group, a cyano group, an aryl group, an alkoxy group, an aryloxy group, a carboxyl group, an alkoxycarbonyl group, an aryloxycarbonyl group, a sulfo group, a sulfamoyl group, a carbamoyl group, an acylamino group, a diacylamino group, an ureido group, an urethane group, a sulfonamido group, a heterocyclic group, an arylsulfonyl group, an alkylsulfonyl group, an arylthio group, an alkylthio group, an alkylamino group, a dialkylamino group, an anilino group, an N-alkylanilino group, an N-arylanilino group, an N-acylanilino group, a hydroxy group, a mercapto group, and so on. A preferred aromatic group as $R^1$ is a phenyl group substituted by an alkyl group, an alkoxy group, a halogen or so on at least one ortho-position. This is because the magenta couplers containing the above-described phenyl groups as $R^1$ cause only a slight coloration by exposure to light or heat when they remain in processed photographic films.

Further, $R^1$ may represent a heterocyclic group (including 5- or 6-membered heterocyclic single or condensed rings containing at least one nitrogen, oxygen and sulfur atoms, e.g., a pyridyl group, a quinolyl group, a furyl group, a benzothiazolyl group, an oxazolyl group, an imidazolyl group, a naphthoxazolyl group, etc.), a heterocyclic group substituted by one of the substituent groups cited as examples of those for the above-described aromatic group, or a heterocyclic group substituted by an aliphatic or aromatic acyl group, an alkylsulfonyl group, an arylsulfonyl group, an alkylcarbamoyl group, an arylcarbamoyl group, an alkylthiocarbamoyl group or an arylthiocarbamoyl group.

$R^2$ in formula (II) represents a hydrogen atom or a substituent group, with specific examples including, aliphatic groups containing 1 to 32, preferably 1 to 22, carbon atoms (i.e., straight and branched chain alkyl, alkenyl, cycloalkyl,.aralkyl and cycloalkenyl groups, which each may be substituted by one of the substituent groups cited above as examples of those for aliphatic groups represented by $R^1$), aromatic groups (which may be substituted by one of the substituent groups cited above as examples of those for aromatic groups represented by $R^1$), heterocyclic groups (which may be substituted by one of the substituent groups cited above as examples of those for heterocyclic groups represented by $R^1$), alkoxycarbonyl groups (e.g., methoxycarbonyl groups, ethoxycarbonyl groups, stearyloxycarbonyl groups, etc.), aryloxycarbonyl groups (e.g., phenoxycarbonyl groups, naphthoxycarbonyl groups, etc.), aralkyloxycarbonyl groups (e.g., benzyloxycarbonyl groups, etc.), alkoxy groups (e.g., methoxy groups, ethoxy groups, heptadecyloxy groups, etc.), aryloxy groups (e.g., phenoxy groups, tolyloxy groups, etc.), alkylthio groups (e.g., ethylthio groups, dodecylthio groups, etc.), arylthio groups (e.g., phenylthio groups, α-naphthylthio groups, etc.), carboxyl groups, acylamino groups (e.g., acetylamino groups, 3-[(2,4-di-tert-amylphenoxy)acetamido]benzamido groups, etc.), diacylamino groups, N-alkylacylamino groups (e.g., N-methylpropionamido groups, etc.), N-arylacylamino groups (e.g., N-phenylacetamido groups, etc.), ureido groups (e.g., ureido group, N-arylureido groups, N-alkylureido groups, etc.), thioureido groups (e.g., thioureido groups, N-alkylthroureido groups, etc.), urethane group, thiourethane group, arylamino groups (e.g., phenylamino groups, N-methylanilino groups, diphenylamino groups, N-acetylanilino groups, 2-chloro-5-tetradecanamidoanilino groups, etc.), alkylamino groups (e.g., n-butylamino groups, methylamino groups, cyclohexylamino groups, etc.), cycloamino groups (e.g., piperidino, pyrrolidino, etc.), heterocyclic amino groups (e.g., 4-pyridylamino groups, 2-benzoxazolylamino groups, etc.), alkylcarbonyl groups (e.g., methylcarbonyl groups, etc.), arylcarbonyl groups (e.g., phenylcarbonyl groups, etc.), sulfonamido groups (e.g., alkylsulfonamido groups, arylsulfonamido groups, etc.), carbamoyl groups (e.g., ethylcarbamoyl groups, dimethylcarbamoyl groups, N-methyl-phenylcarbamoyl group, N-phenylcarbamoyl groups, etc.), sulfamoyl groups (e.g., N-alkylsulfamoyl groups, N,N-dialkylsulfamoyl groups, N-arylsulfamoyl groups, N-alkyl-N-arylsulfamoyl groups, N,N-diarylsulfamoyl groups, etc.), acyloxy groups (e.g., benzoyloxy groups, etc.), sulfonyloxy groups (e.g., benzenesulfonyloxy groups, etc.), cyano groups, hydroxy groups, mercapto groups, halogen atoms, nitro groups, and sulfo groups.

Among the magenta couplers represented by general formula (II), particularly preferred ones are those containing an anilino group, an acylamino group or an arylureido group as $R^2$, and an aryl group substituted by a chlorine atom at least one ortho-position as $R^1$.

When Za, Zb, Zc or Zd in general formula (II) represents a substituted methine, the substituent group is selected from those cited as examples for $R^2$.

A nitrogen-containing ring constructed by Za, Zb, Zc and Zd may be fused together with another ring (e.g., a 5- or 6-membered ring containing any of the moieties, Za-Zb, Zb-Zc and Zc-Zd, preferably a hydrocarbon ring such as a cyclohexene, cyclopentene, benzene or naphthalene ring, or a heterocyclic ring such as a pyridine, pyrimidine, dihydrofuran or dihydrothiophene ring, which each may be substituted by one or more substituents the same as those cited as examples for $R^2$). Za, Zb, Zc and Zd may be the same as or different from one another, but benzotriazolyl-1 and benzotriazolyl-2 are excluded.

The most preferred magenta couplers in the present invention are those which contain as the moiety

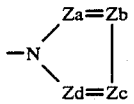

in formula (II) (a) a single 5-membered nitrogen-containing aromatic hetero ring whose members each is selected from among methine, a substituted methine or —N=, or (b) a condensed ring of the formula

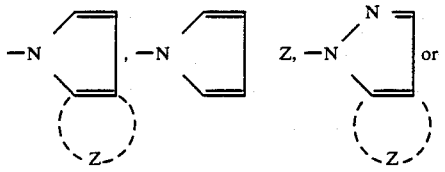

-continued

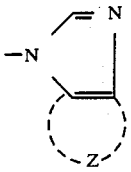

(wherein Z represents nonmetal atoms necessary to complete a 5- or 6-membered ring, and the substituted methine has the same meaning as described above).

The above-cited condensed rings,

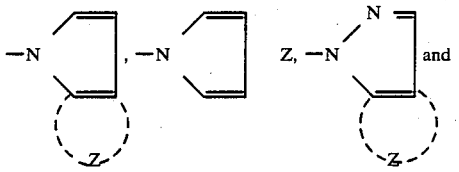

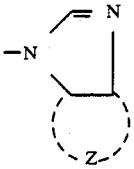

each may be substituted by a group the same as those set forth above as substituent groups regarding the substituted methine. In addition, specific examples of 5- or 6-membered rings completed by Z and fused together with the ring constructed by N, Za, Zb, Zc and Zd are the same as those set forth in the description of general formula (II).

Suitable examples of nitrogen-containing heterocyclic groups represented by

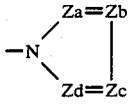

include 1-imidazolyl, 2-methyl-1-imidazolyl, 2-methylthio-1-imidazolyl, 2-ethylthio-1-imidazolyl, 2,4-dimethyl-1-imidazolyl, 4-methyl-1-imidazolyl, 4-nitro-1-imidazolyl, 4-chloro-1-imidazolyl, 4-phenyl-1-imidazolyl, 4-acetyl-1-imidazolyl, 4-tetradecanamido-1-imidazolyl, 1-pyrrolyl, 3,4-dichloro-1-pyrrolyl, 2-isoindolyl, 1-indolyl, 1-pyrazolyl, 1-benzimidazolyl, 5-bromo-1-benzimidazolyl, 5-octadecanamido-1-benzimidazolyl, 2-methyl-1-benzimidazolyl, 5-methyl-1-benzimidazolyl, 7-purinyl, 2-indazolyl, 2,2,4-4-triazolyl, 1,2,3-1-triazolyl, 1-tetrazolyl, and so on.

Further, the compound represented by general formula (II) may be connected to the main chain of a polymer via $R^1$, $R^2$ or

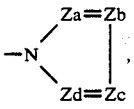

in analogy with the compounds described in Japanese Patent Application (OPI) Nos. 94752/82, 224352/83 and 35730/85.

The magenta couplers represented by general formula (III) are described in detail below.

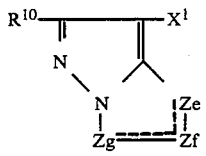

(III)

wherein, $R^{10}$ represents a hydrogen atom or a substituent group; $X^1$ represents a hydrogen atom, or a group capable of splitting away from the coupler by reacting with an oxidation product of an aromatic primary amine developing agent; and Ze, Zf and Zg each represents a methine group, a substituted methine group, =N— or —NH—. Either of the Ze-Zf bond or the Zf-Zg bond is a single bond, and the remainder is a double bond. When the Zf-Zg is a C—C double bond, it may constitute a part of an aromatic ring. The magenta coupler of formula (III) may form a polymer (including a dimer) via $R^{10}$ or $X^1$. When Ze, Zf or Zg represents a substituted methine, formation of the polymer may also be taken place via the substituted methine.

More specifically, the term polymer as used in the description of general formula (III) means a compound containing two or more of coupler moiety derived from the magenta coupler of formula (III) in a molecule, including bis-compounds and polymeric couplers. The polymeric couplers may be homopolymers constituted only by the monomers containing the coupler moiety derived from the coupler represented by formula (III) (preferably those having a vinyl group, called vinyl monomers hereinafter), or copolymers prepared from the above-described vinyl monomers and ethylenic unsaturated monomers incapable of undergoing a coupling reaction with the oxidation products of aromatic primary amine developers and consequently, in capable of forming colors.

Of the pyrazoloazole type magenta couplers represented by general formula (III), those represented by the following general formulae (a), (b), (c), (d), (e), (f) and (g), respectively, are preferred over others.

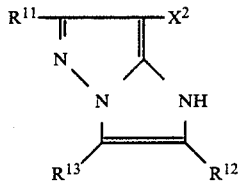

(a)

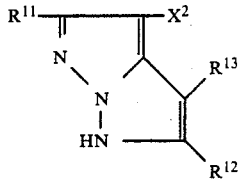

(b)

-continued

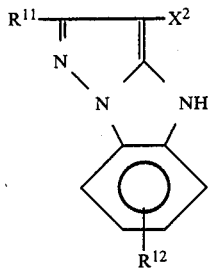

(c)

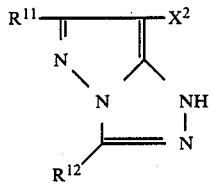

(d)

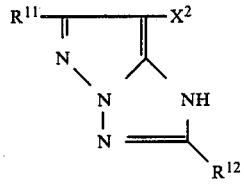

(e)

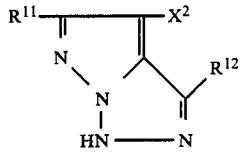

(f)

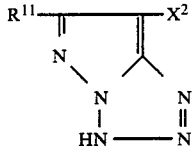

(g)

In general formula (a) to (g), $R^{11}$, $R^{12}$ and $R^{13}$ may be the same or different, and each represents a hydrogen atom, a halogen atom, an alkyl group, an aryl group, a heterocyclic group, a cyano group, an alkoxy group, an aryloxy group, a heterocyclyloxy group, an acyloxy group, a carbamoyloxy group, a silyloxy group, a sulfonyloxy group, an acylamino group, an anilino group, an ureido group, an imido group, a sulfamoylamino group, a carbamoylamino group, an alkylthio group, an arylthio group, a heterocyclylthio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group, or an aryloxycaronyl group. These groups may be further substituted once or twice with a substituent such as those recited above. $X^2$ represents a hydrogen atom, a halogen atom, a carboxy group, or a coupling eliminable group which is attached to the carbon atom located at the coupling position through its oxygen, nitrogen or sulfur atom. In addition, $R^{11}$, $R^{12}$, $R^{13}$ or $X^2$ may be a divalent group, and in this case a bis-compound may be formed via the divalent group.

Further, coupler moieties of the couplers represented by general formula (a) to (g) may be present in the main or side chains of polymers. In particular, polymers derived from vinyl monomers containing one of the moieties derived from compounds represented by general formula (a) to (g) are advantageously employed in the present invention. In such a case $R^{11}$, $R^{12}$, $R^{13}$ or $X^2$ represents a substituted or unsubstituted vinyl group or a vinyl group bonded with the coupler moiety through a linkage group.

In more detail, $R^{11}$, $R^{12}$ and $R^{13}$ each represents a hydrogen atom, a halogen atom (e.g., chlorine, bromine, etc.), an alkyl group (e.g., methyl, propyl, t-butyl, trifluoromethyl, tridecyl, 3-(2,4-di-t-amylphenoxy)propyl, ally, 2-dodecyloxyethyl, 3-phenoxypropyl, 2-hexylsulfonylethyl, cyclopentyl, benzyl, etc.), an aryl group (e.g., phenyl, 4-t-butylphenyl, 2,4-di-t-amylphenyl, 4-tetradecanamidophenyl, etc.), a heterocyclic group (e.g., 2-furyl, 2-thienyl, 2-pyrimidinyl, 2-benzothiazolyl, etc.), a cyano group, an alkoxy group (e.g., methoxy, ethoxy, 2-methoxyethoxy, 2-dodecyloxyethoxy, 2-methanesulfonylethoxy, etc.), an aryloxy group (e.g., phenoxy, 2-methylphenoxy, 4-t-butylphenoxy, etc.), a heterocyclyloxy group (e.g., 2-benzimidazolyloxy, etc.), an acyloxy group (e.g., acetoxy, hexadecanoyloxy, etc.), a carbamoyloxy group (e.g., N-phenylcarbamoyloxy, N-ethylcarbamoyloxy, etc.), a silyloxy group (e.g., trimethylsilyloxy, etc.), a sulfonyloxy group (e.g., dodecylsulfonyloxy, etc.), an acylamino group (e.g., acetamido, benzamido, tetradecanamido, α-(2,4-di-t-amylphenoxy)butylamido, γ-(3-t-butyl-4-hydroxyphenoxy)butylamido, α-{4-(4-hydroxyphenylsulfonyl) phenoxy}decanamido, etc.), an anilino group (e.g., phenylamino, 2-chloroanilino, 2-chloro-5-tetradecanamidoanilino, 2-chloro-5-dodecyloxycarbonylanilino, N-acetylanilino, 2-chloro-5-{α-(3-t-butyl-4-hydroxyphenoxy) dodecanamido}anilino, etc.), an ureido group (e.g., phenylureido, methylureido, N,N-dibutylureido, etc.), an imido group (e.g., N-succinimido, 3-benzylhydantoinyl, 4-(2-ethylhexanoylamino)phthalimido, etc.), a sulfamoylamino group (e.g., N,N-dipropylsulfamoylamino, N-methyl-N-decylsulfamoylamino, etc.), a carbamoylamino group (e.g., methyl carbamoylamino, p-cyanophenyl carbamoylamino, etc.), an alkylthio group (e.g., methylthio, octylthio, tetradecylthio, 2-phenoxyethylthio, 3-phenoxypropylthio, 3-(4-t-butylphenoxy)propylthio, etc.), an arylthio group (e.g., phenylthio, 2-butoxy-5-t-octylphenylthio, 3-pentadecylphenylthio, 2-carboxyphenylthio, 4-tetradecanamidophenylthio, etc.), a heterocylilthio group (e.g., 2-benzothiazolylthio, etc.), an alkoxycarbonylamino group (e.g., methoxycarbonylamino, tetradecyloxycarbonylamino, benzyloxycarbonylamino, etc.), an aryloxycarbonylamino group (e.g., phenoxycarbonylamino, 2,4-di-tertbutylphenoxycarbonylamino, etc.), a sulfonamido group (e.g., methanesulfonamido, hexadecanesulfonamido, benzenesulfonamido, p-toluenesulfonamido, octadecanesulfonamido, 2-methyloxy-5-t-butylbenzenesulfonamido, etc.), a carbamoyl group (e.g., N-ethylcarbamoyl, N,N-dibutylcarbamoyl, N-(2-dodecyloxyethyl)carbamoyl, N-methyl-N-dodecylcarbamoyl, N-{3-(2,4-di-tert-amylphenoxy)propyl}carbamoyl, etc.), an acyl group (e.g., acetyl, (2,4-di-tert-amylphenoxy)acetyl, benzoyl, etc.), a sufamoyl group (e.g., N-ethylsulfamoyl, N,N-dipropylsulfamoyl, N-(2-dodecyloxyethyl)sulfamoyl, N-ethyl-N-dodecylsulfamoyl, N,N-diethylsulfamoyl, etc.), a sulfonyl group (e.g., methanesulfonyl, octanesulfonyl, benzenesulfonyl, toluenesulfonyl, etc.), a sulfinyl group (e.g., octanesulfinyl, dodecylsulfinyl, phenylsulfinyl, etc.), an alkoxycarbonyl group (e.g., methoxycarbonyl, a butyloxycarbonyl, dodecyloxycarbonyl, octadecyloxycarbonyl, etc.), or an aryloxycarbonyl group (e.g., phenyloxycarbonyl, 3-pentadecyl oxyphenyloxycarbonyl, etc.).

$X^2$ represents a hydrogen atom, a halogen atom (e.g., chlorine, bromine, iodine, etc.), a carboxyl group, a group capable of connecting to the ring-forming carbon via an oxygen atom (e.g., acetoxy, propanoyloxy, benzoyloxy, 2,4-dichlorobenzoyloxy, ethoxyoxaloyloxy, pyruvinyloxy, cinnamoyloxy, phenoxy, 4-cyanophenoxyl, 4-methanesulfonamidophenoxy, 4-methanesulfonylphenoxy, α-naphthoxy, 3-pentadecylphenoxy, benzyloxycarbonyloxy, ethoxy, 2-cyanoethoxy, benzyloxy, 2-phenetyloxy, 2-phenoxyethoxy, 5-phenyltetrazolyloxy, 2-benzothiazolyloxy, etc.), a group capable of connecting to the ring-forming carbon via a nitrogen atom (e.g., benzenesulfonamido, N-ethyltoluenesulfonamido, heptafluorobutanamido, 2,3,4,5,6-pentafluorobenzamido, octanesulfonamido, p-cyanophenylureido, N,N-diethylsulfamoylamino, 1-piperidyl 5,5-dimethyl-2,4-dimethyl-2,4-dioxo-3-oxazolidinyl, 1-benzyl-ethoxy-3-hydantoinyl, 2N-1,1-dioxo-3(2H)-oxo-1,2-benzoisothiazolyl, 2-oxo-1,2-dihydro-1-pyridinyl, imidazolyl, pyrazolyl, 3,5-diethyl-1,2,4-triazole-1-yl, 5- or 6-bromobenzotriazole-1-yl, 5-methyl-1,2,4-triazole-1-yl, benzimidazolyl, 3-benzyl-1-hydantoinyl, 1-benzyl-5-hexadecyloxy-3-hydantoinyl, 5-methyl-1-tetrazolyl, and arylazo groups such as 4-methoxyphenylazo, 4-pivaloylaminophenylazo, 2-naphthylazo, 3-methyl-4-hydroxyphenylazo, etc.), or a group capable of connecting to the ring-forming carbon via a sulfur atom (e.g., phenylthio, 2-carboxyphenylthio, 2-methoxy-5-t-octylphenylthio, 4-methanesulfonylphenylthio, 4-octanesulfonamidophenylthio, 2-butoxyphenylthio, 2-(2-hexasulfonylethyl)-5-tert-octylphenylthio, benzylthio, 2-cyanoethylthio, 1-ethoxycarbonyltridecylthio, 5-phenyl-2,3,4,5-tetrazolythio, 2-benzothiazolythio, 2-dodecylthio-5-thiophenylthio, 2-phenyl-3-dodecyl-1,2,4-triazolyl-t-thio, etc.).

In the couplers of general formulae (a) and those of general formula (b), $R^{12}$ and $R^{13}$ may combine with each other to form a 5- to 7-membered ring.

Of the couplers represented by general formulae (a) to (g), those of formula (a), those of formula (d) and those of formula (e) are preferred over others. In particular, the couplers of formula (e) are employed to great advantage.

When $R^{11}$, $R^{12}$, $R^{13}$ or $X^2$ represents a divalent group and therethrough, a bis-compound is formed, preferred examples of divalent groups represented by $R^{11}$, $R^{12}$ or $R^{13}$ include substituted or unsubstituted alkylene groups (e.g., methylene, ethylene, 1,10-decylene, $—CH_2CH_2—O—CH_2CH_2—$, etc.), substituted or unsubstituted phenylene groups (e.g., 1,4-phenylene, 1,3-phenylene,

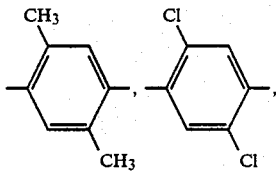

etc.), —NHCO—$R^{14}$—CONH— groups (wherein $R^{14}$ represents a substituted or unsubstituted alkylene or phenylene group, such as $—NHCOCH_2CH_2CONH—$, $—NHCOCH_2C(CH_3)_2CH_2—CONH—$,

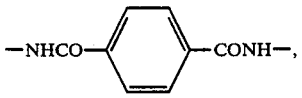

etc.), or —S—$R^{15}$—S— group (wherein $R^{15}$ represents a substituted or unsubstituted alkylene group, such as —S—$CH_2CH_2$—S—, —S—$CH_2C(CH_3)_2$—$CH_2$—S—, etc.), while $X^2$ represents a divalent group derived from any of the monovalent groups cited above as specific examples of $X^2$.

Specific examples of the groups represented by $R^{11}$, $R^{12}$, $R^{13}$ or $X^2$, when the coupler represented by general formula (a), (b), (c), (d), (e), (f) and (g) are vinyl monomers include those formed by combining the vinyl group and two or more of linkage groups selected from among substituted or unsubstituted alkylene groups (such as methylene, ethylene, 1,10-decylene, —$CH_2CH_2OCH_2CH_2$—, etc.), substituted or unsubstituted phenylene groups (such as 1,4-phenylene, 1,3-phenylene,

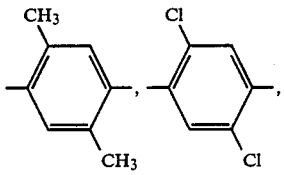

etc.), —NHCO—, —CONH—, —O—, —OCO—, and aralkylene groups (such as

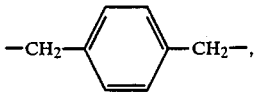

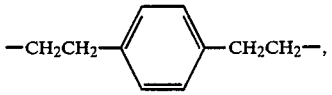

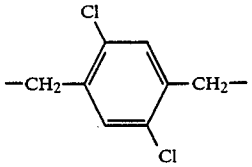

etc.).

As suitable example of such linkage groups, mention may be made of —NHCO—, —$CH_2CH_2$—,

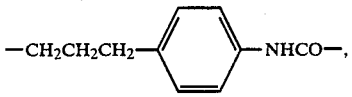

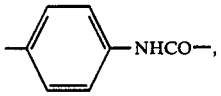

—$CH_2CH_2NHCO$—, —$CH_2CH_2$—OCO—, —CONH—$CH_2CH_2NHCO$—, —$CH_2CH_2OCH_2CH_2NHCO$—,

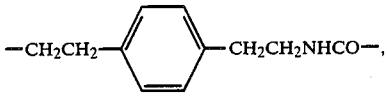

etc.

When the coupler represented by general formula (a), (b), (c), (d), (e), (f),or (g) has a vinyl group, the vinyl group may be substituted by another group. Preferable examples include an unsubstituted vinyl group and substituted group with a chlorine atom, a lower alkyl group containing 1 to 4 carbon atoms, and so on.

The monomers represented by general formula (a), (b), (c), (d), (e), (f) or (g) may form copolymers together with ethylenic unsaturated monomers incapable of undergoing the coupling reaction with oxidation products of aromatic primary amine developers.

Specific examples of ethylenic unsaturated monomers of the above-described kind include acrylic acid, α-chloroacrylic acid, α-alkylacrylic acids (e.g., methacrylic acid, etc.), amides or esters derived from the above-described acrylic acids (e.g., acrylamide, n-butylacrylamide, t-butylacrylamide, diacetoneacrylamide, methacrylamide, methylacrylate, ethylacrylate, n-propylacrylate, n-butylacrylate, t-butylacrylate, isobutylacrylate, 2-ethylhexylacrylate, n-octylacrylate, laurylacrylate, methylmethacrylate, ethylmethacrylate, n-butylmethacrylate, and β-hydroxymethacrylate), methylenebisacrylamide, vinyl esters (e.g., vinyl acetate, vinyl propionate, and vinyl laurate), acrylonitrile, methacrylonitrile, aromatic vinyl compounds (e.g., styrene and its derivatives, vinyltoluene, divinylbenzene, vinylacetophenone, and sulfostyrene), itaconic acid, citraconic acid, crotonic acid, vinylidene chloride, vinyl alkyl ethers (e.g., vinyl ethyl ether), maleic acid, maleic anhydride, maleic acid esters, N-vinyl-2-pyrrolidone, N-vinylpyridine, 2- and 1-vinylpyridine, and so on. Two or more of these noncoloring ethylenic unsaturated monomers may also be used together in the copolymerization. For instance, a combination of n-butylacrylate and methylacrylate, that of styrene and methacrylic acid, that of methacrylic acid and acrylamide, that of methylacrylate and diacetoneacrylamide, and so on may be used.

As well-known in the arts of polymeric color couplers, noncoloring ethylenic unsaturated monomers which undergo copolymerization with solid water-insoluble monomeric couplers are chosen so as to exert favorable influences upon the physical and or chemical properties of the resulting copolymers, e.g., solubility, compatibility with a binder contained in a photographic colloidal composition, e.g., gelatin, flexibility, thermal stability, and so on.

Polymeric couplers which can be used in the present invention may be either soluble or insoluble in water. In particular, it is preferred to use them in the form of latex.

Couplers having high reactivity, so-called high-speed reacting couplers, can be employed as the couplers to be used in the present invention.

The coupling reactivity of the couplers can be determined relatively by mixing two kinds of couplers M and N, which produce different dyes capable of being clearly separated from each other, adding the resulting mixture to an emulsion, subjecting the emulsion to color development to form a dye image, and measuring the respective amounts of dyes contained in the dye image.

When the maximum color density attained by coupler M is represented by (DM)max and a color density obtained by the coupler M at a halfway stage of development is represented by DM, and, similarly, those regarding coupler N are represented by (DN)max and DN, respectively, the ratio of reactivity of coupler M to that of coupler N, RM/RN, is defined by the following equation:

$$\frac{RM}{RN} = \frac{\log 1 - \frac{DM}{(DM)\text{max}}}{\log 1 - \frac{DN}{(DN)\text{max}}}$$

More specifically, the coupling reactivity ratio RM/RN can be determined as follows: Emulsions containing the above-described coupler mixture are subjected to exposures in various stages, respectively, and then to development-processing. Several pairs of the thus obtained DM and DN values are plotted as axes perpendicular to each other in the form of log(1−D/D-max), and the reactivity ratio RM/RN is calculated from the slope of the log(1−DM/(DM)max) vs. log(1−DN/(DN)max) plots.

Accordingly, if values of the ratio RM/RN are calculated in the above-described manner using a fixed coupler as coupler N, and various couplers as coupler M, the coupling reactivities of the couplers examined can be determined relatively.

For instance, the couplers having the structural formulae illustrated below can be employed as coupler N.

Coupler N for Cyan Coupler

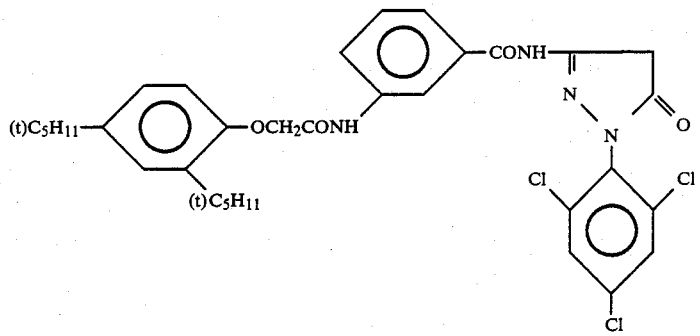

Coupler N for Magenta and Yellow Couplers

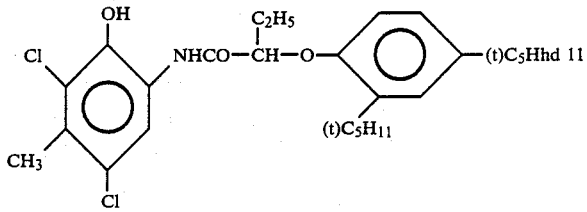

As for the high-speed reacting couplers which can be employed in the present invention, couplers whose RM/RN ratios, determined using the above-illustrated coupler N, are 1.5 or above in case of cyano couplers, 2.5 or above in case of magenta couplers, and 1 or above in case of yellow couplers are preferred.

Specific examples of high-speed reacting couplers which can be preferably used are illustrated below. However the invention should not be construed as being limited to the following examples. In these examples, the values in parentheses represent RM/RN values determined using the corresponding coupler N illustrated above.

Examples of Cyan Coupler

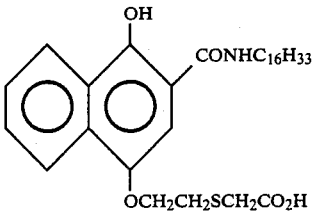

(2.9) (CYAN-1)

-continued
(CYAN-2)
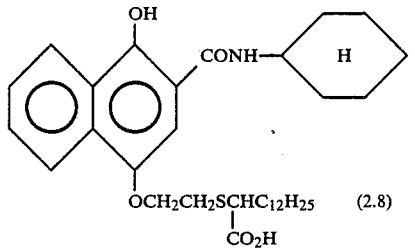
(2.8)
(CYAN-3)
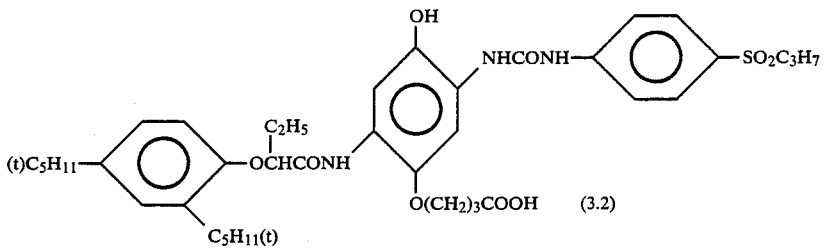
(3.2)
(CYAN-4)
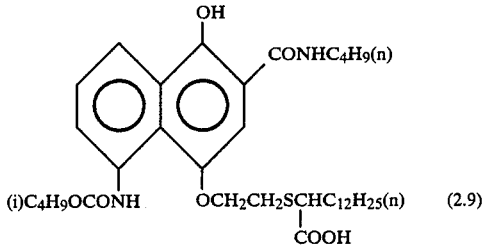
(2.9)
(CYAN-5)
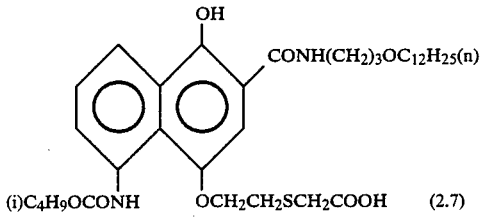
(2.7)
(CYAN-6)
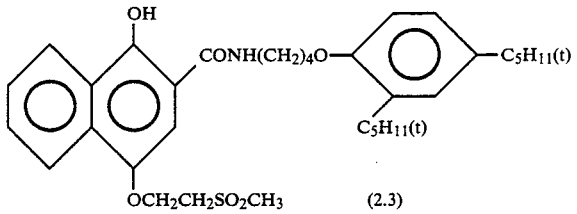
(2.3)
Examples of Magenta Coupler
(MAGENTA-1)
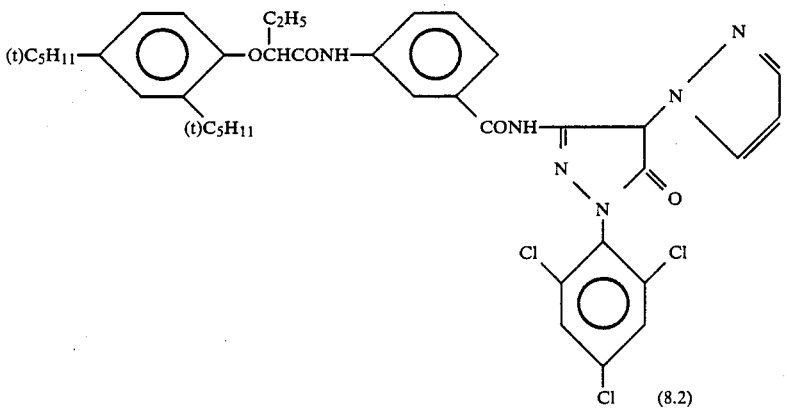
(8.2)

-continued
(MAGENTA-2)
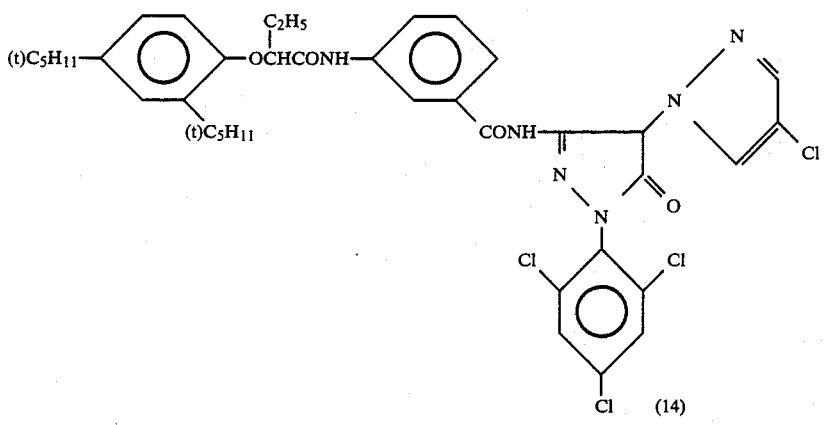
(14)
(MAGENTA-3)
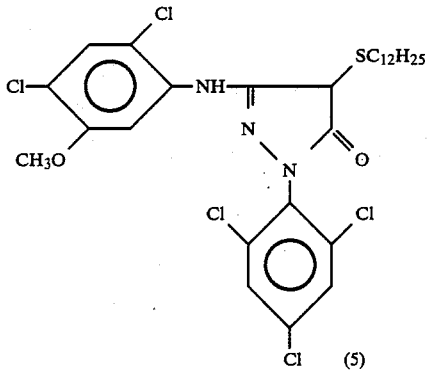
(5)
(MAGENTA-4)
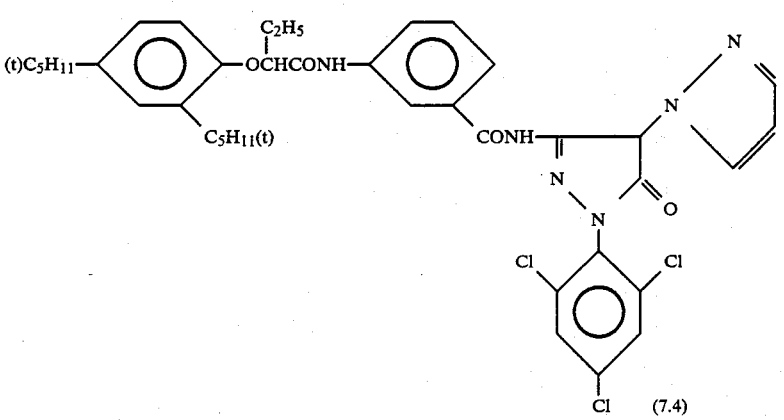
(7.4)
(MAGENTA-5)
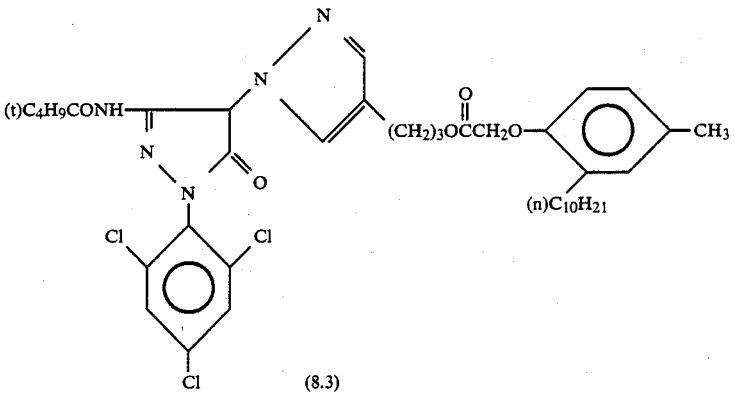
(8.3)

-continued
(MAGENTA-6)
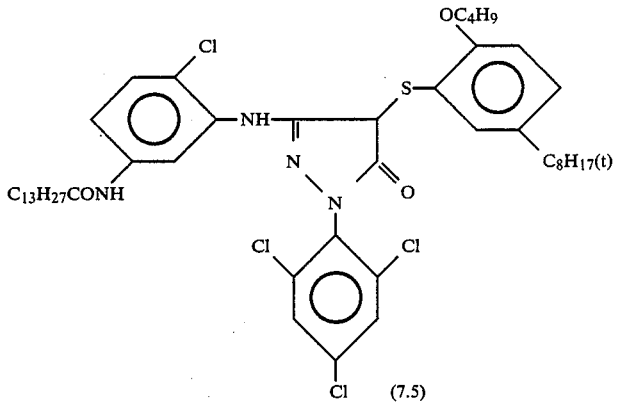
(7.5)
(MAGENTA-7)
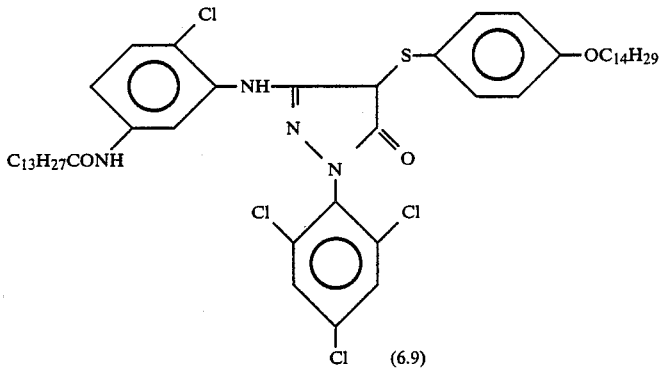
(6.9)
(MAGENTA-8)
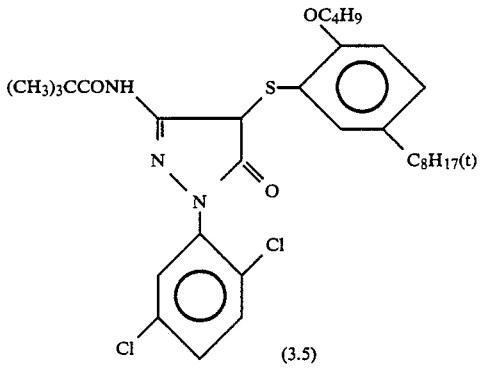
(3.5)
(MAGENTA-9)
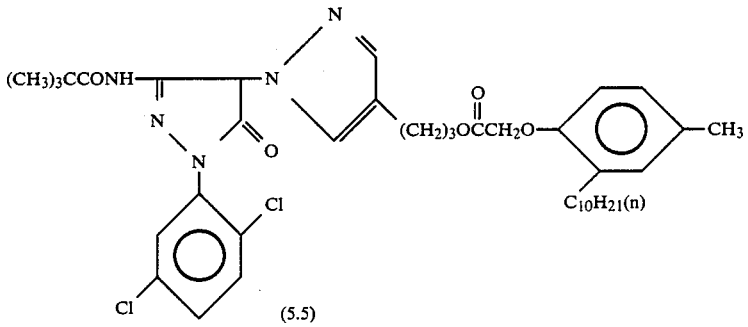
(5.5)

-continued
(MAGENTA-10)
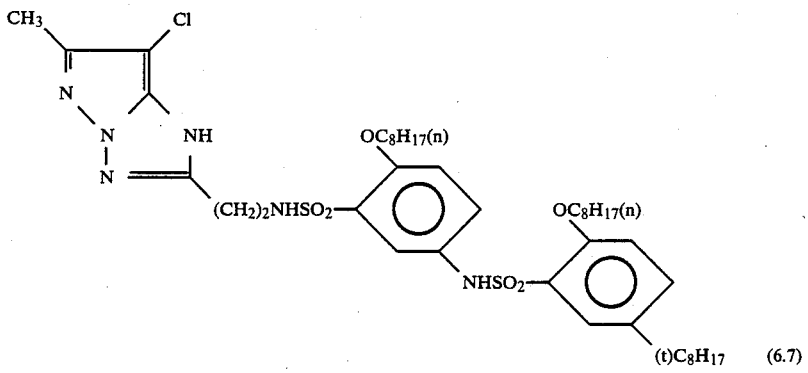
(6.7)
(MAGENTA-11)
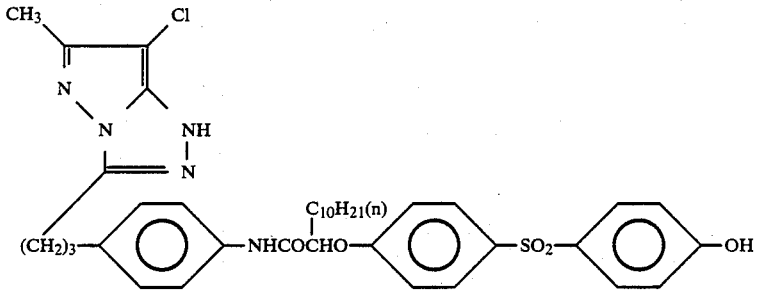
(5.9)
(MAGENTA-12)
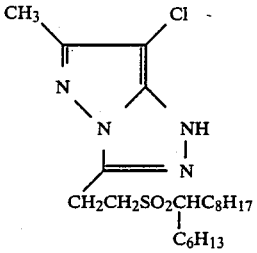
(6.0)
(MAGENTA-13)
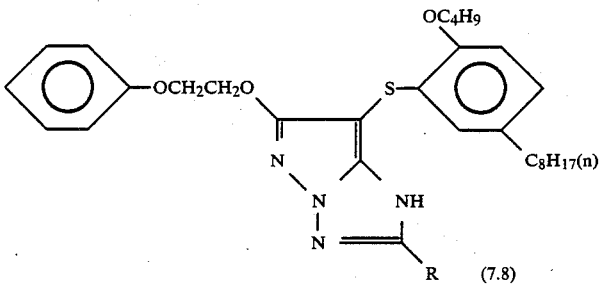
(7.8)
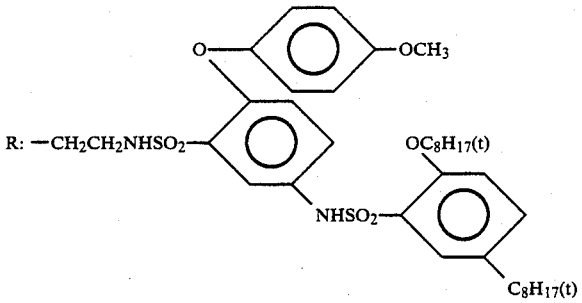
Examples of Yellow Coupler -continued
(YELLOW-1)
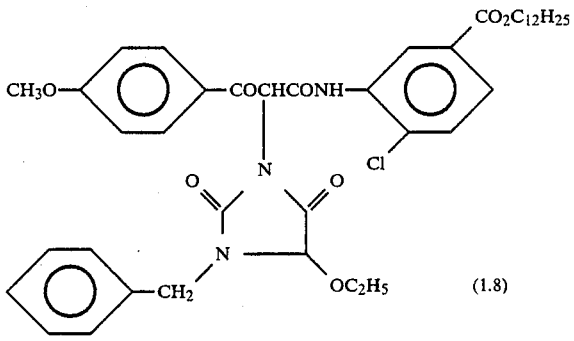
(1.8)
(YELLOW-2)
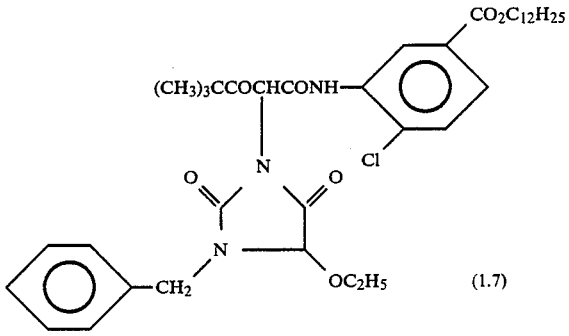
(1.7)
(YELLOW-3)
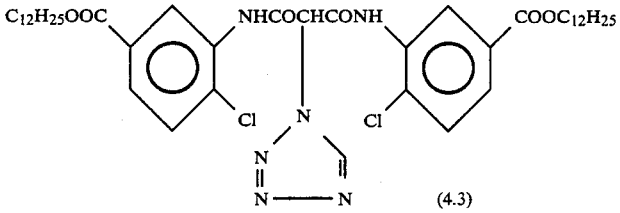
(4.3)
(YELLOW-4)
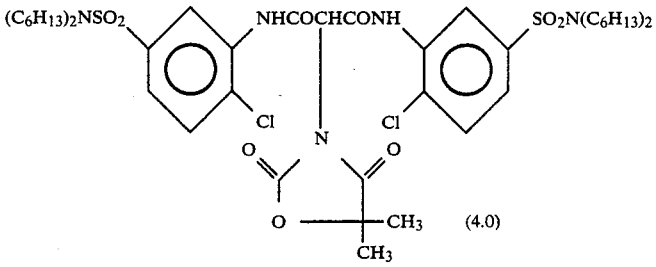
(4.0)
(YELLOW-5)
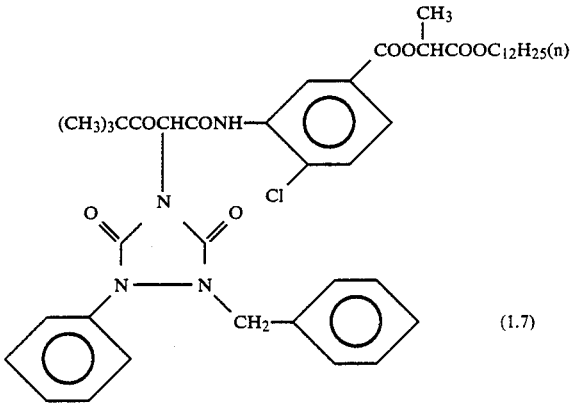
(1.7)

-continued (YELLOW-6)

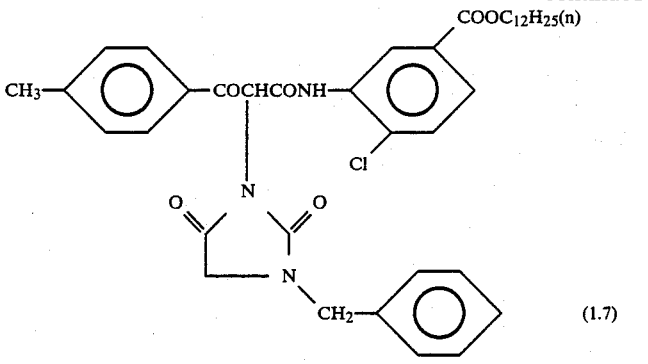

(1.7)

In the present invention, it is favorable that the color sensitive emulsion layers each contain a high-speed reacting coupler as illustrated above in at least the constituent layer having the highest photographic speed of those having the same color sensitivity. The invention has no particular restriction as to the amount of high-speed reacting coupler to be used. However, it is desirable to use high-speed reacting cyan, magenta and yellow couplers each in an amount of 0.005 to 0.1 mole per mole of silver.

Further, nondiffusible couplers capable of producing dyes having moderate diffusibilities, as prescribed in claim 1 and claims 3 to 8 of U.S. Pat. No. 4,420,556, Japanese Patent Application No. (OPI) 191036/84, and so on, can be also employed in the present invention with the intention of increasing a photographic speed through an increase in the covering power, and improving graininess. Such couplers can be synthesized with ease using methods as described in the foregoing patents, and Japanese Patent Application (OPI) Nos. 1938/81, 3934/82 and 105226/78, U.S. Pat. No. 4,264,723, and so on.

Specific examples of the couplers of the above-described kind are illustrated below.

(Y-1)

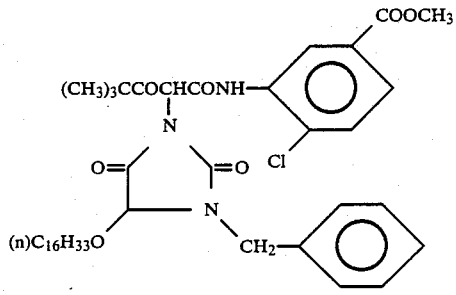

(Y-2)

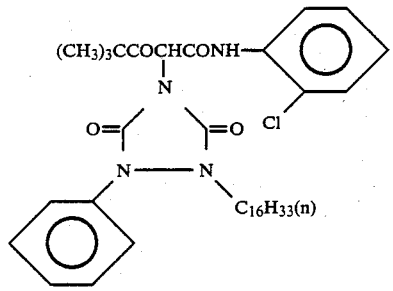

(Y-3)

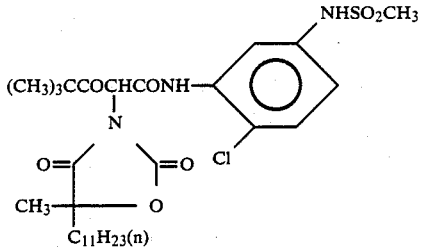

-continued
(Y-4)
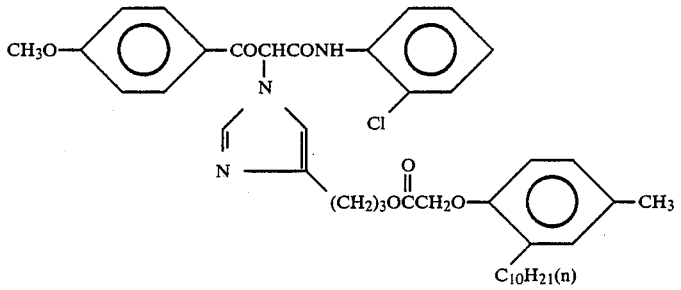
(Y-5)
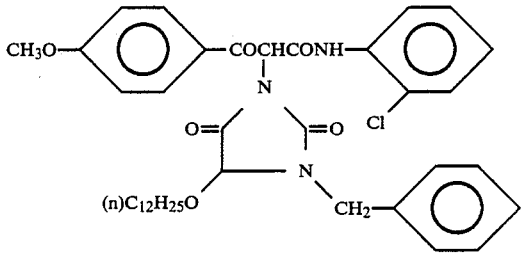
(Y-6)
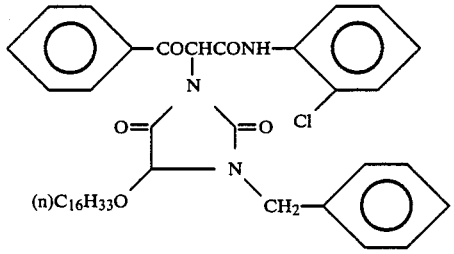
(Y-7)
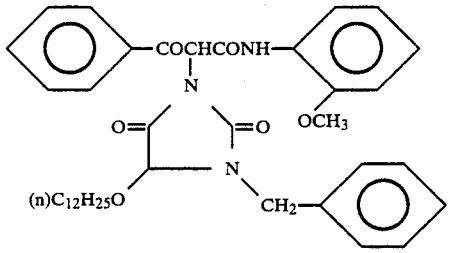
(M-1)
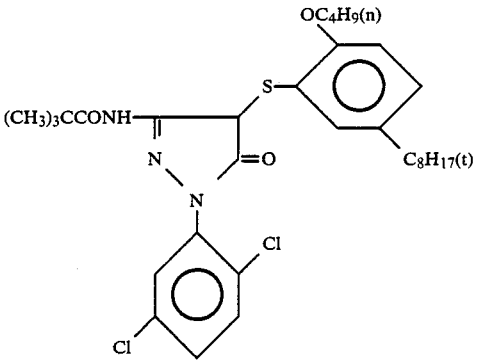

-continued
(M-2)
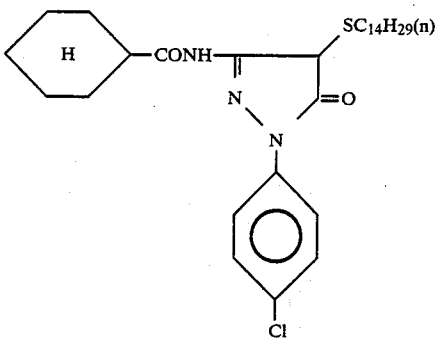
(M-3)
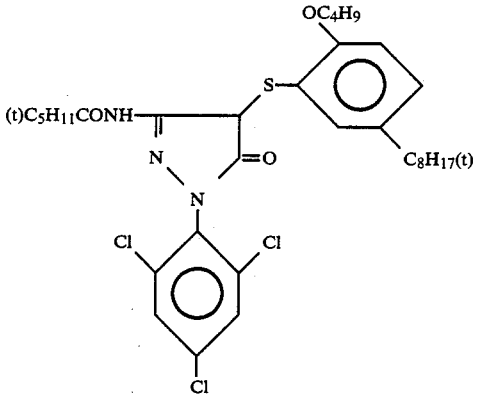
(M-4)
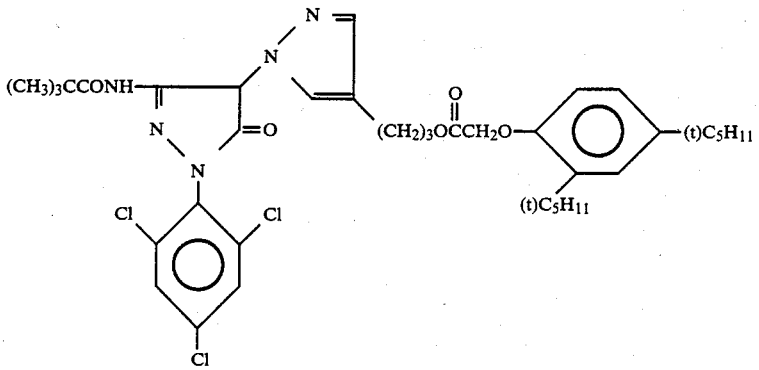
(C-1)
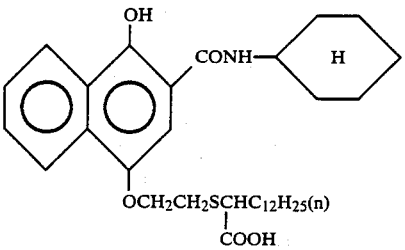
(C-2)
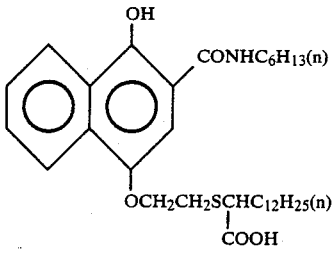

-continued (C-3)

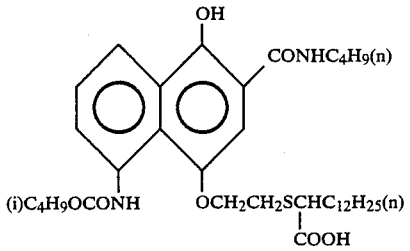

(C-4)

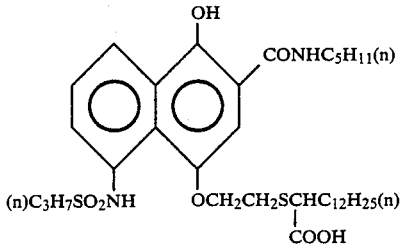

(C-5)

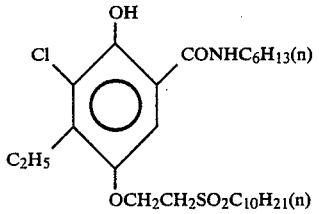

The photographic materials of the present invention may contain, in addition to the above-mentioned couplers, colored couplers having a color-compensating effect or couplers of releasing a development inhibitor with development (so-called DIR couplers).

In addition to DIR couplers, the materials may also contain colorless DIR-coupling compounds which form a colorless product by a coupling reaction and release a development inhibitor.

As the compounds which release a development inhibitor (hereinafter referred to as "DIR compounds") for use in the present invention, such as DIR couplers or colorless DIR-coupling compounds, those represented by the following formula (IV) are preferred.

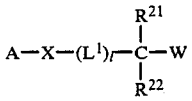

(IV)

in which A represents a coupler component capable of releasing X and the following group by a coupling reaction with the oxidation product of an aromatic primary amine developing agent; X represents an oxygen atom, a sulfur atom or a substituted amino group;

$L^1$ represents a substituted or unsubstituted ethenylene group; l represents an integer of 1 or 2;

$R^{21}$ and $R^{22}$ each represents a hydrogen atom, an alkyl group or an aryl group;

W represents a component (moiety) capable of inhibiting the development of silver halide;

provided that when l represents 2, the $L_1$ groups may be the same or different, and that $R^{21}$ and $R^{22}$ may be the same or different.

In the photographic materials of the present invention, it is preferred that the DIR compound of formula (IV) is incorporated in at least one of emulsion layer and a layer adjacent to an emulsion layer. In particular, the compound is preferably incorporated in the red-sensitive emulsion layer, and more preferably incorporated in at least one red-sensitive emulsion layer and at least one green-sensitive emulsion layer. By the incorporation of the DIR compound of formula (IV), the sharpness and the color-reproducibility can be improved, and further, the pressure-resistance can also be improved.

The DIR compounds represented by general formula (IV) are described in detail below.

Coupler residues represented by A in formula (IV) include those which can form dyes (e.g., yellow, magenta, cyan and other dyes) by the coupling reaction with oxidation products of aromatic primary amine developers, and those which can yield coupling reaction products having, in a substantial sense, no absorption in the visible region.

Suitable examples of yellow dye image-forming coupler residues represented by A include coupler residues of pivaloylacetoanilide type, benzbylacetoanilide type, malonic diester type, malonic acid diamide type, dibenzoylmethane type, benzothiazolylacetamide type malonic ester monoamide type, benzothiazolylacetate type, benzoxazolylacetamide type, benzoxazoylacetate type, benzimidazolylacetamide type or benzimidazolylacetate type; coupler residues derived from hetero ring-substituted acetamides or heterocyclic ring substituted acetates as described in U.S. Pat. No. 3,841,880; coupler residues derived from acylacetamides described in U.S. Pat. No. 3,770,446, British Pat. No. 1,459,171, West German Patent Application (OLS) No. 2,503,099, Japanese Patent Application (OPl) No. 139738/75; coupler residues of a hetero ring type described in U.S. Pat. No. 4,016,574; and so on.

Suitable examples of magenta dye image-forming coupler residues represented by A include coupler residues having a 5-oxo-2-pyrazoline nucleus, a pyrazolo[1,5-a]benzimidazole nucleus, a pyrazoloimidazole nucleus, a pyrazolotriazole nucleus or a pyrazolotetrazole nucleus, and residues of cyanoacetophenone type couplers.

Suitable examples of cyan dye image-forming coupler residues represented by A include those containing a phenol nucleus or an α-naphthol nucleus.

Even when DIR compounds having coupler residue which do not yield dye in a substantial sense after they release development inhibitors by the coupling with oxidation products of developing agents, they are the same as DIR couplers in terms of the effects of DIR compounds. Suitable examples of the above-described kind of coupler residues represented by A are those described, e.g., in U.S. Pat. Nos. 4,052,213, 4,088,491, 3,632,345, 3,958,993 and 3,961,958, and so on.

As described above, X represents an oxygen atom, a sulfur atom or a substituted imino group, and the substituent is preferably bonded to $L^1$ to form a 5- to 7-membered nitrogen-containing hetero-ring (which may optionally have substituent(s) and may be in the form of a condensed ring) together with the nitrogen atom and $L^1$.

As preferred examples of the group $—X—(L^1)_t—$ in formula (IV), there may be mentioned the following groups:

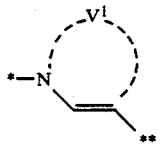
(i)

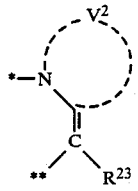
(ii)

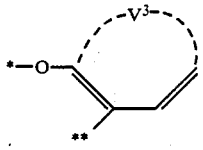
(iii)

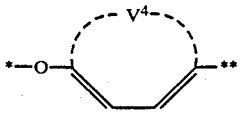
(iv)

In these formulae, "*" shows the position to be to the coupling-position of A; and "**" shows the position to be bonded to

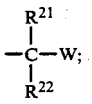

$V^1$ and $V^2$ each represents a non-metallic atomic group necessary for forming a 5- to 7-membered nitrogen containing hetero-ring (which may optionally have substituent(s) and may be in the form of a condensed ring) together with the atomic group as bonded thereto; $V^3$ and $V^4$ each represents a non-metallic atomic group necessary for forming a 5- to 7-membered hereto-ring (which may optionally have substituent(s) and may be in the form of a condensed ring) or a benzene ring (which may optionally have substituent(s) and may be in the form of a condensed ring) together with the atomic group as bonded thereto; $R^{23}$ represents a hydrogen atom or a mono-valent group; provided that $R^{23}$ may be bonded to $V^2$ to form a ring.

In formula (IV), $R^{21}$ and $R^{22}$ each are preferably a hydrogen atom, a substituted or unsubstituted alkyl group having from 1 to 36 carbon atoms (e.g., a methyl group, an ethyl group, a benzyl group, a dodecyl group, a cyclohexyl group, etc.,) or a substituted or unsubstituted aryl group having from 6 to 36 carbon atoms (e.g., a phenyl group, a 4-methoxyphenyl group, a 4-chlorophenyl group, a 4-nitrophenyl group, a naphthyl group, etc.).

The essential part of the development inhibitor as represented by W is a substituted or unsubstituted heterocyclic group or a substituted or unsubstituted heterocyclic-thio group, and specific examples thereof are groups of the following formulae (DI-a) through (DI-q).

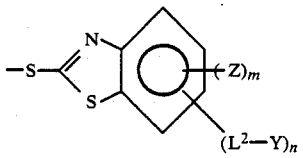
(DI-a)

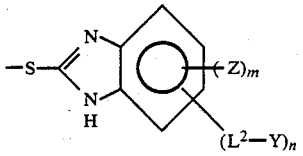
(DI-b)

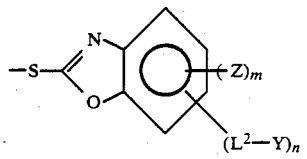
(DI-c)

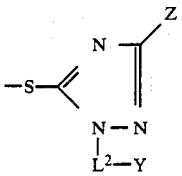
(DI-d)

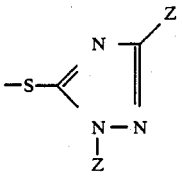
(DI-e)

-continued (DI-f)

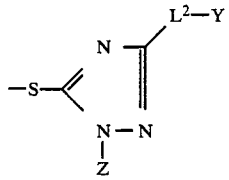

(DI-g)

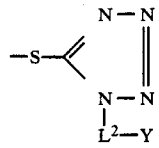

(DI-h)

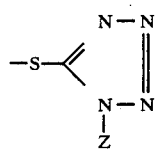

(DI-i)

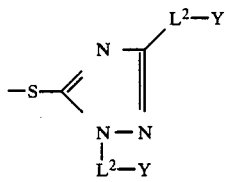

(DI-j)

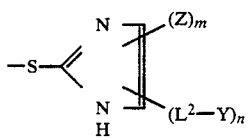

(DI-k)

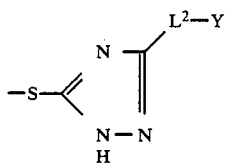

(DI-l)

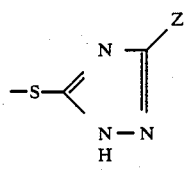

(DI-m)

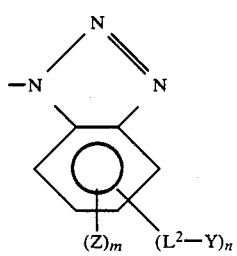

-continued (DI-n)

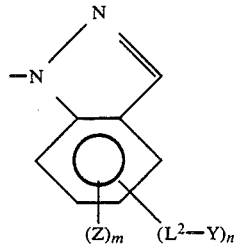

(DI-o)

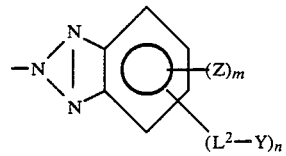

(DI-p)

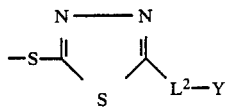

(DI-q)

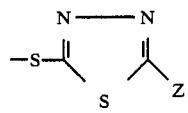

In the above formulae (DI-a) through (DI-q), the substituent Z (which is a part of the group W in the above-mentioned formula (IV)) represents a hydrogen atom, a halogen atom, a substituted or unsubstituted alkyl group, a substituted or unsubstituted alkenyl group, a substituted or unsubstituted alkanamido group, a substituted or unsubstituted alkenamido group, a substituted or unsubstituted alkoxy group, a substituted or unsubstituted sulfonamido group or a substituted or unsubstituted aryl group;

Y represents a substituted or unsubstituted alkyl group, a substituted o unsubstituted alkenyl group, a substituted or unsubstituted aryl group, a substituted or unsubstituted aralkyl group or a substituted or unsubstituted heterocyclic group;

$L^2$ contains a chemical bond capable of being released in a developer. Examples of the chemical bond are shown in the following Table C, and the chemical bond can be cleavage by the action of a nucleophilic reagent component, such as hydroxylamine or hydroxyl ion, as contained in a color developer; m and n each represents 0, 1, 2, 3 or 4.

TABLE C

| Chemical Bond contained in $L^2$ | Reaction for Cleavaging the Bond (Reaction with $OH^-$) |
|---|---|
| —COO— | —COOH + HO— |
| —N(H)COO— | —$NH_2$ + HO— |
| —$SO_2O$— | —$SO_3H$ + HO— |
| —$OCH_2CH_2SO_2$— | —OH + $CH_2{=}CHSO_2$— |
| —OC(=O)O— | —OH + HO— |

TABLE C-continued

| Chemical Bond contained in $L^2$ | Reaction for Cleavaging the Bond (Reaction with $OH^-$) |
|---|---|
| $-NHC(=O)C(=O)-$ | $-NH_2 + HO-$ |

Among the above-mentioned groups of formulae (i) through (iv), the group of formula (iii) is especially preferred, and in particular, the group as represented in the following formula (V) is more preferred among the group of formula (iii). The following formula (V) is shown to include the groups A and

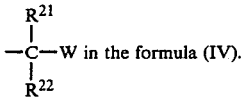

(V)

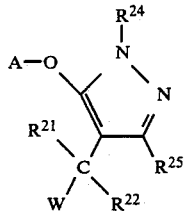

In the formula (V); A, $R^{21}$, $R^{22}$ and W have the same meanings as those in the above-mentioned formula (IV); $R^{24}$ represents a substituted or unsubstituted alkyl group having from 1 to 24 carbon atoms (e.g., a methyl group, a benzyl group, a dodecyl group, etc.), or a substituted or unsubstituted aryl group having from 6 to 36 carbon atoms (e.g., a phenyl group, a 4-tetradecyloxyphenyl group, a 4-methoxyphenyl group, a 4-chlorophenyl group, a 2,5-dichlorophenyl group, a 4-methyl-phenyl group, a 4-nitrophenyl group, etc.); $R^{25}$ represents a hydrogen atom, a substituted or unsubstituted alkyl group having from 1 to 24 carbon atoms (e.g., a methyl group, an ethyl group, an undecyl group, etc.), a substituted or unsubstituted aryl group having from 6 to 36 carbon atoms (e.g., a phenyl group, a 4-methoxyphenyl group, etc.), a substituted or unsubstituted alkoxy group having from 1 to 24 carbon atoms (e.g., a methoxy group, an ethoxy group, a dodecyloxy group, etc.), a cyano group, a substituted or unsubstituted amino group having from 0 to 36 carbon atoms (e.g., an amino group, a dimethylamino group, a piperidino group, a dihexylamino group, an anilino group, etc.), a substituted or unsubstituted carbonamido group having from 1 to 24 carbon atoms (e.g., an acetamido group, a benzamido group, a tetradecanamido group, etc.), a substituted or unsubstituted sulfonamido group having from 1 to 24 carbon atoms (e.g., a methylsulfonamido group, a phenylsulfonamido group, etc.), a carboxy group, a substituted or unsubstituted alkoxycarbonyl group having 2 to 24 carbon atoms (e.g., a methoxycarbonyl group, a dodecyloxycarbonyl from 1 to 24 carbon atoms, (e.g., a carbamoyl group, a dimethyl carbamoyl group, a pyrrolidinocarbamoyl group, etc.)

As the group A in formula (V), a cyan dye-forming coupler residue (such as a phenol series cyan coupler residue, etc.) is preferred; as the groups $R^{21}$ and $R^{22}$, hydrogens are preferred; as the group $R^{24}$, a substituted or unsubstituted aryl group is preferred; and as the group $R^{25}$, a substituted or unsubstituted alkyl group is preferred.

Specific examples of the compounds of formula (IV) are set forth hereunder, however, these examples are not intended to restrict the scope of the present invention.

(IV-1)

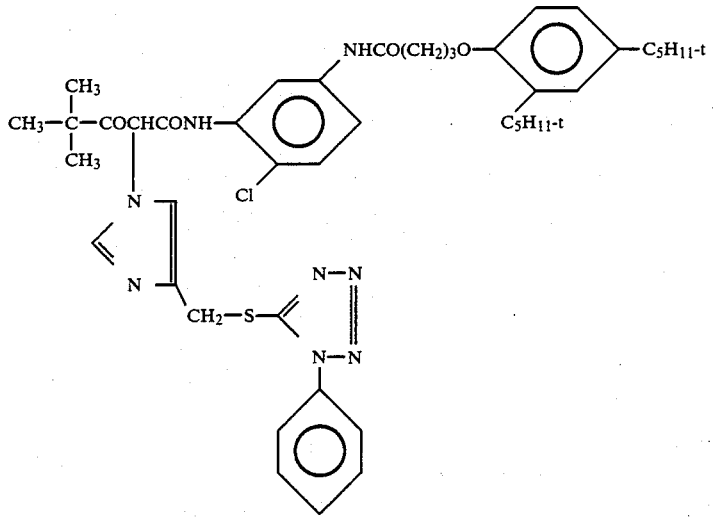

-continued
(IV-2)
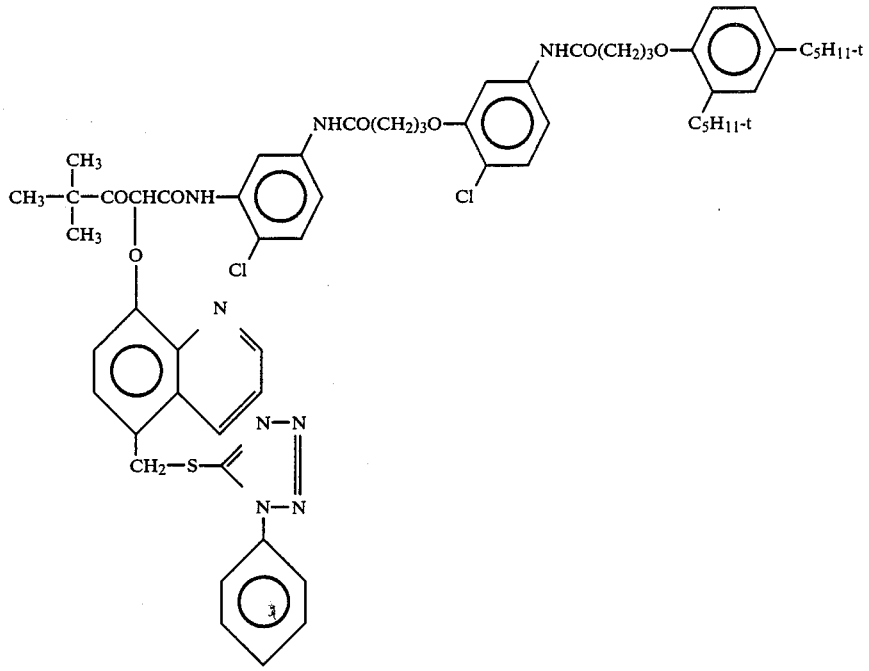
(IV-3)
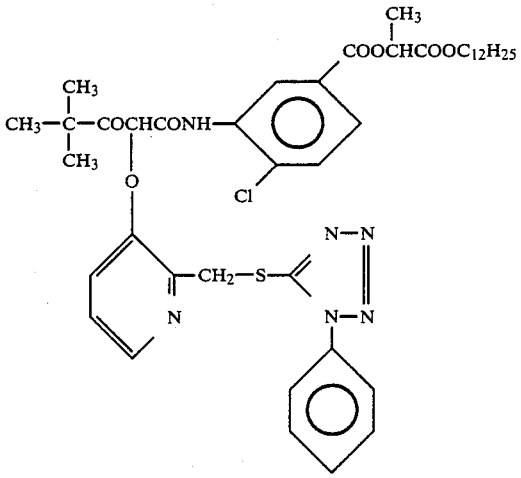
(IV-4)
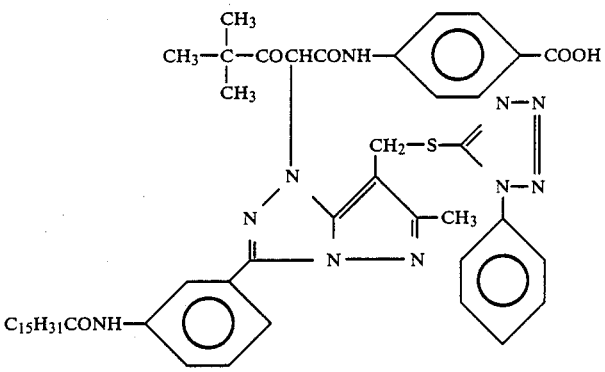

-continued
(IV-5)
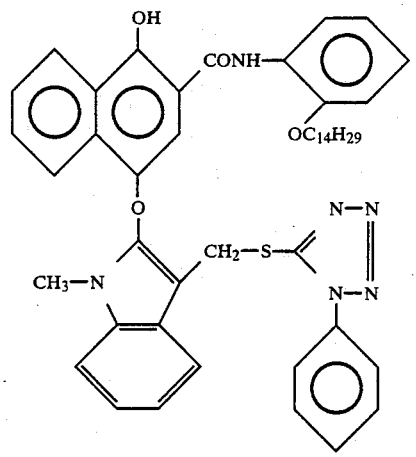
(IV-6)
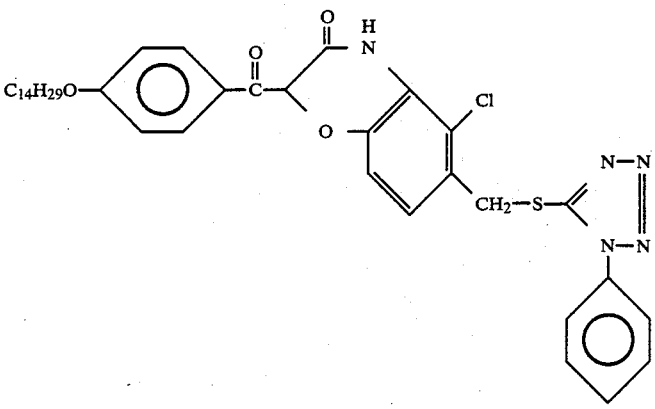
(IV-7)
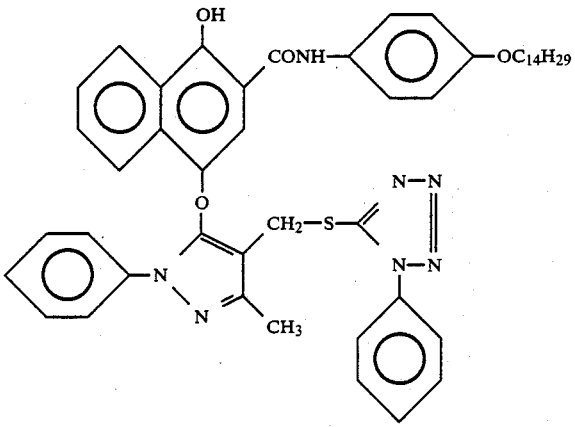
(IV-8)
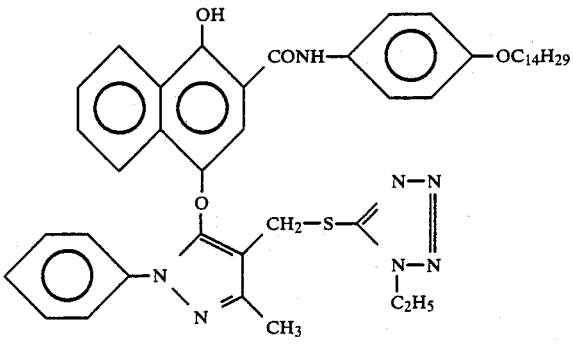

-continued
(IV-9)
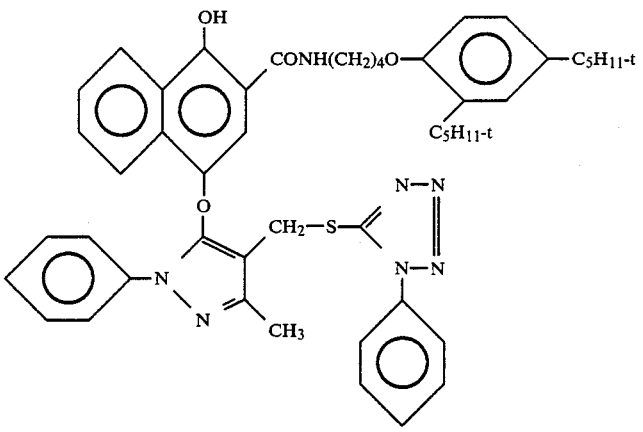
(IV-10)
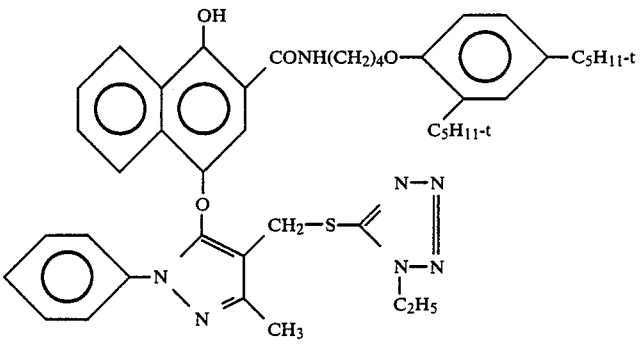
(IV-11)
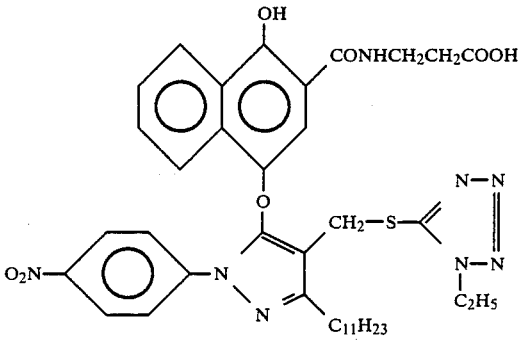
(IV-12)
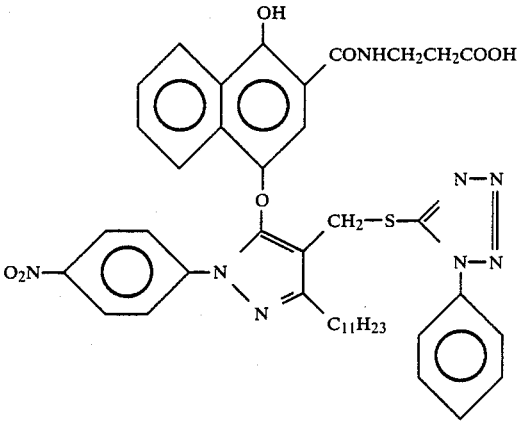

-continued
(IV-13)
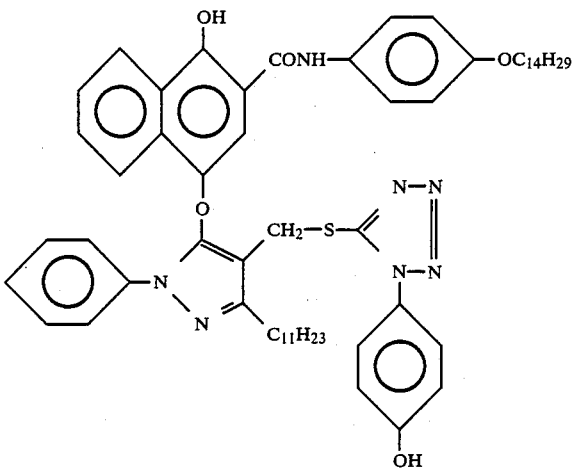
(IV-14)
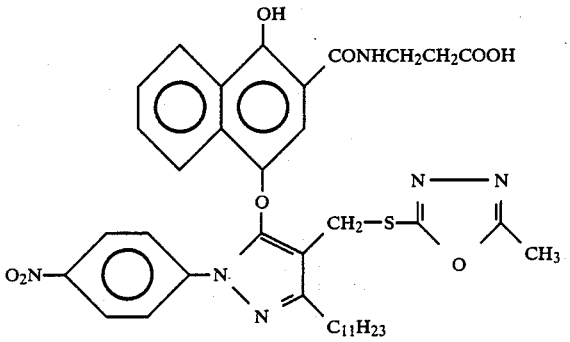
(IV-15)
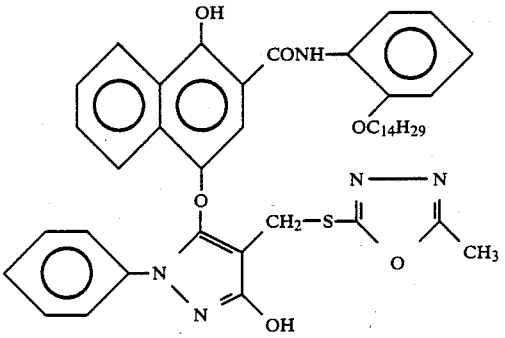
(IV-16)
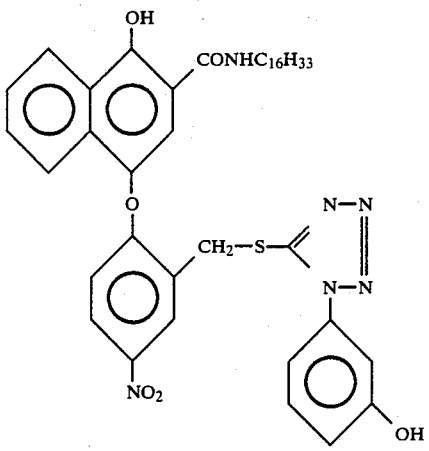

-continued
(IV-17)
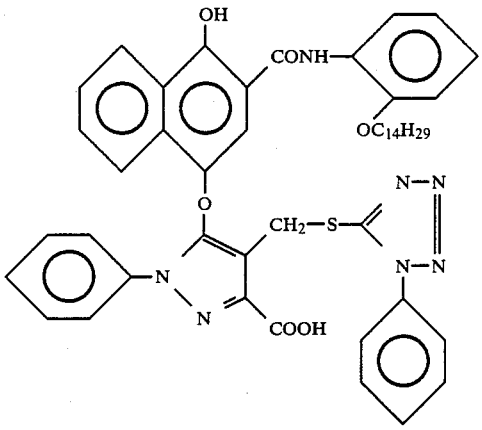
(IV-18)
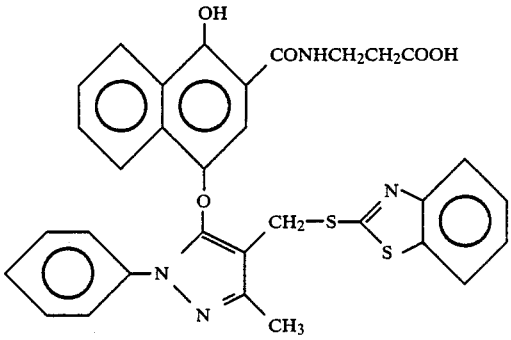
(IV-19)
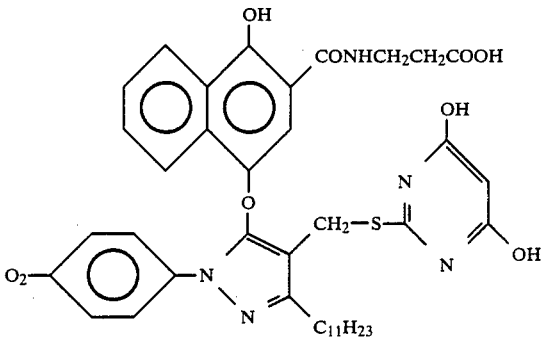
(IV-20)
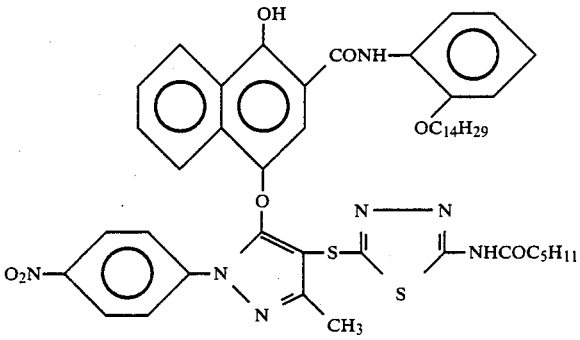

-continued (IV-21)

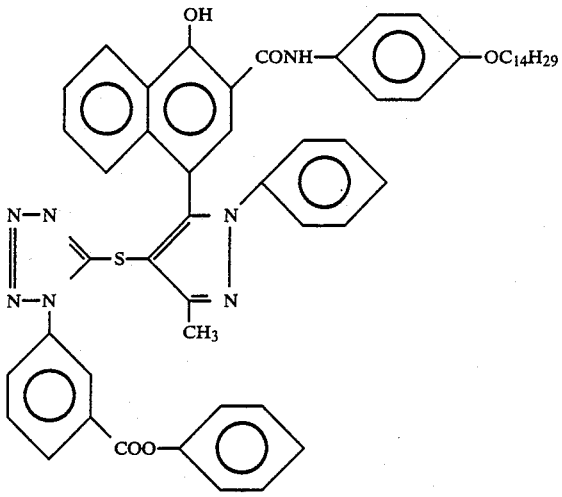

(IV-22)

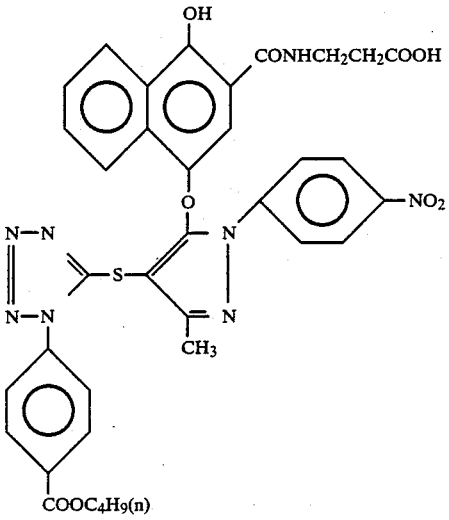

These DIR compounds can be synthesized using the methods described in U.S. Pat. No. 4,421,845 and Japanese Patent Application (OPI) Nos. 188035/82, 98728/83, 209736/83, 209737/83, 09738/83 and 209740/83, and so on.

The amount of the compound represented by formula (IV) in the photographic material of the present invention is preferably from $10^{-5}$ to $5\times10^{-1}$ g/cm$^2$, more preferably from $10^{-4}$ to $10^{-1}$ g/m$^2$ and most preferably from $3\times10^{-4}$ to $5\times10^{-2}$ g/m$^2$.

It is possible in the present invention to increase a photographic speed by using a compound capable of forming a development accelerator or a fogging agent (called a FR compound hereinafter) in proportion to the progress of silver development. Such FR compounds can be synthesized with ease using the methods described in U.S. Pat. Nos. 4,390,618, 4,518,682, 4,526,863 and 4,482,629, Japanese Patent Application (OPI) Nos. 157638/84, 170840/84, 185950/85 and 107029/85, and so on.

Two of more of FR compounds may be used together. Such an FR compound is added in an amount of $10^{-10}$ to 0.2 mole, preferably $10^{-7}$ to 0.02 mole, per mole of silver contained in the same layer or an adjacent layer thereof. An FR compound alone or together with a color image-forming coupler is introduced into a silver halide emulsion layer using an oil-in-water dispersion method known as an oil protecting method, whereby the desired end can be achieved.

Typical examples of FR compounds ar illustrated below.

FR-1

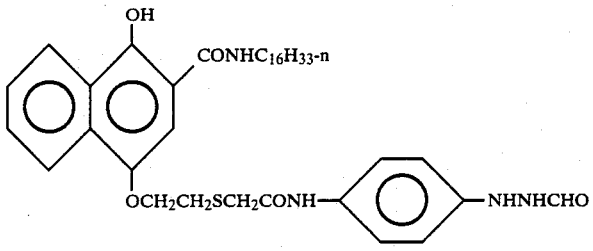

-continued
FR-2
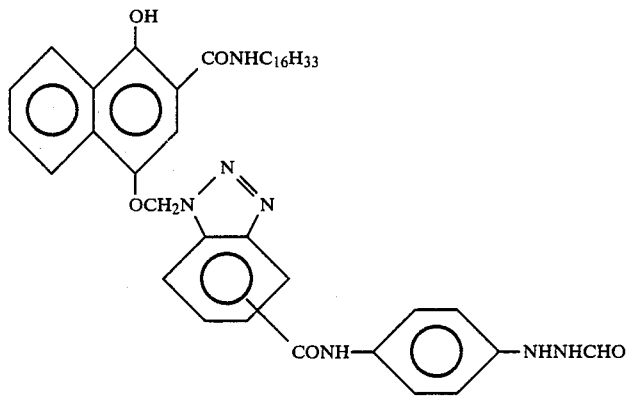
FR-3
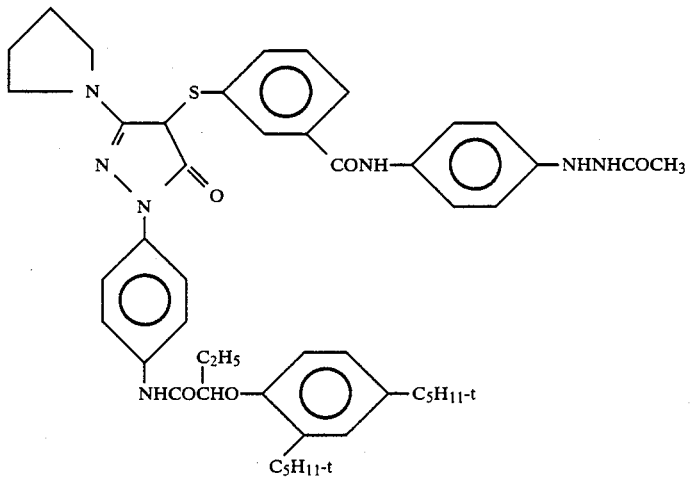
FR-4
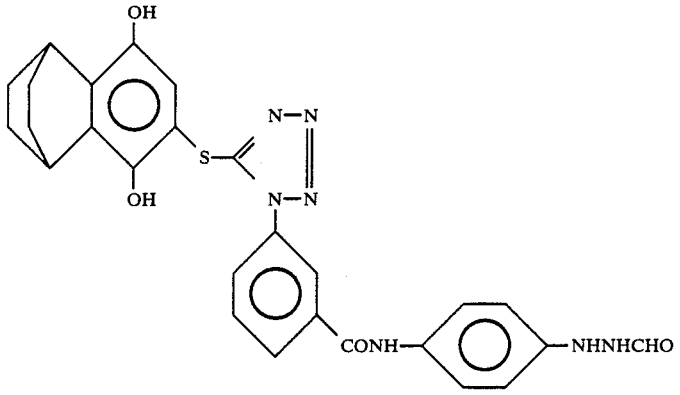

-continued
FR-5
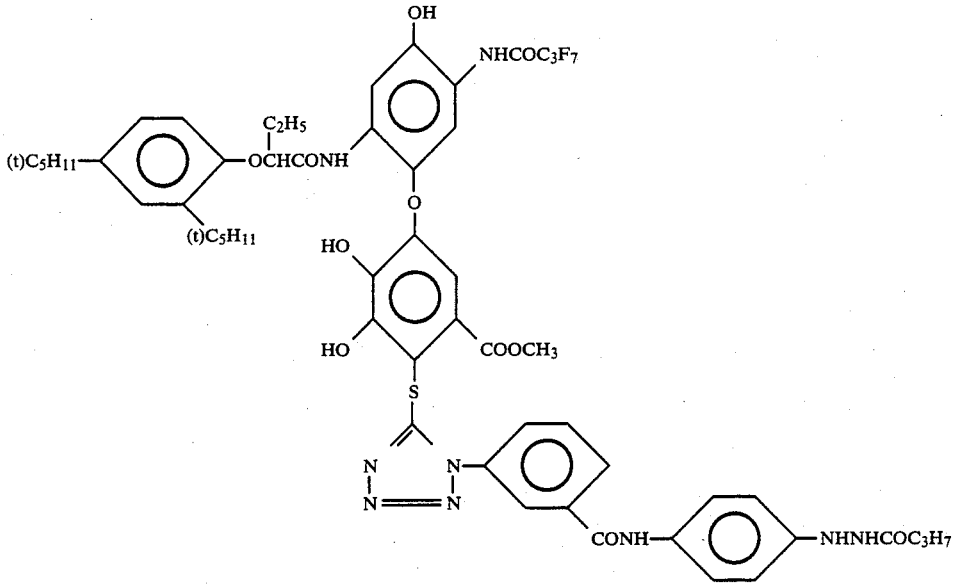
FR-6
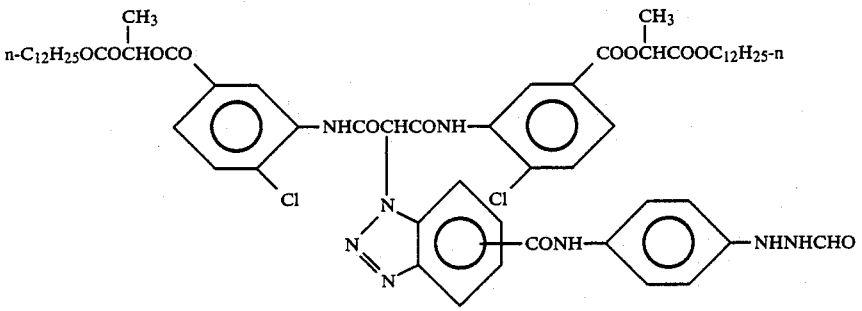
FR-7
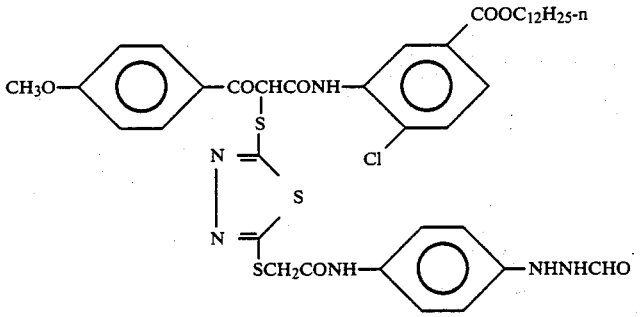
FR-8
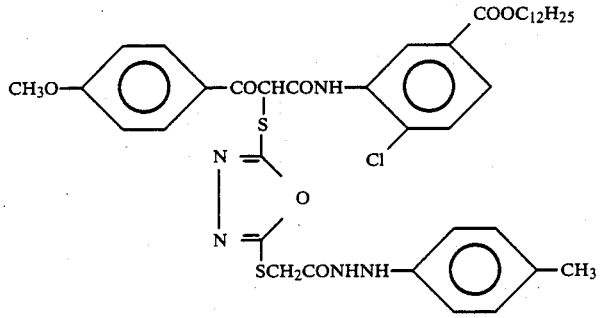

-continued
FR-9
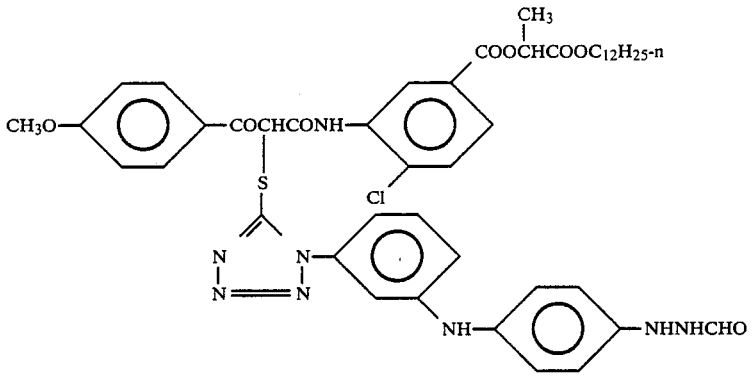
FR-10
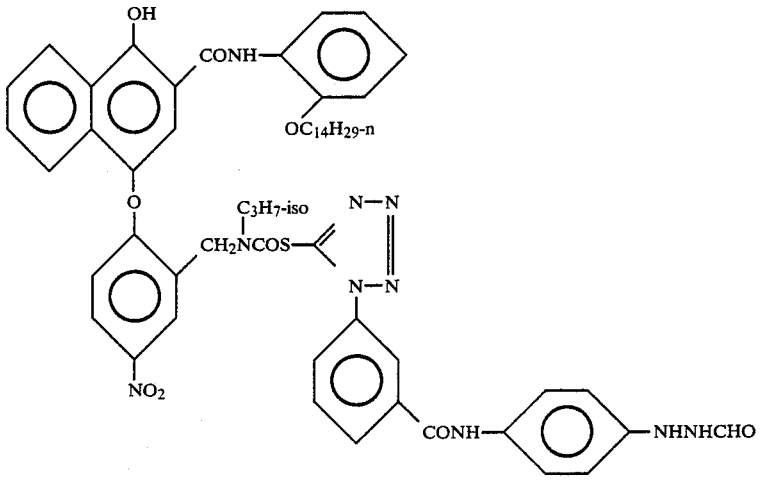
FR-11
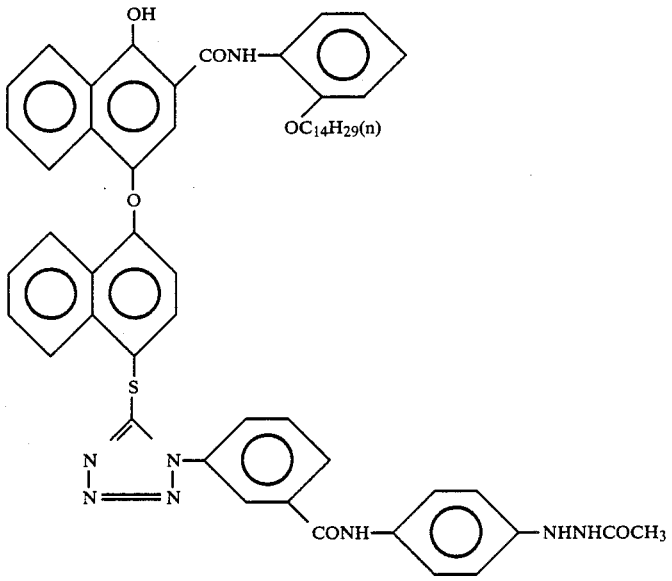

-continued
FR-12
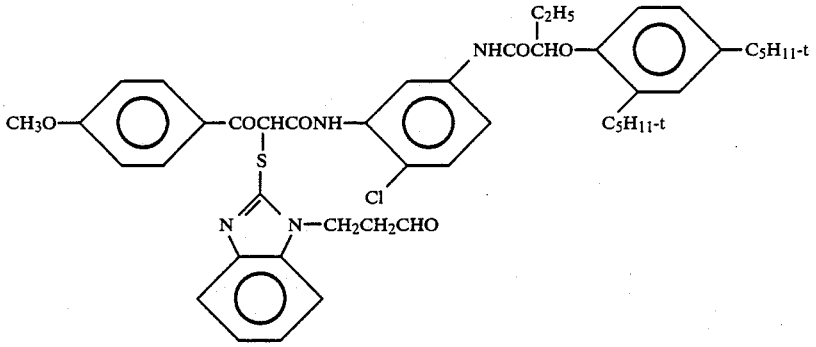
FR-13
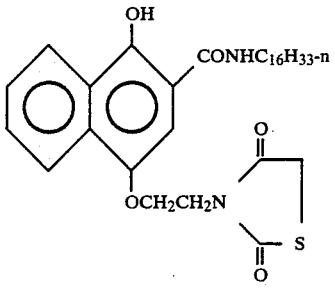
FR-14
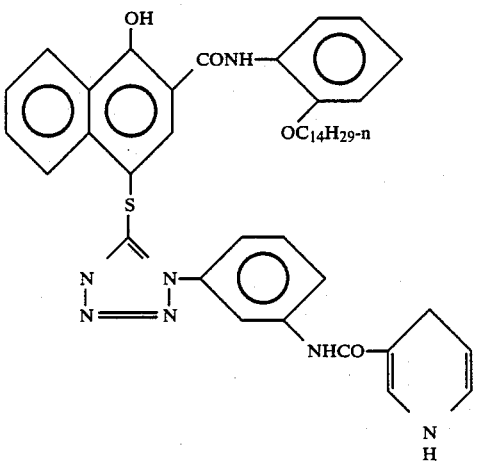
FR-15
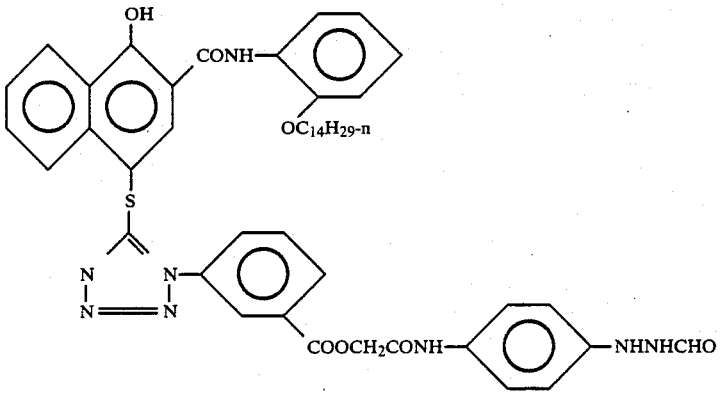

-continued
FR-16
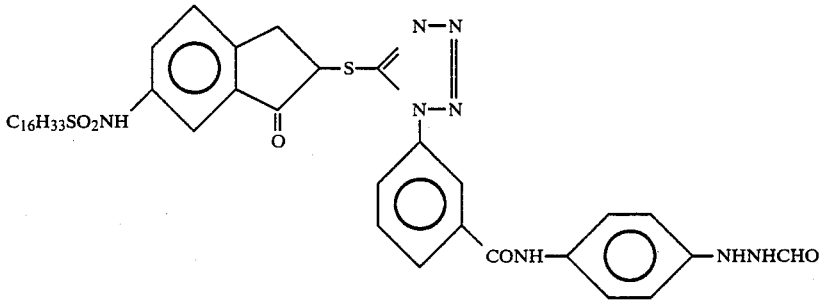
FR-17
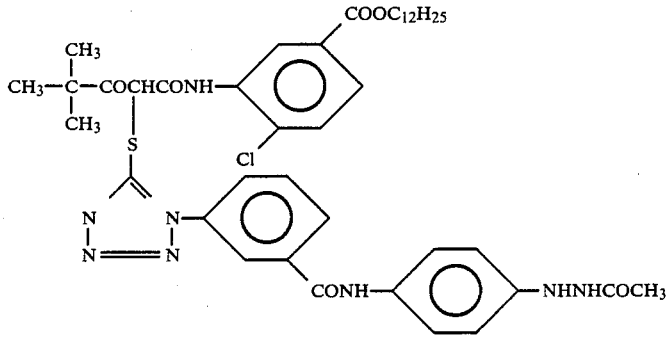
FR-18
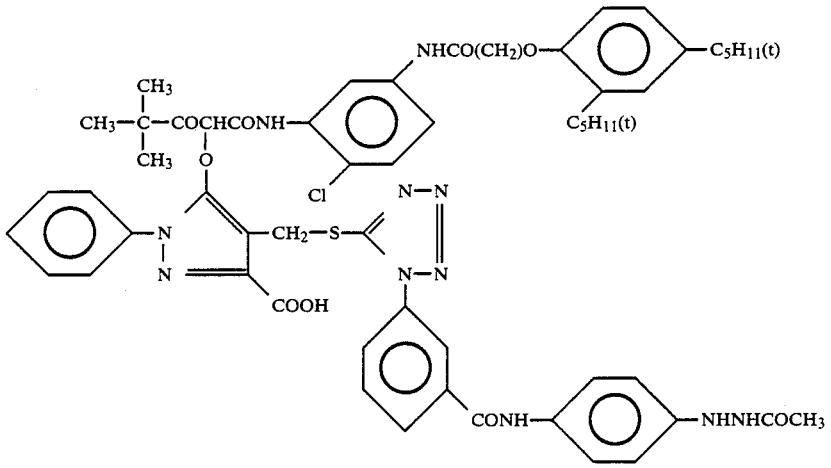

-continued
FR-19
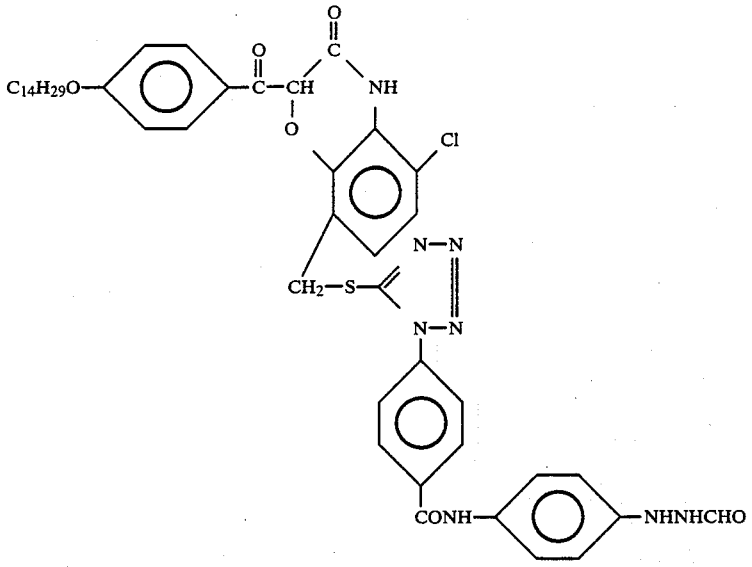
FR-20
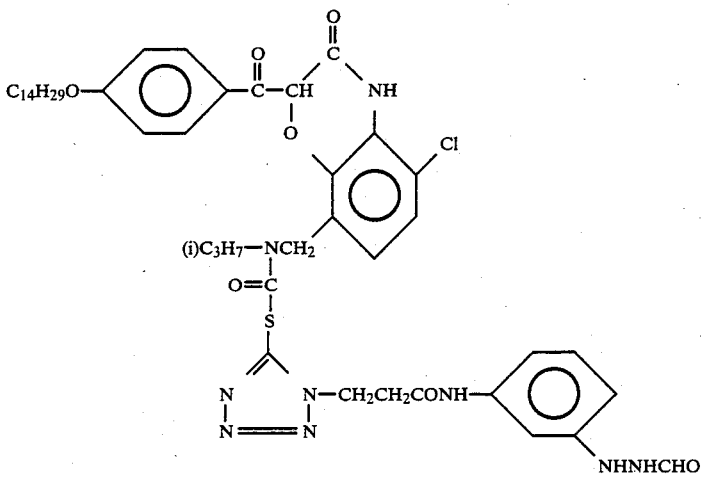
FR-21
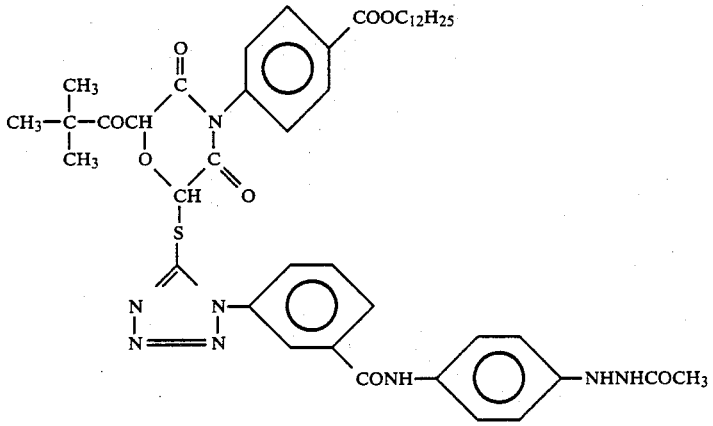

-continued

FR-22

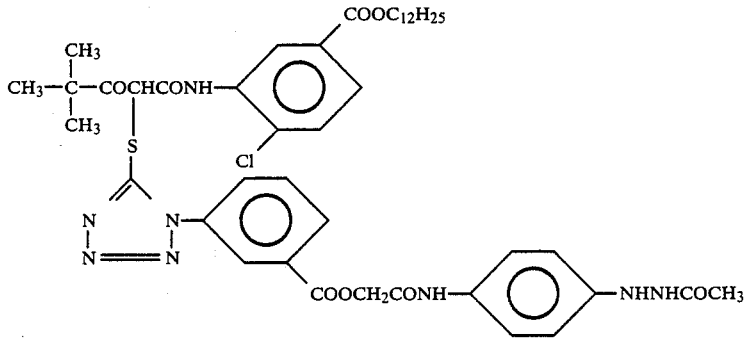

FR-23

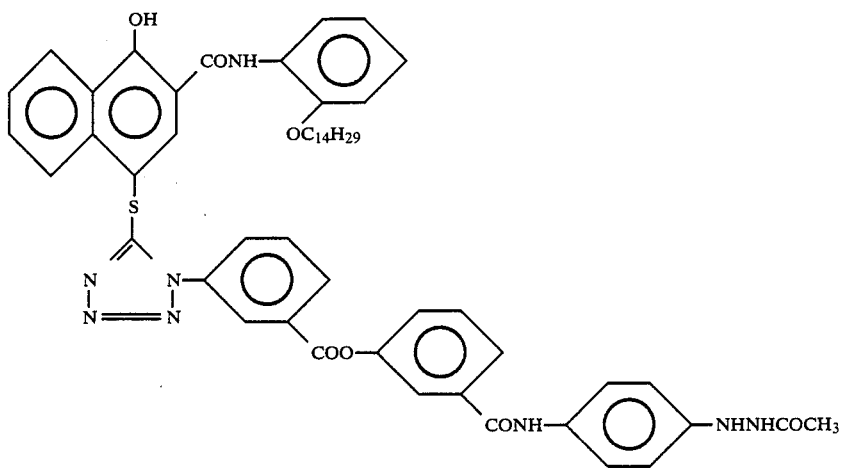

For the purpose of satisfying photographic characteristics required of the photosensitive material, two or more of the above-described couplers and like compounds can be incorporated together in the same layer, and also, the same compound can be added to two or more of different layers separately.

The couplers can be introduced into silver halide emulsion layers using known methods as described, for example, in U.S. Pat. No. 2,322,027. For instance, after dissolving the couplers in a high boiling organic solvent, such as phthalic acid alkyl esters (e.g., dibutyl phthalate, dioctyl phthalate, etc.), phosphoric acid esters (e.g., diphenyl phosphate, triphenyl phosphate, tricresyl phosphate, dioctyl butyl phosphate, etc.), citric acid esters (e.g., tributyl acetylcitrate), benzoic acid esters (e.g., octyl benzoate), alkylamides (e.g., diethyllaurylamide), fatty acid esters (e.g., dibutoxyethyl succinate, diethylazelate, etc.), trimesic acid esters (e.g., tributyl trimesate) or so on, or in an organic solvent having a boiling point of about 30° C. to 150° C. such as lower alkyl acetates like ethyl acetate and butyl acetate, ethyl propionate, secondary butyl alcohol, methyl isobutyl ketone, $\beta$-ethoxyethyl acetate, methyl cellosolve acetate, or so on, the resulting solution is dispersed in a hydrophilic colloid. In dissolving the couplers, the above-described high boiling organic solvents and low boiling solvents may be used in the form of a mixture.

In addition, the dispersion technique using the polymers described in Japanese Patent Publication No. 39853/76 and Japanese Patent Application (OPI) No 59943/76 can be employed.

When the couplers contain an acid group such as carboxyl group or sulfo group, they are introduced into a hydrophilic colloid in the form of an alkaline aqueous solution.

It is favourable to select photographic color couplers to be used in the invention so as to provide images of neutral gray. It is to be desired that the cyan dyes produced from the cyan couplers should show their absorption maxima in the wavelength range of about 600 nm to about 720 nm, the magenta dyes produced from the magenta couplers should show their absorption maxima in the wavelength range of about 500 nm to 580 nm, and the yellow dyes produced from the yellow couplers should show their absorption maxima in the wavelength range of about 400 nm to 480 nm.

The photosensitive material of the present invention may contain dyes in hydrophilic colloid layers for various purposes, e.g., as a filter dye, for prevention of irradiation, and so on. Dyes suitable for such purposes include oxonol dyes, hemioxonol dyes, styryl dyes, merocyanine dyes, cyanine dyes and azo dyes. Of these dyes, oxonol dyes, hemioxonol dyes and merocyanine dyes are used to advantage. Specific examples of dyes which can be used are described in British Pat. Nos. 584,609 and 1,177,429, Japanese Patent Application (OPI) Nos. 85130/73, 99620/74, 114420/74 and 108115/77, and U.S. Pat. Nos. 2,255,077, 2,274,782, 2,390,707, 2,493,747, 2,533,472, 2,843,486, 2,956,879, 3,148,187, 3,177,078, 3,247,127 3,540,887, 3,575,704, 3,653,905, 3,718,472, 4,071,312, 4,070,352 and 4,420,555.

When dyes and ultraviolet absorbents are contained in hydrophilic colloid layers of the photosensitive material of the present invention, they may be mordanted by cationic polymers or the like. For instance, polymers described in British Pat. No. 685,475, U.S. Pat. Nos. 2,675,316, 2,839,401, 2,2882,156, 3,048,487, 3,184,309 and 3,445,231, West German Patent Application (OLS) No. 1,914,362, Japanese Patent Application (OPI) Nos. 47624/75 and 71332/75, and so on can be used as mordant.

The color negative photographic material of the present invention has, in general, a yellow filter layer. In the yellow filter layer, colloidal silver or various kinds of dyes as described above are used. It is particularly preferable in the present invention to use a yellow filter dye which does not decolorized upon a developing processing, for example, as represented by the following general formula (VI), which is described in detail in Japanese patent Application No. 183945/86, because such dyes have an excellent filtering effect, and can impart remarkably high photographic sensitivity to the green-sensitive emulsion layer, compared with colloidal silver.

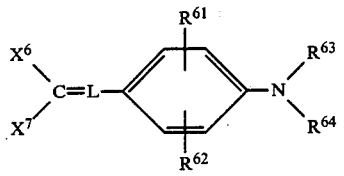

(VI)

In the foregoing formula, $X^6$ and $X^7$ may be the same or different, and each represents a cyano group, a carboxy group, an alkylcarbonyl group, an arylcarbonyl group, an alkoxycarbonyl group, an aryloxycarbonyl group, a carbamoyl group, a sulfonyl group, or a sulfamoyl group. However, the case where the combination of $X^6$ and $X^7$ is that of a cyano group and a substituted or unsubstituted alkylcarbonyl group, or that of a cyano group and a sulfonyl group is excluded therefrom. $R^{61}$ and $R^{62}$ may be the same or different, and each represents a hydrogen atom, a halogen atom, an alkyl group, an alkoxy group, a hydroxy group, a carboxy group, a substituted amino group, a carbamoyl group, a sulfamoyl group, or an alkoxycarbonyl group and may be the same or different, and each represents a hydrogen atom, an alkyl group, or an aryl group. Also, $R^{63}$ and $R^{64}$ may combine with each other to form a 5- or 6-membered ring.

In addition, $R^{61}$ and $R^{63}$, and $R^{62}$ and $R^{64}$ may be connected to each other to form 5- or 6-membered rings, respectively.

L represents a methine group.

Specific examples of the yellow dyes represented by general formula (VI) are illustrated below.

YF-1

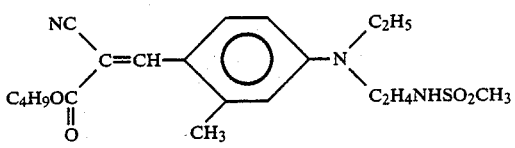

YF-2

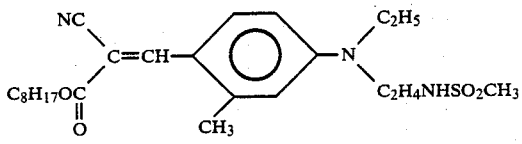

YF-3

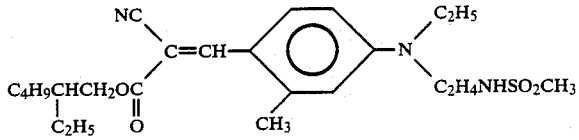

YF-4

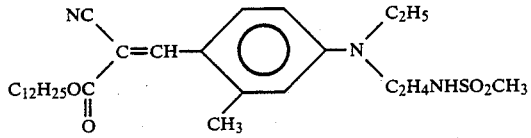

YF-5

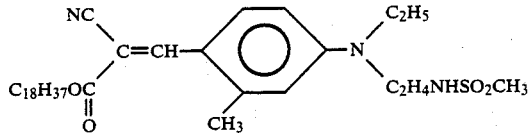

YF-6

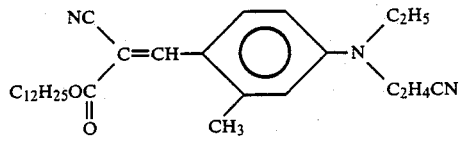

-continued

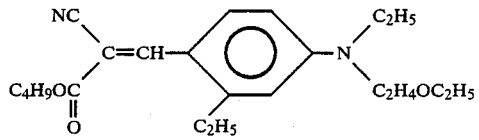

YF-7

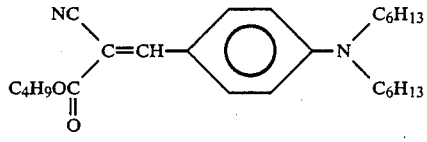

YF-8

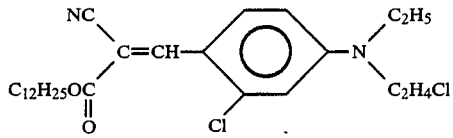

YF-9

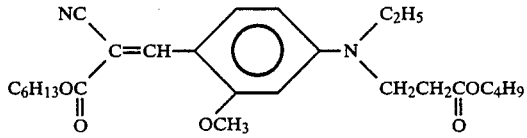

YF-10

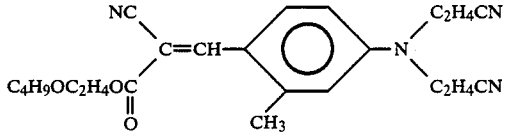

YF-11

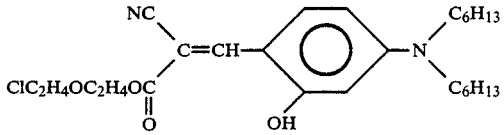

YF-12

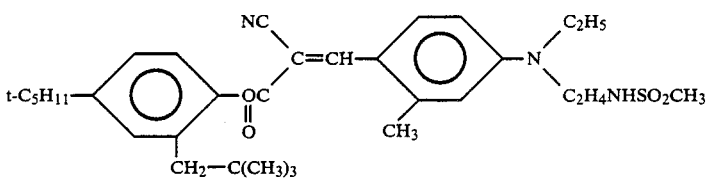

YF-13

Furthermore, dyes which is decolorized upon a developing process which are disclosed, for example, in U.S. Pat. Nos. 3,672,989 and 3,698,901 may also be used.

The above-illustrated yellow dyes do only save the use of yellow colloidal silver so as to reduce the content of silver in the photographic material, but also contribute to a peculiar sensitizing effect This is because these yellow dyes have such a sharp light-absorption characteristic as to transmit light of wavelengths effective to green- and red-sensitive silver halide emulsion layers without absorbing such light, so they are used to great advantage in increasing the photographic speed of the lower layer. In addition, the use of a yellow dye filter has another advantage in that it enables evasion of physical development which tends to occur by the influence of the neighboring colloidal silver, and thereby high-speed emulsions which have received an after-ripening treatment to the fullest are easily used in blue- and green-sensitive emulsion layers.

As the use of Yellow dyes can give aide in increasing the photographic speed of a green-sensitive emulsion layer, it becomes feasible to maintain a prescribed level of photographic speed even when the silver content in the green-sensitive layer is reduced. In addition, the use of a two-equivalent coupler in the green-sensitive layer, particularly in both the constituent layer of a high photographic speed and that of a low photographic speed, can increase the dye forming efficiency, and thereby a reduction of silver becomes feasible without being attended by deterioration in graininess.

Moreover, a reduction of the content of silver in the green-sensitive layer leads to an improvement in the efficient use of light in the red-sensitive layer located under the green-sensitive layer, and when a filter dye represented by general formula (VI) is used a high sensitivity can be maintained accompanying with the super sensitizing effect of the dye.

In the photosensitive material of the present invention, various additives which have so far been employed in general silver halide photosensitive materials can be used. Such additives are described, e.g., in U.S. Pat. No. 4,599,301.

As representative examples of such additives, mention may be made of those described in the specification of the above-cited patent from the 12-th line in column 33 to the 45-th line in column 38, more specifically surface active agents (column 33), polymers insoluble or slightly soluble in water (columns 33 and 34), ultraviolet absorbents (columns 37 and 38), antifoggants (column 37), color fog inhibitors (column 38), hydroquinones (column 38) and so on.

The photosensitive material of the present invention can be development-processed according to the method described, e.g., in the specification of the foregoing U.S. Patent, from column 34 to column 35.

After a desilvering step, e.g., fixation, bleach-fix or like step, the silver halide color negative photographic material of the present invention is, in general, subjected to a washing step, a stabilizing step, and/or so on.

The volume of washing water required can be determined depending on the characteristics of photosensitive materials to be processed (specifically, depending, e.g., on what kinds of the couplers are incorporated therein). The end-use purposes of the photosensitive materials to be processed, the temperature of the washing water, the number of washing tanks (stage number), the way of replenishing the washing water (e.g., whether a current of water flows in the counter direction, or not), and other various conditions. In particular, the relation between the number of washing tanks and the volume of washing water in the multistage counter current process can be determined using the method described in *Journal of the Society of Motion Picture and Television Engineers*, volume 64, pages 248–253 (May 1955).

According to the multistage counter current process described in the above-cited reference, the volume of washing water can be sharply decreased. However, the process suffers from disadvantages in that bacteria grow in the tanks because of an increase in the staying time of the water in the tanks, and the suspended matter produced from the bacteria sticks to the photosensitive materials processed therein. As a means of solving such a problem in the processing of the color photosensitive material of the present invention when the above-described process is applied, the method of reducing the contents of calcium and magnesium, which is described in Japanese Patent Application 131632/86, can be employed to enormous advantage. Further, the bactericides such as isothiazolone compounds described in Japanese Patent Application (OPI) No. 8542/82, sodium salt of chlorinated isocvanuric acid, benzotriazole described in Hiroshi Horiguchi *Bohkun Bohkun Zai no Kagaku* (which means "Chemistry of Antibacteria and Antimold"), and *Biseibutshu no Mekkin Sakkin Bohkun no Kagaku* (which means "Arts of sterilizing and pasteurizing microbes, and proofing against mold"), compiled by Eisei Gijutsu Kai can be used.

Washing water to be used in the processing of the photosensitive material of the present invention is adjusted to pH 4-10, preferably to pH 5-9.

Also, the photosensitive material of the present invention can be processed directly with a stabilizing solution in place of using the above-described washing water. Known methods, all of which are described in Japanese Patent Application (OPI) Nos. 8543/82, 14834/83 and 118749/86, can be applied to the stabilization processing of the photosensitive material of the present invention.

The following examples are intended to illustrate the present invention but not to limit it in any way. Unless otherwise indicated, all parts and percents are by weight.

EXAMPLE 1

A multilayer color photographic paper (Sample 101) was prepared by forming the layers having the compositions shown below on a cellulose triacetate film support having a subbing layer.

Compositions of the Photographic Layers

The amount of each component coated is represented by the unit of g/m$^2$, and the amount of silver halide coated is represented by the amount of silver in the halide coated. The amount of each sensitizing dye coated is represented by the unit of the respective molar amount coated per mol of silver halide in the same layer.

| | |
|---|---|
| First Layer: Anti-halation Layer | |
| Back Colloidal Silver | 0.18 (as Ag) |
| Gelatin | 1.40 |
| Second Layer: Interlayer | |
| 2,5-Di-t-pentadecylhydroquinone | 0.18 |
| Coupler C-1 | 0.07 |
| Coupler C-3 | 0.02 |
| Ultraviolet Absorbent U-1 | 0.08 |
| Ultraviolet Absorbent U-2 | 0.08 |
| High Boiling Point Solvent HBS-1 | 0.10 |
| High Boiling Point Solvent HBS-2 | 0.02 |
| Gelatin | 1.04 |
| Third Layer: First Red-sensitive Emulsion Layer | |
| Silver Iodobromide Emulsion (mean grain size: 0.7 μm, mean silver iodide content: 3 mol %) | 1.52 (as Ag) |
| Sensitizing Dye IX | $6.9 \times 10^{-5}$ |
| Sensitizing Dye II | $1.8 \times 10^{-5}$ |
| Sensitizing Dye III | $3.1 \times 10^{-4}$ |
| Sensitizing dye IV | $4.0 \times 10^{-5}$ |
| Coupler C-2 | 0.146 |
| High Boiling Point Solvent HBS-1 | 0.005 |
| Coupler C-15 | 0.0050 |
| Gelatin | 1.20 |
| Fourth Layer: Second Red-sensitive Emulsion Layer | |
| Silver Iodobromide Emulsion (mean grain size: 0.95 μm, mean silver iodide content: 3 mol %) | 1.38 (as Ag) |
| Sensitizing Dye IX | $5.1 \times 10^{-5}$ |
| Sensitizing Dye II | $1.4 \times 10^{-5}$ |
| Sensitizing Dye III | $2.3 \times 10^{-4}$ |
| Sensitizing Dye IV | $3.0 \times 10^{-5}$ |
| Coupler C-2 | 0.060 |
| Coupler C-3 | 0.008 |
| Coupler C-15 | 0.004 |
| High Boiling Point Solvent HBS-1 | 0.005 |
| Gelatin | 1.50 |
| Fifth Layer: Third Red-sensitive Emulsion Layer | |
| Silver Iodobromide Emulsion (mean grain size: 1.3 μm, mean silver iodide content: 4 mol %) | 2.08 (as Ag) |
| Sensitizing Dye IX | $5.4 \times 10^{-5}$ |
| Sensitizing Dye II | $1.4 \times 10^{-5}$ |
| Sensitizing Dye III | $2.4 \times 10^{-4}$ |
| Sensitizing Dye IV | $3.1 \times 10^{-5}$ |
| Coupler C-5 | 0.012 |
| Coupler C-3 | 0.003 |
| Coupler C-4 (high reaction speed coupler) | 0.004 |
| High Boiling Point HBS-1 | 0.32 |
| Gelatin | 1.63 |
| Sixth Layer: Interlayer | |
| Gelatin | 1.06 |
| Seventh Layer: First Green-sensitive Emulsion Layer | |
| Silver Iodobromide Emulsion (mean grain size: 0.7 μm, mean silver iodide content: 3 mol %) | 0.64 (as Ag) |
| Sensitizing Dye V | $3.0 \times 10^{-5}$ |
| Sensitizing Dye VI | $1.0 \times 10^{-4}$ |
| Sensitizing Dye VII | $3.8 \times 10^{-4}$ |
| Coupler C-6 | 0.120 |
| Coupler C-1 | 0.021 |

-continued

| | |
|---|---|
| Coupler C-7 | 0.030 |
| Coupler C-8 | 0.025 |
| High Boiling Point Solvent HBS-1 | 0.20 |
| Gelatin | 1.70 |
| Eighth Layer: Second Green-sensitive Emulsion Layer | |
| Silver Iodobromide Emulsion (mean grain size: 0.95 μm, mean silver iodide content: 4 mol %) | 1.12 (as Ag) |
| Sensitizing Dye V | $2.1 \times 10^{-5}$ |
| Sensitizing Dye VI | $7.0 \times 10^{-5}$ |
| Sensitizing Dye VII | $2.6 \times 10^{-4}$ |
| Coupler C-6 | 0.021 |
| Coupler C-8 | 0.004 |
| Coupler C-1 | 0.002 |
| Coupler C-7 | 0.003 |
| High Boiling Point Solvent HBS-1 | 0.15 |
| Gelatin | 0.80 |
| Ninth Layer: Third Green-sensitive Emulsion Layer | |
| Silver Iodobromide Emulsion (mean grain size: 1.3 μm, mean silver iodide content: 5 mol %) | 2.07 (as Ag) |
| Sensitizing Dye V | $3.5 \times 10^{-5}$ |
| Sensitizing Dye VI | $8.0 \times 10^{-5}$ |
| Sensitizing Dye VII | $3.0 \times 10^{-4}$ |
| Coupler C-6 | 0.011 |
| Coupler C-1 | 0.001 |
| High Boiling Point Solvent HBS-2 | 0.69 |
| Gelatin | 1.74 |
| Tenth layer: Yellow Filter Layer | |
| Yellow Colloidal Silver | 0.05 (as Ag) |
| 2,5-Di-t-pentadecylhydroquinone | 0.03 |
| Gelatin | 0.95 |
| Eleventh Layer: First Blue-sensitive Emulsion Layer | |
| Silver Iodobromide Emulsion (mean grain size: 0.6 μm, mean silver iodide content: 4 mol %) | 0.31 (as Ag) |
| Sensitizing Dye VIII | $3.5 \times 10^{-4}$ |
| Coupler C-9 (high reaction speed coupler) | 0.27 |
| Coupler C-8 | 0.005 |
| High Boiling Point Solvent HBS-1 | 0.28 |
| Gelatin | 1.28 |
| Twelfth Layer: Second Blue-sensitive Emulsion Layer | |
| Silver Iodobromide Emulsion (mean grain size: 1.1 μm, mean silver iodide content: 6 mol %) | 0.38 (as Ag) |
| Sensitizing Dye VIII | $2.1 \times 10^{-4}$ |
| Coupler C-9 (high reaction speed coupler) | 0.098 |

-continued

| | |
|---|---|
| High Boiling Point Solvent HBS-1 | 0.03 |
| Gelatin | 0.46 |
| Thirteenth Layer: Second Blue-sensitive Emulsion Layer | |
| Silver Iodobromide Emulsion (mean grain size: 1.8 μm, mean silver iodide content: 7 mol %) | 0.77 (as Ag) |
| Sensitizing Dye VIII | $2.2 \times 10^{-4}$ |
| Coupler C-9 (high reaction speed coupler) | 0.036 |
| High Boiling Point HBS-1 | 0.07 |
| Gelatin | 0.69 |
| Fourteenth Layer: First Protective Layer | |
| Silver iodobromide (silver iodide: 1 mol %, mean grain size: 0.07 μm) | 0.1 (as Ag) |
| Ultraviolet Absorbent U-1 | 0.11 |
| Ultraviolet Absorbent U-2 | 0.17 |
| High Boiling Point HBS-1 | 0.90 |
| Fifteenth Layer: Second Protective Layer | |
| Polymethyl methacrylate grains (diameter: about 1.5 μm) | 0.54 |
| Formalin Scavenger S-1 | 0.15 |
| Formalin Scavenger S-2 | 0.10 |
| Gelatin | 0.72 |

Gelatin hardener H-1 and an anion surfactant (dodecylbenzene sulfonic acid type) were added to each layer in addition to the above-mentioned composition.

In the same manner as the preparation of Sample 101, Samples 102 and 103 were prepared except that the silver amount in each layer coated and the combined total of silver contents was varied as shown in the following Table 1.

Each of the samples thus prepared were, immediately after preparation or after storage for one year under natural conditions, exposed and developed in the same manner as the case of the measurement of the above-mentioned specific photographic sensitivity and thus the photographic characteristics of the respective samples were measured. The results obtained are shown in the following Table 2.

The compounds used in Example 1 are as follows:

U-1

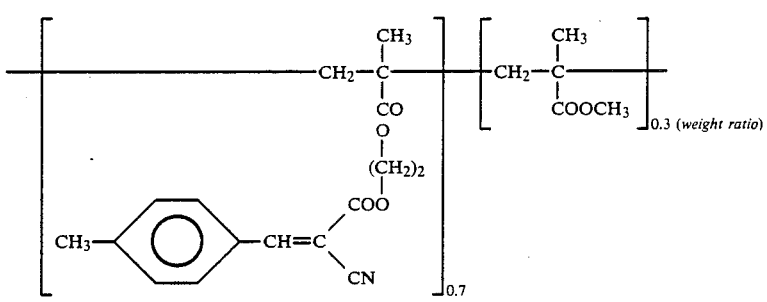

U-2

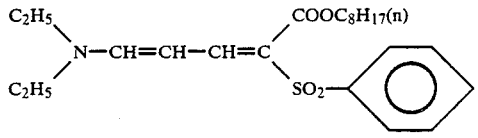

-continued
C-1
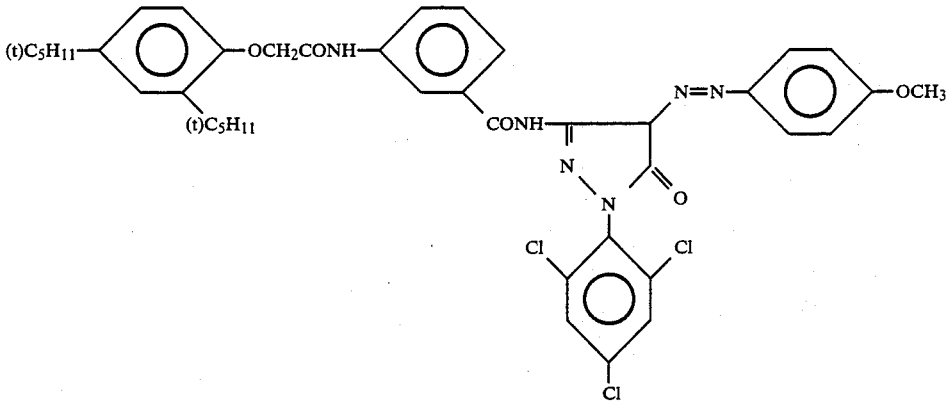
C-2
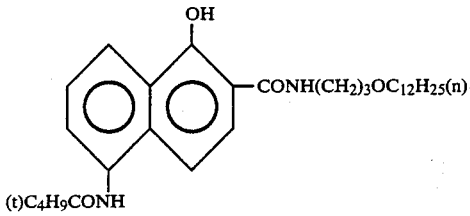
C-3
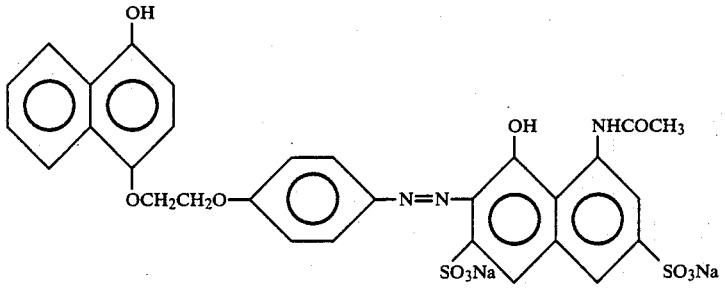
C-4
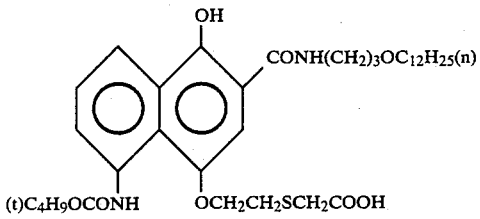
C-5
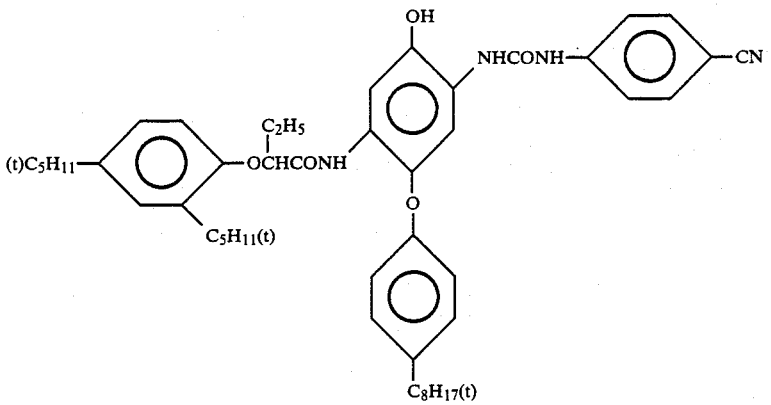

-continued
C-6
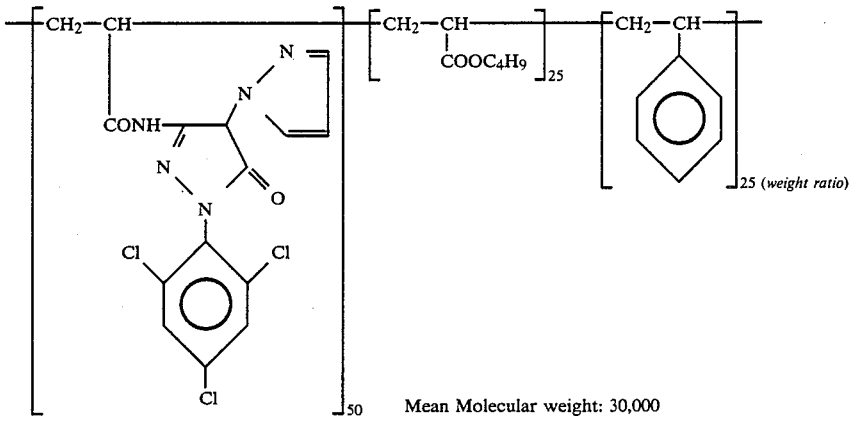
Mean Molecular weight: 30,000
C-7
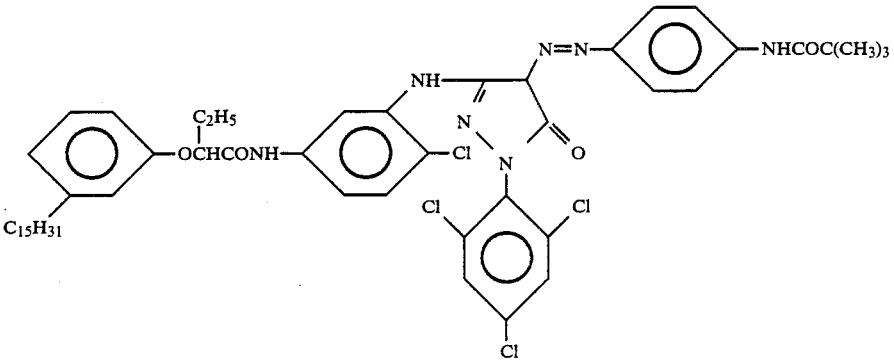
C-8
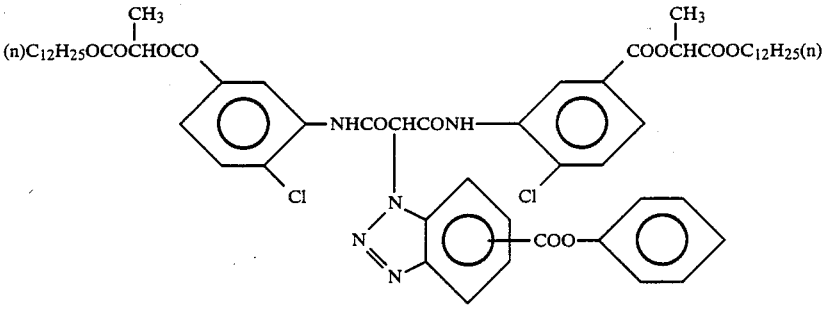
C-9
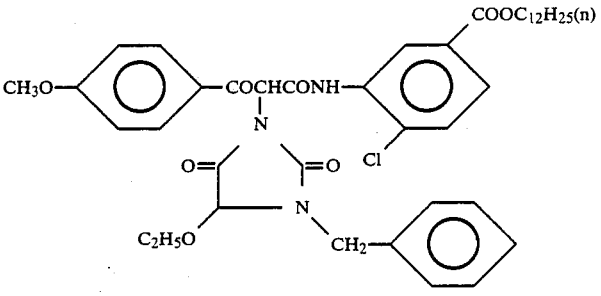

-continued
C-15
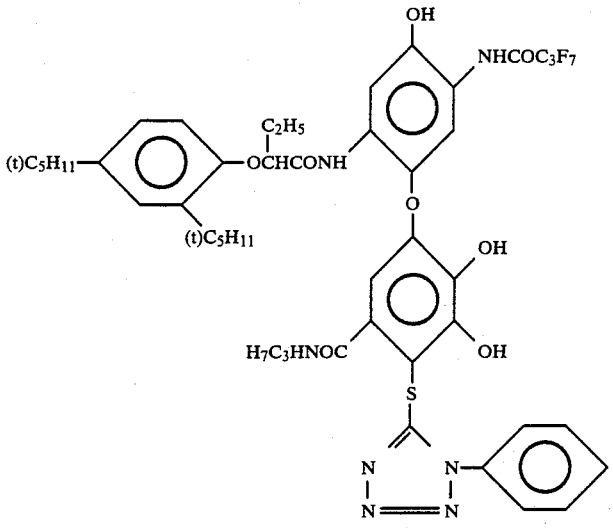
S-1
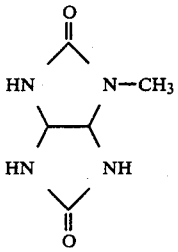
S-2
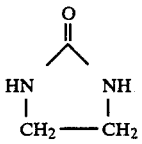
Tricresyl Phosphate HBS-1
Dibutyl Phthalate HBS-2
H-1
$CH_2{=}CH{-}SO_2{-}CH_2{-}CONH{-}CH_2$
$CH_2{-}CH{-}SO_2{-}CH_2{-}CONH{-}CH_2$
Sensitizing Dyes
II
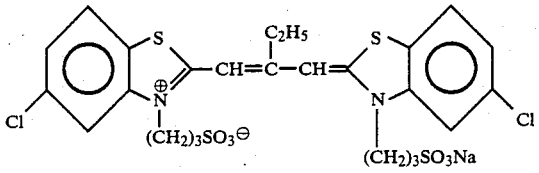
III
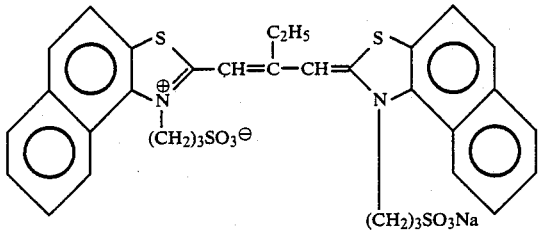

-continued

IV

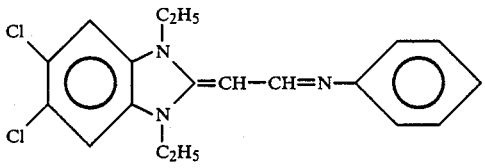

V

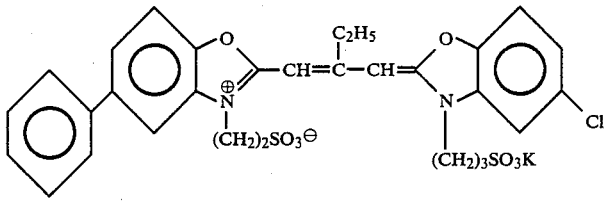

VI

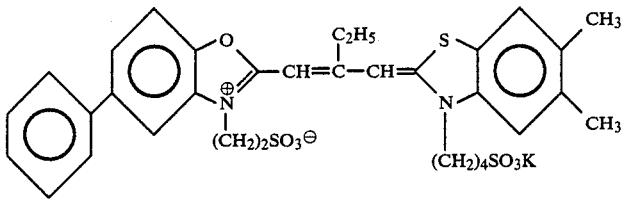

VII

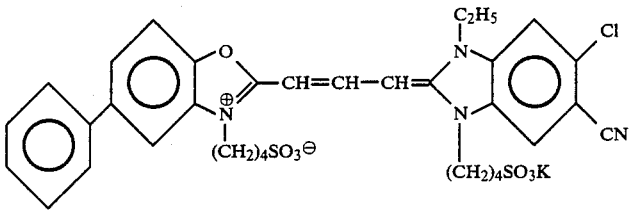

VIII

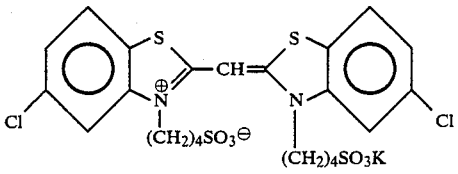

IX

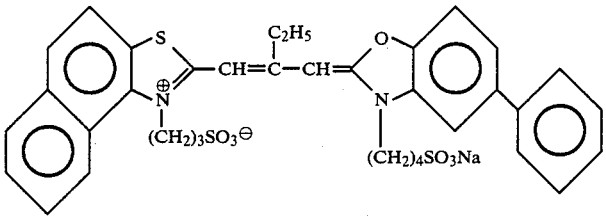

| Layer | Amount of Silver in Each Layer Coated in Samples 101 to 103 ($g/m^2$) | | |
|---|---|---|---|
| | Sample 101 (Comparison) | Sample 102 (The invention) | Sample 103 (The invention) |
| 1st layer | 0.13 | 0.18 | 0.18 |
| 3rd layer | 1.52 | 0.50 | 0.50 |
| 4th layer | 1.38 | 0.97 | 0.90 |
| 5th layer | 2.08 | 1.46 | 1.27 |
| 7th layer | 0.64 | 0.31 | 0.31 |
| 8th layer | 1.12 | 0.72 | 0.60 |
| 9th layer | 2.07 | 1.66 | 1.30 |

-continued

| Layer | Amount of Silver in Each Layer Coated in Samples 101 to 103 ($g/m^2$) | | |
|---|---|---|---|
| | Sample 101 (Comparison) | Sample 102 (The invention) | Sample 103 (The invention) |
| 10th layer | 0.05 | 0.05 | 0.05 |
| 11th layer | 0.31 | 0.22 | 0.22 |
| 12th layer | 0.38 | 0.36 | 0.34 |
| 13th layer | 0.77 | 0.70 | 0.63 |
| 14th layer | 0.10 | 0.10 | 0.10 |
| total | 10.6 | 7.2 | 6.4 |

TABLE 2

| Photographic Characteristics of Samples 101 to 103 | | | | | | |
|---|---|---|---|---|---|---|
| | Fresh Sample | | | After storage for 1 year | | |
| Sample No. | 101 (Comparison) | 102 (The invention) | 103 (The invention) | 101 (Comparison) | 102 (The invention) | 103 (The invention) |
| Sensitivity | | | | | | |
| Blue | 100 | 99 | 97 | 92 | 91 | 89 |
| Green | 100 | 97 | 95 | 92 | 98 | 87 |
| Red | 100 | 98 | 97 | 97 | 95 | 94 |
| Specific photographic sensitivity (S) | 420 | 410 | 403 | 397 | 386 | 382 |
| RMS | | | | | | |
| Blue | 0.036 | 0.041 | 0.042 | 0.042 | 0.042 | 0.043 |
| Green | 0.016 | 0.019 | 0.020 | 0.021 | 0.021 | 0.022 |
| Red | 0.015 | 0.019 | 0.021 | 0.020 | 0.021 | 0.022 |
| MTF | | | | | | |
| Blue | 100 | 105 | 107 | 99 | 104 | 106 |
| Green | 100 | 125 | 130 | 98 | 123 | 130 |
| Red | 100 | 140 | 150 | 98 | 139 | 148 |

As apparent from Table 2, Samples 102 and 103 of the present invention are somewhat less sensitive and are somewhat poorer in graininess than Comparative Sample 101, which, however would cause no problem for practical usage. In fact, the difference of graininess between Samples 102 and 103 and Comparative Sample 101 is a negligible level after storage for 1 year when most users actually use photographic papers. On the other hand, regarding the sharpness, Samples 102 and 103 of the present invention have an extremely higher MTF value compared to Comparative Sample 101. As to the overall image-forming property, it is apparent that Samples 102 and 103 of the present invention are better than Comparative Sample 101.

EXAMPLE 2

Sample 204 was prepared in the same manner as the preparation of Sample 102 in Example 1, except that the constitution of the silver iodobromide emulsion in the respective emulsion layers was varied as shown in Table 3 below.

Further, Sample 205 was prepared in the same manner as Sample 204, except that the emulsions in the 5th, 9th and 13th layers in Sample 204 were substituted by emulsions where the inclusion of impurities in the emulsion formed had been controlled as little as possible. Samples 204 and 205 were exposed and developed in the same manner as in Example 1 and the photographic characteristics of the Samples were measured also in the same manner as in Example 1. The results are shown in Table 4 below, where the results of Samples 101 and 102 of Example are also shown.

The results in Table 4 reveal that the low silver Sample 204 of the present invention, containing core/shell type two-layer grains, is comparable to Comparative Sample 101 with respect to the graininess immediately after preparation. Further, after being stored for one year, the graininess of the former is better than the latter. Further, Sample 205 of the present invention having the high-sensitivity emulsions prepared by controlling the inclusion of impurities to be as little as possible, has a higher sensitivity than Comparative Sample 101.

TABLE 3

| Structure of Emulsions used in Samples 102 and 204 | | | | |
|---|---|---|---|---|
| | Sample 102 | | Sample 204 | |
| Layer | Silver Iodide Content | Ratio of Core/Shell | Silver Iodide (core mol %/ shell mol %) | Ratio of Silver Content (Core/Shell) |
| 3rd layer | 3 | Uniform Structure | 12/0 | 1/1 |
| 4th layer | 3 | Uniform Structure | 12/0 | 1/2 |
| 5th layer | 4 | Uniform Structure | 18/0 | 1/2 |
| 7th layer | 3 | Uniform Structure | 12/0 | 1/1 |
| 8th layer | 4 | Uniform Structure | 12/0 | 1/2 |
| 9th layer | 5 | Uniform Structure | 18/0 | 1/2 |
| 11th layer | 4 | Uniform Structure | 15/0 | 1/2 |
| 12th layer | 6 | Uniform Structure | 30/0 | 1/1 |
| 13th layer | 7 | Uniform Structure | 38/0 | 1/1 |

TABLE 4

| Photographic Characteristics of Samples 101, 102, 204, 205 | | | | | | | | |
|---|---|---|---|---|---|---|---|---|
| | Fresh Sample | | | | After storage for 1 year | | | |
| Sample No. | 101 (Comparison) | 102 (The invention) | 204 (The invention) | 205 (The invention) | 101 (Comparison) | 102 (The invention) | 204 (The invention) | 205 (The invention) |
| Sensitivity | | | | | | | | |
| Blue | 100 | 99 | 99 | 105 | 92 | 91 | 91 | 96 |
| Green | 100 | 97 | 97 | 101 | 92 | 89 | 89 | 93 |
| Red | 100 | 98 | 98 | 103 | 97 | 95 | 95 | 99 |
| Specific photographic sensitivity (S) | 420 | 410 | 410 | 428 | 397 | 386 | 386 | 403 |
| RMS | | | | | | | | |
| Blue | 0.036 | 0.041 | 0.037 | 0.037 | 0.042 | 0.042 | 0.038 | 0.038 |

TABLE 4-continued

| Photographic Characteristics of Samples 101, 102, 204, 205 | | | | | | | | |
|---|---|---|---|---|---|---|---|---|
| | Fresh Sample | | | | After storage for 1 year | | | |
| Sample No. | 101 (Comparison) | 102 (The invention) | 204 (The invention) | 205 (The invention) | 101 (Comparison) | 102 (The invention) | 204 (The invention) | 205 (The invention) |
| Green | 0.016 | 0.019 | 0.017 | 0.017 | 0.021 | 0.021 | 0.019 | 0.019 |
| Red | 0.015 | 0.019 | 0.016 | 0.016 | 0.020 | 0.021 | 0.018 | 0.018 |
| MTF | | | | | | | | |
| Blue | 100 | 105 | 103 | 103 | 99 | 104 | 102 | 102 |
| Green | 100 | 125 | 123 | 123 | 98 | 123 | 121 | 121 |
| Red | 100 | 140 | 138 | 138 | 98 | 139 | 137 | 137 |

EXAMPLE 3

Sample 306 was prepared in the same manner as Sample 102 in Example 1, except that Coupler C-31, as shown below, was incorporated in the 9th layer in an amount of 0.02 g/m$^2$, in place of Coupler C-1 and C-6 in the same layer of Sample 102.

Further, Sample 307 was also prepared in the same manner as Sample 102, except that Dye YF-32, as shown below, was incorporated in the 10th layer in an amount of 0.2 g/mz, in place of the yellow colloidal silver and 2,5-di-t-pentadecylhydroquinone in the same layer of Sample 102.

Samples 306 and 307 were exposed and developed in the same manner as in Example 1 and the photographic characteristics were evaluated. The results are shown in Table 5 below, where the results of Sample 101 and 102 of Example 1 are also shown.

YF-32

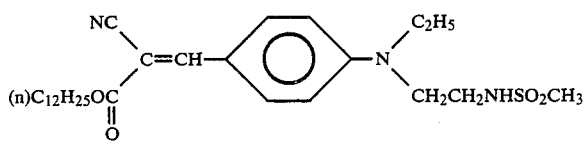

C-31

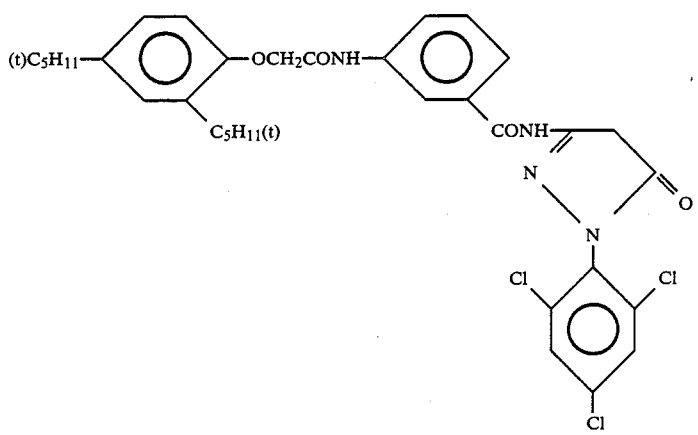

TABLE 5

| Photographic Characteristics of Samples 101, 102, 306, 307 | | | | | | | | |
|---|---|---|---|---|---|---|---|---|
| | Fresh Sample | | | | After storage for 1 year | | | |
| Sample No. | 101 (Comparison) | 102 (The invention) | 306 (The invention) | 307 (The invention) | 101 (Comparison) | 102 (The invention) | 306 (The invention) | 307 (The invention) |
| Sensitivity | | | | | | | | |
| Blue | 100 | 99 | 99 | 99 | 92 | 91 | 91 | 91 |
| Green | 100 | 97 | 80 | 116 | 92 | 89 | 74 | 107 |
| Red | 100 | 98 | 97 | 103 | 97 | 95 | 94 | 100 |
| Specific photographic sensitivity (S) | 420 | 410 | 372 | 460 | 397 | 386 | 353 | 435 |
| RMS | | | | | | | | |
| Blue | 0.036 | 0.041 | 0.041 | 0.041 | 0.042 | 0.042 | 0.042 | 0.042 |
| Green | 0.016 | 0.019 | 0.017 | 0.020 | 0.021 | 0.021 | 0.019 | 0.022 |
| Red | 0.015 | 0.019 | 0.019 | 0.019 | 0.020 | 0.021 | 0.021 | 0.021 |
| MTF | | | | | | | | |
| Blue | 100 | 105 | 105 | 102 | 99 | 104 | 104 | 101 |
| Green | 100 | 125 | 127 | 118 | 98 | 123 | 125 | 117 |
| Red | 100 | 140 | 138 | 135 | 98 | 139 | 137 | 136 |

The results Table 5 reveal that Sample 306, which did not contain a 2-equivalent coupler in the third green-sensitive emulsion layer, or the most high-sensitive emulsion layer among the green-sensitive layers, is somewhat poor in sensitivity although the sharpness thereof is higher and the graininess deterioration thereof with time is smaller than with Comparative Sample 101. Hence, Sample 102 with a 2-equivalent coupler is better than Sample 306.

In addition, Sample 307, having a dye in the yellow filter layer, has a higher sensitivity than Sample 102 having an yellow colloidal silver in place of a dye in the said layer. Hence, the use of such a dye is sufficient for compensating the decrease of the sensitivity which results from the reduction of the silver amount coated.

EXAMPLE 4

Using Samples 101 and 102 obtained in Example 1, a person with Macbeth Chart was photographed. The time of photographing was a slightly cloudy day in mid-September, about two in the afternoon, and the place of photographing was outdoors near the Ashigara Factory of Fuji Photo Film Co. The camera used for photographing was Minolta's α-7000 with a 70 mm lens, F-value 3.5, and the distance from the subject was about 3 m. The ISO was 400.

After photographing, each sample was developed in the same manner as in Example 1 and then printed on Fuji Color High-tech Paper Type 12.

Print 102P, obtained by photograph-taking on Sample 102 of the present invention, was sharper in terms of color-reproduction than Print 101P obtained from Comparative Sample 101. It is considered that since in Sample 102 the silver coating amount is small the inter-layer effects can be easily obtained. In order to quantitatively show this result, the reflection density of each of the blue, green and red patches in the Macbeth Chart in Prints 101P and 102P was measured with a Macbeth densitometer. The results are shown in Table 6 below. Next, the density difference between the respective colors was calculated from the results in Table 6, and the values calculated are shown in Table 7 below.

TABLE 6

| Sample No. | Reflection Density in Prints 101P and 102P | | | | | |
|---|---|---|---|---|---|---|
| | Print 101P (Comparison) | | | Print 102 (The Invention) | | |
| Part in Object | Blue Patch | Green Patch | Red Patch | Blue Patch | Green Patch | Red Patch |
| Cyan Density D (C) | 1.81 | 1.24 | 0.28 | 1.84 | 1.31 | 0.30 |
| Magenta Density D (M) | 1.20 | 0.77 | 1.50 | 1.28 | 0.73 | 1.72 |
| Yellow Density D (Y) | 0.61 | 1.24 | 1.44 | 0.67 | 1.29 | 1.50 |

TABLE 7

| Part in Object | Color Density Difference | Print 101P (Comparison) | Print 102P (The Invention) |
|---|---|---|---|
| Blue Patch | D (C)-D (Y) | 1.04 | 1.01 |
| | D (M)-D (Y) | 0.50 | 0.53 |
| Green Patch | D (C)-D (M) | 0.40 | 0.50 |
| | D (Y)-D (M) | 0.56 | 0.64 |
| Red Patch | D (M)-D (C) | 1.29 | 1.50 |
| | D (Y)-D (C) | 1.32 | 1.36 |

The above-mentioned results reveal that the difference between the cyan density and the magenta density (D(C)-D(M)) and the difference between the yellow density and the magenta density (D(Y)-D(M)) in the green patch part are both greater in Sample Print 102P of the present invention than in Comparative Sample Print 101P. Hence, it is apparent that the green color was more sharply reproduced in Print 102P than in Print 101P. In addition, the difference between the magenta density and the cyan density (D(M)-D(C)) and the difference between the yellow density and the cyan density (D(Y)-D(C)) in the red patch part are both grater in Print 102P than in Print b 101P. Hence, it is apparent that the red color was more sharply reproduced in Print 102P than in Print 101P. It is noted from these results that a sharper color reproduction was attained on the low silver Sample Print 102P of the present invention.

EXAMPLE 5

Samples 102 and 103 of the present invention, as obtained in Example 1, were exposed and then processed with an automatic developing machine in accordance with the following steps, until the total replenisher amount of the developer reached three times the amount of the original developer in the tank.

Processing Steps

| Step | Processing Time | Processing Temperature | Amount of Replenisher(*) |
|---|---|---|---|
| Color Development | 3 min 15 sec | 38° C. | 15 ml |
| Bleaching | 1 min 00 sec | 38° C. | 20 ml |
| Bleach-fixing | 3 min 15 sec | 38° C. | 30 ml |
| Rinsing (1) | 40 sec | 35° C. | Countercurrent system from (2) to (1) |
| Rinsing (2) | 1 min 00 sec | 35° C. | 30 ml |
| Stabilization | 40 sec | 38° C. | 20 ml |
| Drying | 1 min 15 sec | 55° C. | |

The compositions of the processing solutions used are described below.

| Color Developer: | Original(g) | Replenisher(g) |
|---|---|---|
| Diethylenetriamine-tetraacetic Acid | 1.0 | 1.1 |
| 1-Hydroxyethylidene-1, 1-diphosphonic Acid | 2.0 | 2.2 |
| Sodium Sulfite | 4.0 | 4.9 |
| Potassium Carbonate | 30.0 | 42.0 |
| Potassium Bromide | 1.6 | — |
| Potassium Iodide | 2.0 mg | — |
| Hydroxyamine | 2.4 | 3.6 |
| 4-(N-ethyl-N-β-hydroxyethyl-amino)-2-methylaniline Sulfate | 5.0 | 7.3 |
| Water to make | 1 liter | 1 liter |
| pH | 10.00 | 10.05 |

| Bleaching Solution: | Original and replenisher were the same. |
|---|---|
| Ammonium Ferric Ethylenediamine-tetraacetate | 120.0 g |
| Disodium Ethylenediamine-tetraacetate | 10.0 g |
| Ammonium Nitrate | 10.0 g |
| Ammonium Bromide | 100.0 g |
| Bleaching Promoter | $5 \times 10^{-3}$ mol |

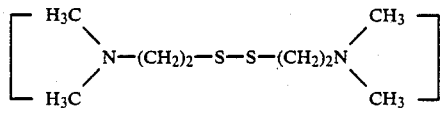

-continued

| Processing Steps | |
|---|---|
| Aqueous Ammonia and Water to make | pH 6.3 and 1.0 liter |
| Bleach-Fixing Solution: | Original and replenisher were the same. |
| Ammonium Ferric Ethylenediamine-tetraacetate | 50.0 g |
| Disodium Ethylenediamine-tetraacetate | 5.0 g |
| Sodium Sulfite | 12.0 g |
| Ammonium Thiosulfate Aqueous Solution (70 wt. %) | 240 ml |
| Aqueous Ammonia and Water to make | pH 7.3 and 1 liter |

(*) the amount is per unit area of 35 mm width and 1 m length of the sample being processed.

Rinsing Water

City water was passed through a mixed bed type column which had been filled with an H-type strong acidic cationic exchange resin (Diaion SK-1B, manufactured by Mitsubishi Chemical Industries) and an OH-type strong basic anionic exchange resin (Diaion SA-10A, manufactured by the Mitsubishi Chemical Industries) whereby the quality of the water thus treated was controlled to have the following composition. Next, sodium dichloroisocyanurate was added as a germicide in an amount of 20 mg/liter.

| Rinsing Water Composition | |
|---|---|
| Calcium Ion | 1.1 mg/liter |
| Magnesium Ion | 0.5 mg/liter |
| pH | 6.9 |

| Stabilizer | Original (g) | Replenisher (g) |
|---|---|---|
| Aqueous Solution of Formaldehyde (37% W/V) | 2.0 ml | 3.0 ml |
| Polyoxyethylene-p-monononyl-phenylether (mean polymerization degree: 10) | 0.3 | 0.45 |
| Disodium Ethylenediamine-tetraacetate | 0.05 | 0.07 |
| Water to make | 1 liter | 1 liter |
| pH | about 6.0 | about 6.0 |

Even after being processed in accordance with the above-mentioned steps, the results of Samples 102 and 103 of the present invention were also excellent as in the case of Example 1.

EXAMPLE 6

Samples 102 and 103 of the present invention, as obtained in Example 1, were exposed and then processed by the following steps.

| Step | Processing Time | Processing Temperature | Amount of Replenisher(*) |
|---|---|---|---|
| Color Development | 3 min 15 sec | 38° C. | 28 ml |
| Bleaching | 6 min 30 sec | 38° C. | 33 ml |
| Rinsing (1) | 3 min 40 sec | 30° C. | 1200 ml |
| Fixation | 4 min 20 sec | 38° C. | 33 ml |
| Rinsing (2) | 1 min 05 sec | 30° C. | 1200 ml |
| Rinsing (3) | 2 min 10 sec | 30° C. | |
| Stabilization | 1 min 05 sec | 38° C. | 33 ml |

-continued

| Step | Processing Time | Processing Temperature | Amount of Replenisher(*) |
|---|---|---|---|
| Drying | 5 min 00 sec | 50° C. | |

(*) the amount is per unit area of 35 mm width and 1 m length of the sample being processed.

Rinsing steps (2) and (3) were effected by countercurrent flow system from (3) to (2).

The compositions of the processing solutions used are described below.

| Color Developer | Original (g) | Replenisher (g) |
|---|---|---|
| Diethylenetriamine-pentaacetic Acid | 1.0 | 1.1 |
| 1-Hydroxyethylidene-1,1-diphosphonic Acid | 2.0 | 2.2 |
| Sodium Sulfite | 4.0 | 4.4 |
| Potassium Carbonate | 30.0 | 32.0 |
| Potassium Bromide | 1.4 | 0.7 |
| Potassium Iodide | 1.3 mg | — |
| Hydroxyamine Sulfate | 2.4 | 2.6 |
| 4-(N-ethyl-N-β-hydroxyethyl-amino)-2-methylaniline Sulfate | 4.5 | 5.0 |
| Water to make | 1.0 liter | 1.0 liter |
| pH | 10.00 | 10.05 |
| **Bleaching Solution** | **Original (g)** | **Replenisher (g)** |
| Ammonium bromide | 160 | 180 |
| Ammonium Ferric Ethylene-diamine-tetraacetate (Dihydrate) | 110 | 130 |
| Disodium Ethylenediamine-tetraacetate (Dihydrate) | 10 | 11 |
| Ammonium Nitrate | 30 | 33 |
| Aqueous Ammonia (28 wt. %) | 7 ml | 5 ml |
| Water to make | 1 liter | 1 liter |
| pH | 6.0 | 5.7 |
| **Fixing Solution** | **Original (g)** | **Replenisher (g)** |
| Ammonium Thiosulfate Solution (70% W/V) | 170 ml | 200 ml |
| Sodium Sulfite | 7 | 8 |
| Sodium Bisulfite | 5 | 5.5 |
| Disodium Ethylenediamine-tetraacetate (Dihydrate) | 0.5 | 0.7 |
| Water to make | 1 liter | 1 liter |
| pH | 6.7 | 6.6 |
| **Stabilizer Solution** | **Original (g)** | **Replenisher (g)** |
| Aqueous Solution of Formaldehyde (37% W/V) | 2.0 ml | 2.0 ml |
| Polyoxyethylene-p-monononyl-phenylether (mean polymerization degree: 10) | 0.3 | 0.45 |
| Disodium Ethylenediamine-tetraacetate | 0.05 | 0.07 |
| Water to make | 1 liter | 1 liter |
| pH | about 6.0 | about 6.0 |

The rinsing water was the same as described in Example 5.

Even after being processed in accordance with the above-mentioned steps, the results of Samples 102 and 103 of the present invention were as excellent as in the case of Example 1.

EXAMPLE 7

Each of multilayer color photographic papers (Samples 401 to 406) was prepared by forming the layers having the compositions shown below on a cellulose triacetate film support having a subbing layer. Compositions of the Photographic Layers:

The amount of each component coated is represented by the unit of g/m$^2$, and the amount of silver halide coated is represented by the amount of silver in the halide coated. The amount of each sensitizing dye and coupler coated is represented by the unit of the respective molar amount coated per mol of silver halide in the same layer.

| | |
|---|---|
| First Layer: Anti-halation Layer | |
| Back Colloidal Silver | 0.2 |
| Gelatin | 1.0 |
| Ultraviolet Absorbent UV-1 | 0.05 |
| Ultraviolet Absorbent UV-2 | 0.1 |
| Ultraviolet Absorbent UV-3 | 0.1 |
| Dispersion Oil OIL-1 | 0.02 |
| Second Layer: Interlayer | |
| Fine Silver Bromide Grains (mean grain size: 0.7 μm) | 0.15 |
| Gelatin | 1.0 |
| Third Layer: First Red-sensitive Emulsion Layer | |
| Silver Iodobromide Emulsion | See Table 8 |
| Gelatin | 0.9 |
| Sensitizing Dye A | $2.0 \times 10^{-4}$ |
| Sensitizing Dye B | $1.0 \times 10^{-4}$ |
| Sensitizing Dye C | $0.3 \times 10^{-4}$ |
| Coupler Cp-c | 0.35 |
| Coupler Cp-b | 0.052 |
| Coupler Cp-d | 0.047 |
| DIR Coupler D-1 | 0.023 |
| DIR Coupler D-2 | 0.035 |
| High Boiling Point Solvent HBS-3 | 0.10 |
| High Boiling Point Solvent HBS-4 | 0.10 |
| Fourth Layer: Interlayer | |
| Gelatin | 0.8 |
| Coupler Cp-c | 0.10 |
| High Boiling Point Solvent HBS-3 | 0.05 |
| Fifth Layer: Second Red-sensitive Emulsion Layer | |
| Silver Iodobromide Emulsion | See Table 8 |
| Gelatin | 1.0 |
| Sensitizing Dye A | $1.5 \times 10^{-4}$ |
| Sensitizing Dye B | $2.0 \times 10^{-4}$ |
| Sensitizing Dye C | $0.5 \times 10^{-4}$ |
| Coupler Cp-a (high reaction speed coupler) | 0.050 |
| Coupler Cp-c | 0.10 |
| Coupler Cp-d | 0.027 |
| DIR Coupler D-1 | 0.005 |
| DIR Coupler D-2 | 0.010 |
| High Boiling Point Solvent HBS-3 | 0.050 |
| High Boiling Point Solvent HBS-4 | 0.060 |
| Sixth Layer: Third Red-sensitive Emulsion Layer | |
| Silver Iodobromide Emulsion | See Table 8 |
| Gelatin | 1.5 |
| Coupler Cp-a | 0.060 |
| Coupler Cp-c | 0.024 |
| Coupler Cp-d | 0.038 |
| DIR Coupler D-1 | 0.006 |
| High Boiling Point Solvent HBS-3 | 0.12 |
| Seventh Layer: Interlayer | |
| Gelatin | 1.0 |
| Cpd-A (color mixing inhibitor) | 0.05 |
| High Boiling Point Solvent HBS-4 | 0.05 |
| Eighth Layer: First Green-sensitive Emulsion Layer | |
| Silver Iodobromide Emulsion | See Table 8 |
| Gelatin | 1.0 |

-continued

| | |
|---|---|
| Sensitizing Dye D | $1 \times 10^{-4}$ |
| Sensitizing Dye E | $4 \times 10^{-4}$ |
| Sensitizing Dye F | $1 \times 10^{-4}$ |
| Coupler Cp-e | 0.26 |
| Coupler Cp-f | 0.61 |
| Coupler Cp-g | 0.084 |
| Coupler Cp-k | 0.035 |
| Coupler Cp-l | 0.036 |
| DIR Coupler D-3 | 0.041 |
| DIR Coupler D-4 | 0.018 |
| High Boiling Point Solvent HBS-3 | 0.25 |
| High Boiling Point Solvent HBS-4 | 0.45 |
| Ninth Layer: Second Green-sensitive Emulsion Layer | |
| Silver Iodobromide Emulsion | See Table 8 |
| Gelatin | 1.5 |
| Sensitizing Dye D | $1.5 \times 10^{-4}$ |
| Sensitizing Dye E | $2.3 \times 10^{-4}$ |
| Sensitizing Dye F | $1.5 \times 10^{-4}$ |
| Coupler Cp-f | 0.007 |
| Coupler Cp-h | 0.012 |
| Coupler Cp-g | 0.009 |
| High Boiling Point Solvent HBS-4 | 0.088 |
| Tenth layer: Interlayer | |
| Gelatin | 1.2 |
| Cpd-A | 0.3 |
| High Boiling Point Solvent HBS-3 | 0.3 |
| Eleventh Layer: First Blue-sensitive Emulsion Layer | |
| Silver Iodobromide Emulsion | See Table 8 |
| Gelatin | 2.0 |
| Sensitizing Dye G | $1 \times 10^{-4}$ |
| Sensitizing Dye H | $1 \times 10^{-4}$ |
| Coupler Cp-i | 0.63 |
| Coupler Cp-j | 0.57 |
| DIR Coupler D-1 | 0.020 |
| DIR Coupler D-4 | 0.015 |
| High Boiling Point Solvent HBS-3 | 0.05 |
| Twelfth Layer: Second Blue-sensitive Emulsion Layer | |
| Silver Iodobromide Emulsion | See Table 8 |
| Gelatin | 0.5 |
| Sensitizing Dye G | $5 \times 10^{-5}$ |
| Sensitizing Dye H | $5 \times 10^{-5}$ |
| Coupler Cp-i | 0.10 |
| Coupler Cp-j | 0.10 |
| DIR Coupler D-4 | 0.005 |
| High Boiling Point Solvent HBS-4 | 0.10 |
| Thirteenth Layer: Interlayer | |
| Gelatin | 0.5 |
| Coupler Cp-m | 0.1 |
| Ultraviolet Absorbent UV-1 | 0.1 |
| Ultraviolet Absorbent UV-2 | 0.1 |
| Ultraviolet Absorbent UV-3 | 0.1 |
| High Boiling Point Solvent HBS-3 | 0.05 |
| High Boiling Point Solvent HBS-4 | 0.05 |
| Fourteenth Layer: Protective Layer | |
| Monodispersed Silver Iodobromide Emulsion (silver iodide: 4 mol %, mean grain size: 0.05 μm, variation coefficient: 10%) | 0.1 |
| Gelatin | 1.5 |
| Polymethyl Methacrylate grains (mean grain size: 1.5 μm) | 0.1 |
| Formalin Scavenger S-3 | 0.2 |
| Formalin Scavenger S-4 | 0.2 |

Surfactant K-1 and Gelatin Harden®r H-2 were added to each layer in addition to the above-mentioned composition.

Sensitizing Dye A:

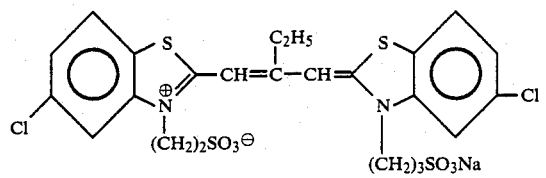

-continued
Sensitizing Dye B: This is the same as Sensitizing Dye II in Example 1.
Sensitizing Dye C: This is the same as Sensitizing Dye III in Example 1.
Sensitizing Dye D:
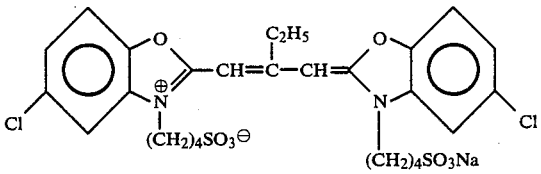
Sensitizing Dye E:
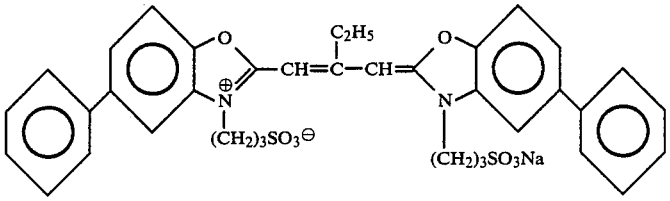
Sensitizing Dye F:
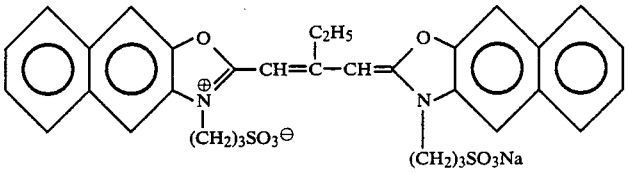
Sensitizing Dye G:
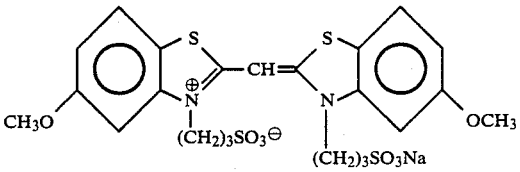
Sensitizing Dye H:
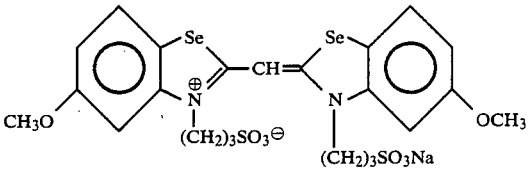
D-1
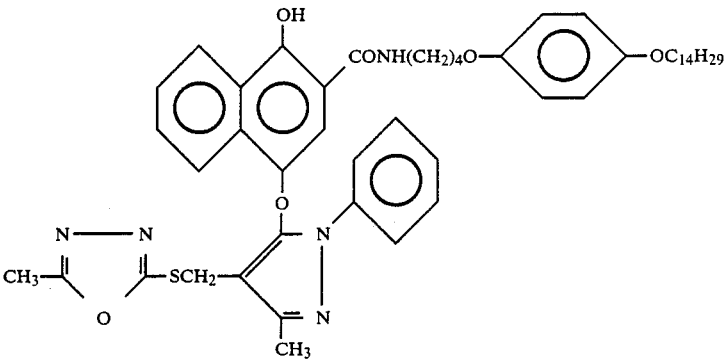

-continued
D-2
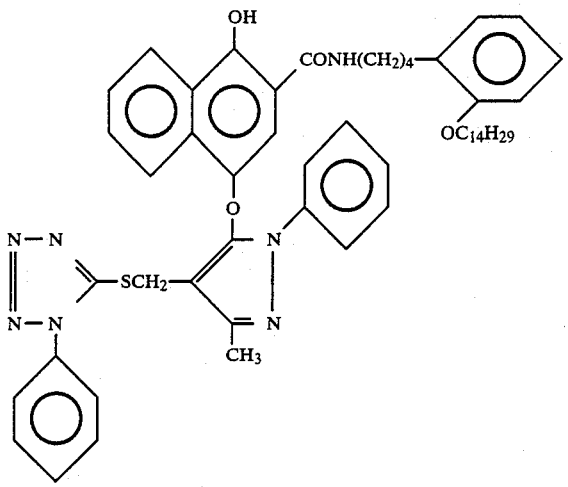
D-3
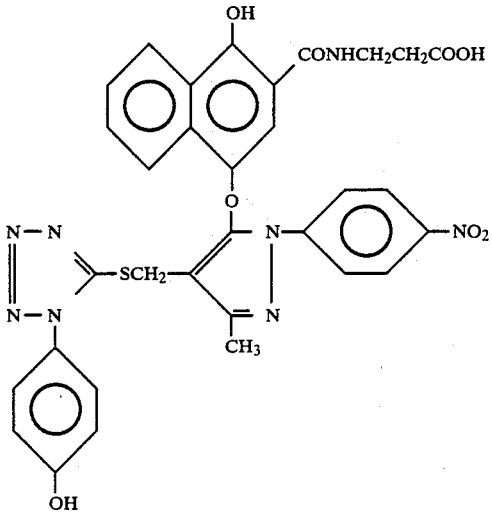
D-4
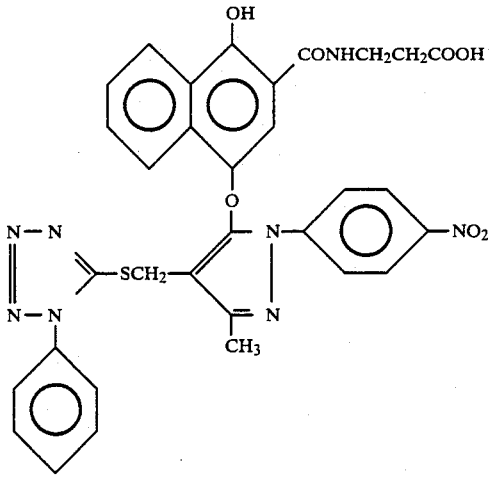

-continued
Cp-a
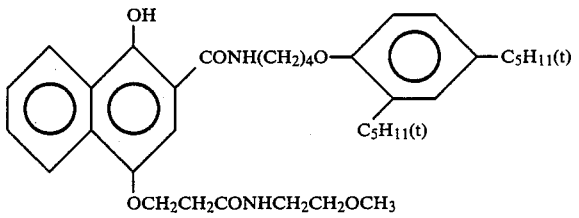
Cp-b
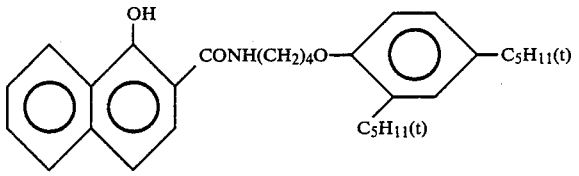
Cp-c
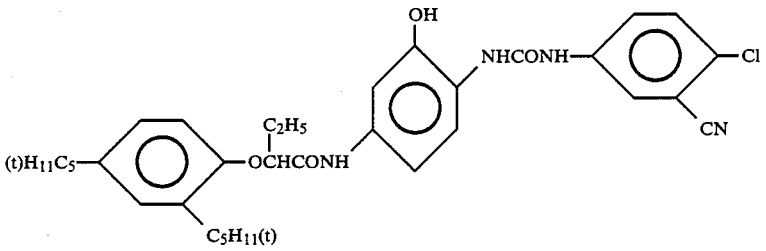
Cp-d
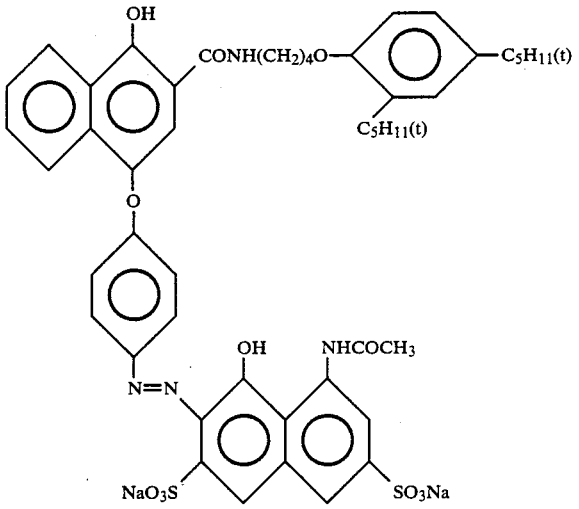
Cp-e
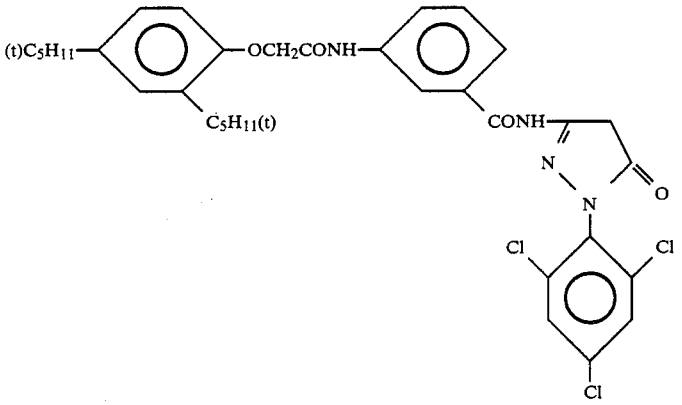

-continued
Cp-f
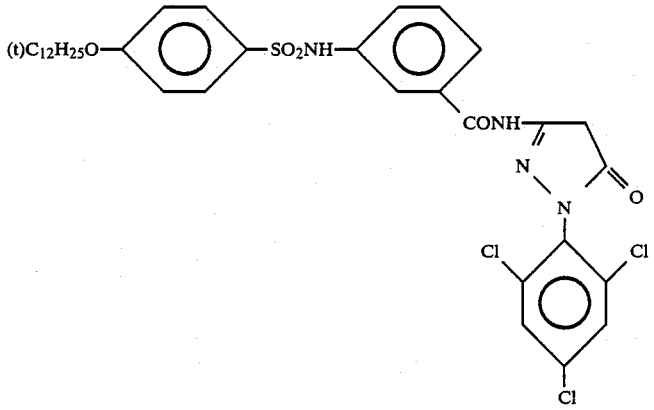
Cp-g
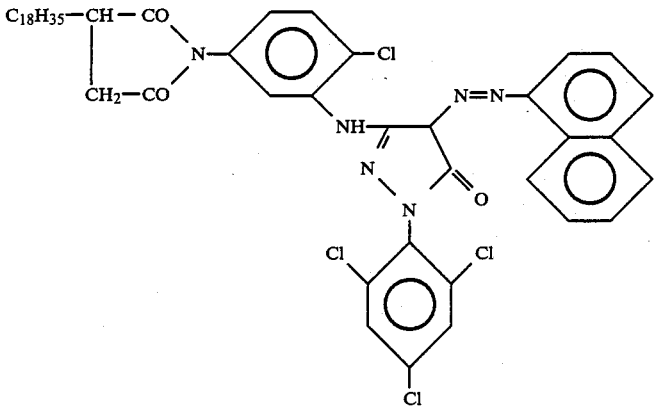
Cp-h
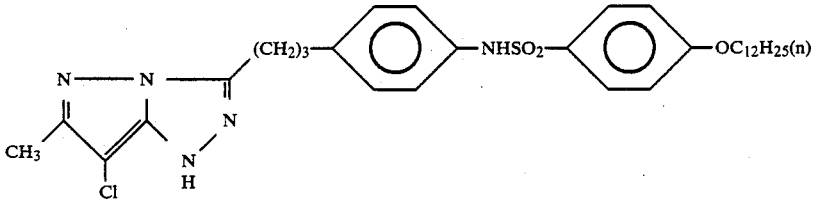
Cp-i
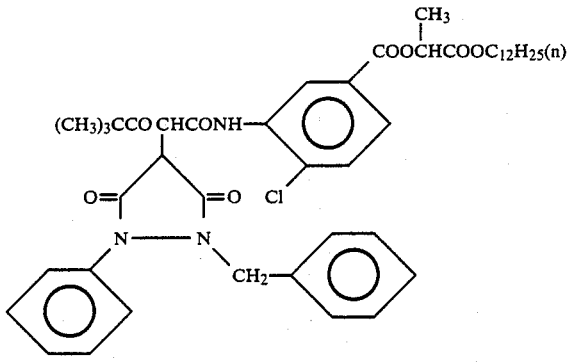

-continued
Cp-j
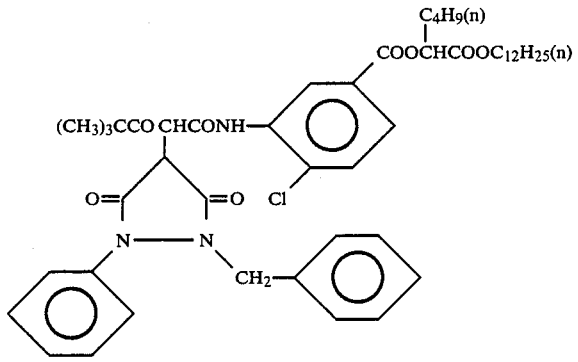
Cp-k
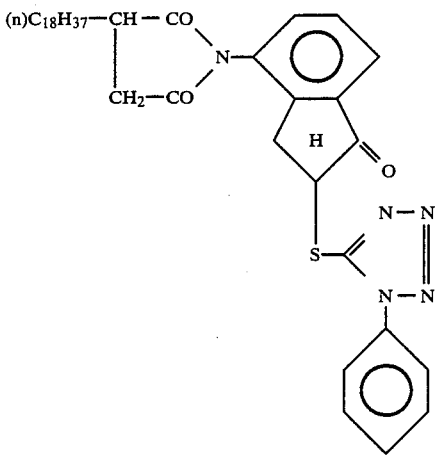
Cp-l
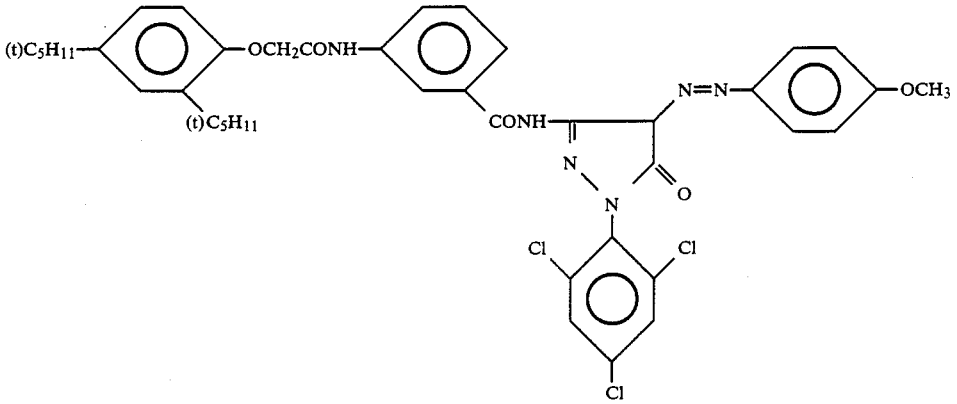
Cp-m
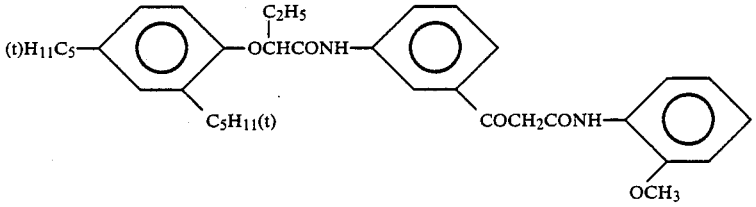
Oil-1
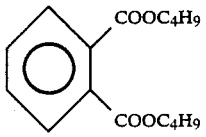

-continued
HBS-3
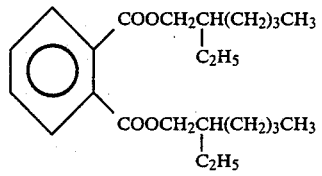
HBS-4
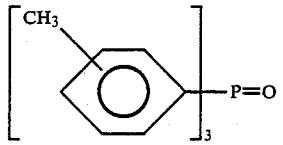
K-1
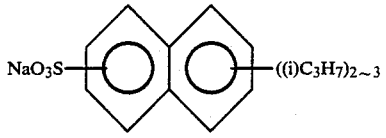
S-3
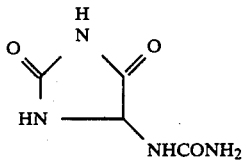
S-4
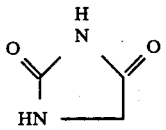
UV-1
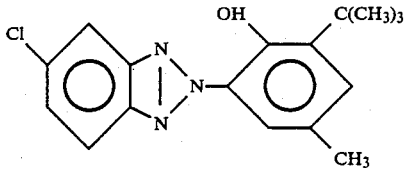
UV-2
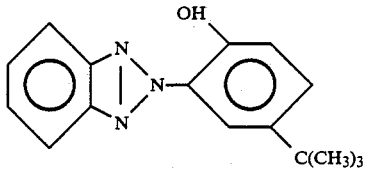
UV-3
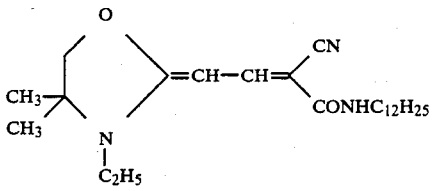
Cpd-A
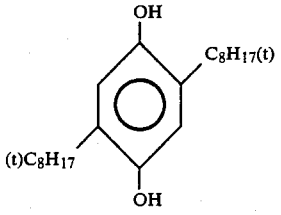

-continued

H-2

$CH_2{=}CH{-}SO_2{-}CH_2$
$\quad\quad\quad

TABLE 9-continued

| | | | Photographic Characteristics of Samples 401 to 406 | | | | | |
|---|---|---|---|---|---|---|---|---|
| | | | Sample 401 (Comparison) | Sample 402 (The Invention) | Sample 403 (The Invention) | Sample 404 (Comparison) | Sample 405 (The Invention) | Sample 406 (The Invention) |
| | | Green | 0.020 | 0.023 | 0.024 | 0.016 | 0.019 | 0.020 |
| | | Red | 0.018 | 0.021 | 0.023 | 0.015 | 0.019 | 0.021 |
| | MTF | Blue | 100 | 105 | 107 | 101 | 107 | 110 |
| | | Green | 100 | 130 | 140 | 105 | 140 | 150 |
| | | Red | 100 | 143 | 155 | 106 | 150 | 163 |
| After storage for 1 year | Specific Photographic Characteristic (S) | | 390 | 380 | 375 | 398 | 397 | 393 |
| | RMS | Blue | 0.044 | 0.047 | 0.049 | 0.042 | 0.042 | 0.043 |
| | | Green | 0.024 | 0.026 | 0.027 | 0.021 | 0.021 | 0.022 |
| | | Red | 0.022 | 0.024 | 0.026 | 0.020 | 0.021 | 0.022 |
| | MTF | Blue | 99 | 104 | 106 | 100 | 106 | 109 |
| | | Green | 98 | 127 | 138 | 103 | 139 | 149 |
| | | Red | 98 | 142 | 153 | 103 | 148 | 161 |

EXAMPLE 8

After Samples 401 to 406 were uniformly exposed by 0.005 lux.sec, the surface of the emulsion layer of each Sample was scratched with a sapphire needle with a top of about 30 μm radius under a load of 4 g at a speed of 5 cm/sec. Afterwards, the Samples thus treated were developed in the same manner as in the case of the measurement of the specific photographic sensitivity. After the development, the density of the scratches made by the needle was measured with a micro-densitometer, and the density difference between the scratched part and the non-scratched part was obtained in every Sample. The results are shown in Table 10 below.

As apparent from the results in Table 10, the pressure fog (sensitivity increase by pressure) is little in Samples 405 and 406 of the present invention, and thus it is noted that the Samples of the present invention have excellent pressure-resistance.

EXAMPLE 9

Samples 401 to 406 were, without being exposed, developed in the same manner as in the case for the measurement of the specific photographic sensitivity, and then the residual silver amount was measured for each Sample. Next, the fixation time was varied to 2 minutes and 10 seconds, and the same measurement was performed. The results are shown in Table 11.

The Samples 401 to 406 were uniformly exposed by 0.5 lux. sec and then developed in the same manner as in the case for the measurement of the specific photographic sensitivity, and then the residual silver amount was measured for each Sample. Next, the bleaching time was varied to 2 minutes and 10 seconds, and the same measurement was performed. The results are shown in Table 12.

From the results of the Tables 11 and 12, it is apparent that Samples 405 and 406 of the present invention are excellent in the fixing and the bleaching processability.

TABLE 10

| | Results of Needle Scratch Test of Samples 401 to 406 | | | | | |
|---|---|---|---|---|---|---|
| Sample No. | 401 (Comparison) | 402 (The Invention) | 403 (The Invention) | 404 (Comparison) | 405 (The Invention) | 406 (The Invention) |
| Density Increment by Needle Scratch | | | | | | |
| Blue | 0.83 | 0.52 | 0.47 | 0.63 | 0.33 | 0.30 |
| Green | 0.52 | 0.38 | 0.32 | 0.43 | 0.27 | 0.23 |
| Red | 0.15 | 0.14 | 0.12 | 0.12 | 0.10 | 0.10 |

TABLE 11

| | Residual Silver Amount (μg/cm²) in Samples 401 to 406 After Development | | | | | |
|---|---|---|---|---|---|---|
| Sample No. | 401 (Comparison) | 402 (The Invention) | 403 (The Invention) | 404 (Comparison) | 405 (The Invention) | 406 (The Invention) |
| Fixation Time | | | | | | |
| 6 min 30 sec | 3.2 | 2.3 | 2.1 | 3.1 | 2.0 | 1.8 |
| 2 min 10 sec | 6.2 | 3.5 | 3.2 | 6.0 | 3.1 | 2.6 |

TABLE 12

| | Residual Silver Amount (μg/cm²) in Samples 401 to 406 After Development | | | | | |
|---|---|---|---|---|---|---|
| Sample No. | 401 (Comparison) | 402 (The Invention) | 403 (The Invention) | 404 (Comparison) | 405 (The Invention) | 406 (The Invention) |
| Bleaching Time | | | | | | |
| 6 min 30 sec | 1.5 | 0.9 | 0.7 | 1.3 | 0.5 | 0.5 |
| 2 min 10 sec | 7.0 | 4.8 | 4.5 | 6.7 | 3.9 | 3.8 |

EXAMPLE 10

Samples 407 to 409 as shown in Table 13 below were prepared by varying the grain size of the grains in the emulsions of the 6th, 9th and 12th layers of Samples 404 to 406, respectively.

The photographic characteristics of Samples 404 to 409 were evaluated in the same manner as that described in Example 7. The results are shown in Table 14 below.

The results in Table 14 reveal that Samples 407, 408 and 409, each containing emulsion grains with a larger mean grain size than 1.4 μm in the blue-sensitive emulsion layer and emulsion grains with a larger mean grain size than 1.1 μm in the green-sensitive emulsion layer and in the red-sensitive emulsion layer are poorer in graininess than Samples 404, 405 and 406 and that the graininess deterioration with time is more remarkable in the former than in the latter.

surement of the X-ray diffraction was performed by the use of a Kβ-ray of copper.

The photographic characteristics of Samples 504 to 506 were measured in the same manner as in Example 7, and the results are shown in Table 15 below. From the results, it is apparent that Samples 504 to 506 containing two-layer structure grains have better graininess than Samples 404 to 406.

In addition, the pressure-resistance of Samples 504 to 506 was also tested in the same manner as in Example 8. The results are shown in Table 16 below. As apparent from Table 16, the monodispersed two-layer structure grains have excellent pressure-resistance, and the low silver Samples 505 and 506 showed especially remarkable pressure-resistance.

TABLE 15

| Photographic Characteristics of Fresh Samples 504 to 506 | | | |
|---|---|---|---|
| Sample No. | 504 | 505 | 506 |
| Specific Photo-graphic Sensitivity | 425 | 415 | 408 |
| RMS Blue | 0.033 | 0.037 | 0.038 |
| Green | 0.014 | 0.015 | 0.016 |

TABLE 13

Emulsions of the Photographic Layers and the Silver Amount Coated in Samples 404 to 409

| | Sample 404 | | | | Sample 405 | | | | Sample 406 | | | |
|---|---|---|---|---|---|---|---|---|---|---|---|---|
| | * [AgI] [mol %] | ** Mean grain Size [μm] | *** Variation Coefficient [%] | Silver Amount Coated [g/m²] | [AgI] [mol %] | Mean grain Size [μm] | Variation Co-efficient [%] | Silver Amount Coated [g/m²] | [AgI] [mol %] | Mean grain Size [μm] | Variation Coefficient [%] | Silver Amount Coated [g/m²] |
| 6th layer | 7 | 1.0 | 13 | 2.08 | 7 | 1.0 | 13 | 1.46 | 7 | 1.0 | 13 | 1.27 |
| 9th layer | 8 | 1.0 | 14 | 2.07 | 8 | 1.0 | 14 | 1.66 | 8 | 1.0 | 14 | 1.30 |
| 12th layer | 10 | 1.3 | 11 | 0.77 | 10 | 1.3 | 11 | 0.70 | 10 | 1.3 | 11 | 0.63 |
| Total | 10.6 g/m² | | | | 7.3 g/m² | | | | 6.5 g/m² | | | |

| | Sample 407 | | | | Sample 408 | | | | Sample 409 | | | |
|---|---|---|---|---|---|---|---|---|---|---|---|---|
| | * [AgI] [mol %] | ** Mean grain Size [μm] | *** Variation Coefficient [%] | Silver Amount Coated [g/m²] | [AgI] [mol %] | Mean grain Size [μm] | Variation Co-efficient [%] | Silver Amount Coated [g/m²] | [AgI] [mol %] | Mean grain Size [μm] | Variation Coefficient [%] | Silver Amount Coated [g/m²] |
| 6th layer | 7 | 1.2 | 14 | 2.08 | 7 | 1.2 | 14 | 1.46 | 7 | 1.2 | 14 | 1.27 |
| 9th layer | 8 | 1.2 | 15 | 2.07 | 8 | 1.2 | 15 | 1.66 | 8 | 1.2 | 15 | 1.30 |
| 12th layer | 10 | 1.5 | 12 | 0.77 | 10 | 1.5 | 12 | 0.70 | 10 | 1.5 | 12 | 0.63 |
| Total | 10.6 g/m² | | | | 7.3 g/m² | | | | 6.5 g/m² | | | |

*(AgI): Mean Silver Iodide Content (mol %)

**Variation Coefficient: $\frac{\text{(Standard Deviation of Grain size)}}{\text{(Mean Grain Size)}} \times 100\ (\%)$

***Mean Grain Size: This means the mean value of the diameters of the corresponding spheres.

TABLE 14

| Photographic Characteristics of Samples 404 to 409 | | | | | | | |
|---|---|---|---|---|---|---|---|
| | | Sample 404 | Sample 405 | Sample 406 | Sample 407 | Sample 408 | Sample 409 |
| Fresh Sample | Specific Photographic Characteristic (S) | 420 | 410 | 403 | 440 | 430 | 422 |
| | RMS | | | | | | |
| | Blue | 0.036 | 0.041 | 0.042 | 0.042 | 0.048 | 0.049 |
| | Green | 0.016 | 0.019 | 0.020 | 0.019 | 0.022 | 0.024 |
| | Red | 0.015 | 0.019 | 0.021 | 0.019 | 0.023 | 0.025 |
| After Storage for 1 year | Specific Photographic Characteristic (S) | 398 | 397 | 393 | 410 | 408 | 405 |
| | RMS | | | | | | |
| | Blue | 0.042 | 0.042 | 0.043 | 0.049 | 0.051 | 0.052 |
| | Green | 0.021 | 0.021 | 0.022 | 0.025 | 0.027 | 0.028 |
| | Red | 0.020 | 0.021 | 0.022 | 0.025 | 0.027 | 0.028 |

EXAMPLE 11

Samples 504, 505 and 506 were prepared by substituting a monodispersed emulsion containing grains with a definite two-layer structure for the emulsion of each of the 6th, 9th and 12th layers of Samples 404 to 406, respectively. The X-ray diffraction profile of the emulsion grains in each layer is shown in the Figure. The mea- TABLE 15-continued

| Photographic Characteristics of Fresh Samples 504 to 506 | | | |
|---|---|---|---|
| Sample No. | 504 | 505 | 506 |
| Red | 0.013 | 0.015 | 0.016 |

TABLE 16

| Results of Needle Scratch Test of Samples 404 to 406 and 504 to 506 | | | | | | |
|---|---|---|---|---|---|---|
| Sample No. | 404 | 405 | 406 | 504 | 505 | 506 |
| Density Increment by Needle Scratch | | | | | | |
| RMS Blue | 0.63 | 0.33 | 0.30 | 0.61 | 0.25 | 0.23 |
| Green | 0.43 | 0.27 | 0.23 | 0.40 | 0.22 | 0.20 |
| Red | 0.12 | 0.10 | 0.10 | 0.10 | 0.07 | 0.06 |

EXAMPLE 12

Samples 405 and 406 of the present invention, as obtained in Example 7, were processed in the same manner as in Example 5, using the same automatic developing machine.

Even after thus being processed, the results of Samples 405 and 406 of the present invention were good as in the case of Example 7.

EXAMPLE 13

Samples 405 and 406 of the present invention, as obtained in Example 7, were exposed and then processed in the same manner as in Example 6, using the same automatic developing machine.

Even after thus being processed, the results of Samples 405 and 406 of the present invention were good as in the case of the Example 7.

EXAMPLE 14

Samples 405 and 406 of the present invention were exposed and then processed with an automatic developing machine, in accordance with the following steps, until the total replenisher amount of the developer reached three times the amount of the original developer in the tank.

| | Processing Steps | | | |
|---|---|---|---|---|
| Step | Processing Time | Processing Temperature | Amount of Replenisher(*) | Tank Capacity |
| Color Development | 3 min 15 sec | 37.8° C. | 50 ml | 10 liter |
| Bleaching | 6 min 30 sec | 37.8° C. | 10 ml | 20 liter |
| Fixation | 3 min 15 sec | 37.8° C. | 30 ml | 10 liter |
| Rinsing (1) | 1 min 00 sec | 35.0° C. | Countercurrent System from (2) to (1) | 4 liter |
| Rinsing (2) | 1 min 40 sec | 35.0° C. | 30 ml | 4 liter |
| Stabilization | 1 min 20 sec | 37.8° C. | 30 ml | 4 liter |
| Drying | 1 min 30 sec | 52.0° C. | | |

(*) The amount is per unit area of 35 mm width and 1 m length of the sample being processed.

The compositions of the following solutions used are described below.

| Color Developer: | Original (g) | Replenisher (g) |
|---|---|---|
| Diethylenetriamine-Pentaacetic Acid | 5.0 | 6.0 |
| Sodium Sulfite | 4.0 | 4.4 |
| Potassium Carbonate | 30.0 | 37.0 |
| Potassium Bromide | 1.3 | 0.9 |
| Potassium Iodide | 1.2 mg | — |
| Hydroxylamine Sulfate | 2.0 | 2.8 |
| 4-[N-ethyl-N-(β-hydroxyethyl)-amino]-2-methylaniline Sulfate | 4.7 | 5.3 |
| Water to make | 1.0 liter | 1.0 liter |
| pH | 10.00 | 10.05 |

| Bleaching Solution: | Original (g) | Replenisher (g) |
|---|---|---|
| Ammonium Ferric Ethylenediamine-tetraacetate Dihydrate | 100.0 | 120.0 |
| Disodium Ethylenediamine-tetraacetate Dihydrate | 10.0 | 12.0 |
| Ammonium Bromide | 160.0 | 180.0 |
| Ammonium Nitrate | 30.0 | 50.0 |
| Aqueous Ammonia (27 wt. %) | 7.0 ml | 5.0 ml |
| Water to make | 1.0 liter | 1.0 liter |
| pH | 6.0 | 5.7 |

| Fixing Solution: | Original (g) | Replenisher (g) |
|---|---|---|
| Disodium Ethylenediamine-tetraacetate | 0.5 | 0.7 |
| Sodium Sulfite | 7.0 | 8.0 |
| Sodium Bisulfite | 5.0 | 5.5 |
| Ammonium Thiosulfate Aqueous Solution (70 wt. %) | 170.0 ml | 200.0 ml |
| Water to make | 1.0 liter | 1.0 liter |
| pH | 6.7 | 6.6 |

| Rinsing Solution: | Original and replenisher were the same. |
|---|---|
| 5-Chloro-2-methyl-4-isothiazolin-3-one | 6.0 mg |
| 2-Methyl-4-isothiazolin-3-one | 3.0 mg |
| Ethylene Glycol | 1.5 ml |
| Water to make | 1.0 liter |
| pH | 5.0 to 7.0 |

| Stabilizer Solution: | Original and replenisher were the same. |
|---|---|
| Aqueous Solution of Formaldehyde (37 wt. %) | 3.0 ml |
| Ethylene Glycol | 2.0 g |
| Surfactant (*) | 0.4 g |
| Water to make | 1.0 liter |
| pH | 5.0 to 8.0 |

(*)

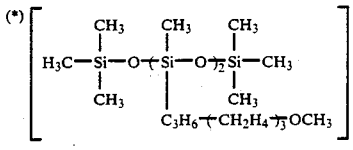

Even after being processed by the above-mentioned procedure, the results of Samples 405 and 406 of the present invention were good as in the case of Example 7.

EXAMPLE 15

A multilayer color photographic paper (Sample 601) was prepared by multi coating the layers having the compositions shown below on a cellulose triacetate film support having a subbing layer.

Compositions of the Photographic Layers

The amount of each component coated is represented by the unit of g/m$^2$, and the amount of silver halide coated is represented by the amount of silver in the halide coated. The amount of each sensitizing dye coated is represented by the unit of the respective molar amount coated per mol of silver halide in the same layer.

First Layer: Anti-halation Layer

-continued

| | |
|---|---|
| Black colloidal Silver | 0.2 |
| Gelatin | 1.0 |
| Ultraviolet Absorbent UV-1 | 0.05 |
| Ultraviolet Absorbent UV-2 | 0.1 |
| Ultraviolet Absorbent UV-3 | 0.1 |
| Dispersion Oil OIL-1 | 0.02 |
| Second Layer: Interlayer | |
| Fine Silver Bromide Grains (mean grain size: 0.07 μm) | 0.15 |
| Gelatin | 1.0 |
| Third Layer: First Red-sensitive Emulsion Layer | |
| Monodispersed Silver Iodobromide Emulsion (silver iodide 2 mol %, mean grain size: 0.4 μm, variation coefficient with respect to grain size (hereinafter refer to as "variation coefficient"): 19%) | 1.42 |
| Gelatin | 0.9 |
| Sensitizing Dye A | $2.0 \times 10^{-4}$ |
| Sensitizing Dye B | $1.0 \times 10^{-4}$ |
| Sensitizing Dye C | $0.3 \times 10^{-4}$ |
| Coupler Cp-c | 0.35 |
| Coupler Cp-b | 0.052 |
| Coupler Cp-d | 0.047 |
| DIR Coupler D-1 | 0.023 |
| DIR Coupler D-2 | 0.035 |
| High Boiling Point Solvent HBS-3 | 0.10 |
| High Boiling Point Solvent HBS-4 | 0.10 |
| Fourth Layer: Interlayer | |
| Gelatin | 0.8 |
| Coupler Cp-c | 0.10 |
| High Boiling Point Solvent HBS-3 | 0.05 |
| Fifth Layer: Second Red-sensitive Emulsion Layer | |
| Monodispersed Silver Iodobromide Emulsion (silver iodide: 5 mol %, mean grain size: 0.7 μm, variation coefficient : 18%) | 1.38 |
| Gelatin | 1.0 |
| Sensitizing Dye A | $1.5 \times 10^{-4}$ |
| Sensitizing Dye B | $2.0 \times 10^{-4}$ |
| Sensitizing Dye C | $0.5 \times 10^{-4}$ |
| Coupler Cp-a | 0.050 |
| Coupler Cp-c | 0.10 |
| Coupler Cp-d | 0.027 |
| DIR Coupler D-1 | 0.005 |
| DIR Coupler D-2 | 0.010 |
| High Boiling Point Solvent HBS-3 | 0.050 |
| High Boiling Point Solvent HBS-4 | 0.060 |
| Sixth Layer: Third Red-sensitive Emulsion Layer | |
| Monodispersed Silver Iodobromide Emulsion (silver iodide: 7 mol %, mean grain size: 1.0 μm, variation coefficient : 18%) | 2.08 |
| Gelatin | 1.5 |
| Coupler Cp-a | 0.060 |
| Coupler Cp-c | 0.024 |
| Coupler Cp-d | 0.038 |
| DIR Coupler D-1 | 0.006 |
| High Boiling Point Solvent HBS-3 | 0.12 |
| Seventh Layer: Interlayer | |
| Gelatin | 1.0 |
| Cpd-A | 0.05 |
| High Boiling Point Solvent HBS-4 | 0.05 |
| Eighth Layer: First Green-sensitive Emulsion Layer | |
| Monodispersed Silver Iodobromide Emulsion (A) (silver iodide: 3 mol %, mean grain size: 0.4 μm, variation coefficient: 19%) | 0.64 |
| Monodispersed Silver Iodobromide Emulsion (B) (silver iodide: 6 mol %, mean grain size: 0.7 μm, variation coefficient: 18%) | 1.12 |
| Gelatin | 1.0 |
| Sensitizing Dye D | $1 \times 10^{-4}$ |
| Sensitizing Dye E | $4 \times 10^{-4}$ |
| Sensitizing Dye F | $1 \times 10^{-4}$ |
| Coupler Cp-e | 0.26 |
| Coupler Cp-f | 0.61 |
| Coupler Cp-g | 0.084 |

-continued

| | |
|---|---|
| Coupler Cp-k | 0.035 |
| Coupler Cp-l | 0.036 |
| DIR Coupler D-3 | 0.041 |
| DIR Coupler D-4 | 0.018 |
| High Boiling Point Solvent HBS-3 | 0.25 |
| High Boiling Point Solvent HBS-4 | 0.45 |
| Ninth Layer: Second Green-sensitive Emulsion Layer | |
| Monodispersed Silver Iodobromide Emulsion (silver iodide: 7 mol %, mean grain size: 1.0 μm, variation coefficient: 18%) | 2.07 |
| Gelatin | 1.5 |
| Sensitizing Dye D | $1.5 \times 10^{-4}$ |
| Sensitizing Dye E | $2.3 \times 10^{-4}$ |
| Sensitizing Dye F | $1.5 \times 10^{-4}$ |
| Coupler Cp-f | 0.007 |
| Coupler Cp-h | 0.012 |
| Coupler Cp-g | 0.009 |
| High Boiling Point Solvent HBS-4 | 0.088 |
| Tenth Layer: Interlayer | |
| Gelatin | 1.2 |
| Cpd-A | 0.3 |
| High Boiling Point Solvent HBS-3 | 0.3 |
| Eleventh Layer: First Blue-sensitive Emulsion Layer | |
| Monodispersed Silver Iodobromide Emulsion (C) (silver iodide: 6 mol %, mean grain size: 0.4 μm, variation coefficient: 20%) | 0.31 |
| Monodispersed Silver Iodobromide Emulsion (D) (silver iodide: 5 mol %, mean grain size: 0.9 μm, variation coefficient: 17%) | 0.38 |
| Gelatin | 2.0 |
| Sensitizing Dye G | $1 \times 10^{-4}$ |
| Sensitizing Dye H | $1 \times 10^{-4}$ |
| Coupler Cp-i | 0.63 |
| Coupler Cp-j | 0.57 |
| DIR Coupler D-1 | 0.020 |
| DIR Coupler D-4 | 0.015 |
| High Boiling Point Solvent HBS-3 | 0.05 |
| Twelfth Layer: Second Blue-sensitive Emulsion Layer | |
| Monodispersed Silver Iodobromide Emulsion (silver iodide: 8 mol %, mean grain size: 1.3 μm, variation coefficient: 18%) | 0.77 |
| Gelatin | 0.5 |
| Sensitizing Dye G | $5 \times 10^{-5}$ |
| Sensitizing Dye H | $5 \times 10^{-5}$ |
| Coupler Cp-i | 0.10 |
| Coupler Cp-j | 0.10 |
| DIR Coupler D-4 | 0.005 |
| High Boiling Point Solvent HBS-4 | 0.10 |
| Thirteenth Layer: Interlayer | |
| Gelatin | 0.5 |
| Coupler Cp-m | 0.1 |
| Ultraviolet Absorbent UV-1 | 0.1 |
| Ultraviolet Absorbent UV-2 | 0.1 |
| Ultraviolet Absorbent UV-3 | 0.1 |
| High Boiling Point Solvent HBS-3 | 0.05 |
| High Boiling Point Solvent HBS-4 | 0.05 |
| Fourteenth Layer: Protective Layer | |
| Monodispersed Silver Iodobromide Emulsion (silver iodide: 4 mol %, mean grain size: 0.05 μm, variation coefficient: 10%) | 0.1 |
| Gelatin | 1.5 |
| Polymethyl Methacrylate Grains (mean grain size: 1.5 μm) | 0.1 |
| Formalin Scavenger S-3 | 0.2 |
| Formalin Scavenger S-4 | 0.2 |

Surfactant K-1 and Gelatin Hardener H-2 were added to each layer in addition to the above-mentioned composition.

The Sensitizing Dyes A to H, Compounds D-1 to D-4, Compounds Cp-a to Cp-m, OIL-1, HBS-3, HBS-4, Surfactants K-1, S-3, S-4, UV-1 to UV 3, compound Cpd-A and Hardener H-2 are the same as those in Example 7.

Samples 602 and 603 were prepared by varying the amount of the emulsion of each layer in Sample 601, the amount of silver coated in each layer being shown in Table 17 below. In addition, Samples 604, 605 and 606 were prepared in the same manner as Samples 601, 602 and 603, respectively, except the following variations.

(i) D-1 and D-2 in the 3rd layer were changed to 0.04 g of D-5.

(ii) D-1 and D-2 in the 5th layer were changed to 0.01 g of D-5.

(iii) D-3 and D-4 in the 8th layer were changed to 0.04 g of D-5.

(iv) D-1 and D-4 in the 11th layer were changed to 0.03 g of D-5.

the same manner and the sharpness of the thus processed samples was measured by a conventional MTF (modulation transfer function) method. The sharpness was represented by a relative value on the basis of the MTF value (100) of fresh Sample 601.

The results obtained are shown in Table 18 below.

TABLE 17

Silver Amount (g/m$^2$) in Each Layer Coated in Samples 601 to 603

| | Sample No. | | |
|---|---|---|---|
| | 601 | 602 | 603 |
| 1st layer | 0.20 | 0.20 | 0.20 |
| 2nd layer | 0.15 | 0.15 | 0.15 |
| 3rd layer | 1.42 | 0.50 | 0.50 |
| 4th layer | — | — | — |
| 5th layer | 1.38 | 0.92 | 0.86 |
| 6th layer | 2.08 | 1.46 | 1.27 |
| 7th layer | — | — | — |
| 8th layer, emulation (A) | 0.64 | 0.31 | 0.31 |
| 8th layer, emulation (B) | 1.12 | 0.72 | 0.60 |
| 9th layer | 2.07 | 1.66 | 1.30 |
| 10th layer | — | — | — |
| 11th layer, emulation (C) | 0.31 | 0.22 | 0.22 |
| 11th layer, emulation (D) | 0.38 | 0.36 | 0.34 |
| 12th layer | 0.77 | 0.70 | 0.63 |
| 13th layer | — | — | — |
| 14th layer | 0.10 | 0.10 | 0.10 |
| Total | 10.62 | 7.30 | 6.48 |

D-5

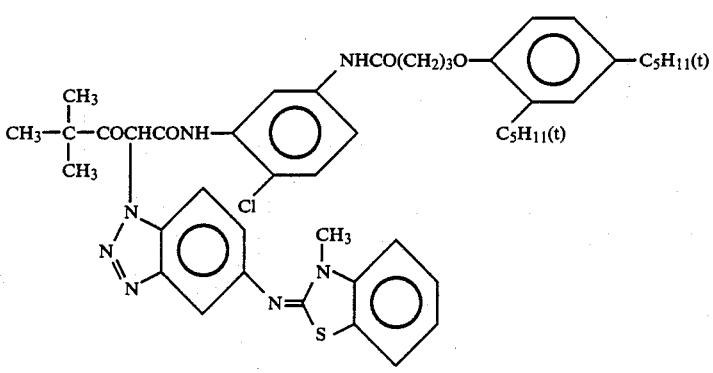

Each of the samples thus prepared were, immediately after preparation or after storage for one year at room temperature in the Ashigara Laboratory of Fuji Photo Film Co. (Minimiashigara, Kanagawa, Japan), exposed and developed in the same manner as in the case of the measurement of the above-mentioned specific photographic sensitivity and thus the photographic characteristics of the respective samples were measured. Regarding the graininess, the samples were exposed by 0.005 lux. sec and then processed in the same manner as in the case of the measurement of the specific photographic sensitivity, and the graininess of the thus processed samples was measured by a conventional RMS (root mean square) method using a 48 $\mu m\phi$ aperture. Regarding the sharpness, the samples were also processed in

TABLE 18

Photographic Characteristics of Samples 601 to 606

| | | | Sample 601 (Comparison) | Sample 602 (The Invention) | Sample 603 (The Invention) | Sample 604 (Comparison) | Sample 605 (The Invention) | Sample 606 (The Invention) |
|---|---|---|---|---|---|---|---|---|
| Fresh Sample | Specific Photographic Characteristic (S) | | 420 | 410 | 403 | 422 | 405 | 401 |
| | RMS | Blue | 0.036 | 0.041 | 0.042 | 0.034 | 0.039 | 0.040 |
| | | Green | 0.016 | 0.019 | 0.020 | 0.015 | 0.018 | 0.019 |
| | | Red | 0.015 | 0.019 | 0.021 | 0.014 | 0.018 | 0.020 |
| | MTF | Blue | 100 | 110 | 114 | 90 | 100 | 103 |
| | | Green | 100 | 150 | 160 | 83 | 115 | 123 |
| | | Red | 100 | 161 | 168 | 81 | 121 | 129 |
| After Storage for 1 year | Specific Photographic Characteristic (S) | | 398 | 397 | 393 | 401 | 395 | 391 |
| | RMS | Blue | 0.042 | 0.042 | 0.043 | 0.040 | 0.040 | 0.041 |
| | | Green | 0.021 | 0.022 | 0.022 | 0.020 | 0.021 | 0.021 |
| | | Red | 0.020 | 0.021 | 0.022 | 0.019 | 0.070 | 0.021 |
| | MTF | Blue | 99 | 108 | 112 | 89 | 98 | 101 |
| | | Green | 98 | 147 | 157 | 81 | 112 | 120 |
| | | Red | 98 | 159 | 164 | 80 | 116 | 125 |

An apparent from Table 18, the graininess deterioration with time was smaller in Samples 602, 603, 605 and 606, where the amount of silver coated was less than 8 g/m$^2$, than in Samples 601 and 604 where the amount of silver coated was more than 8 g/m$^2$, and in addition the sharpness of the former Samples with less silver content was higher than the latter Samples.

In particular, Samples 602 and 603 of the present invention, where a timing type DIR coupler was used, had an especially high sharpness. Accordingly, it is apparent that Samples 602 and 603 of the present invention have an excellent all-round image quality, including graininess and sharpness, after storage for one year, i.e., within the time when most users would actually use photographic papers.

EXAMPLE 16

After Samples 601 to 606 were uniformly exposed by 0.005 lux. sec, the surface of the emulsion layer of each Sample was scratched with a sapphire needle with a top of about 30 μm radius under a load of 4 g at a speed of 5 cm/sec. Afterwards, the Samples thus treated were developed in the same manner as in the case of the measurement of the specific photographic sensitivity. After the development, the density of the scratches made by the needle was measured with a micro-densitometer, and the density difference between the scratched part and the non-scratched part was obtained in every Sample. The results are shown in Table 19 below.

An apparent from the results of Table 19 below, the pressure fog (sensitivity increase by pressure) is little in Samples 602 and 603 of the present invention, and thus it is noted that the Samples of the present invention have excellent pressure-resistance.

TABLE 19

Results of Needle Scratch Test of Samples 601 to 606

| Sample No. | 601 (Comparison) | 602 (The Invention) | 603 (The Invention) | 604 (Comparison) | 605 (The Invention) | 606 (The Invention) |
|---|---|---|---|---|---|---|
| Density Increment by Needle Scratch | | | | | | |
| Blue | 0.59 | 0.20 | 0.17 | 0.65 | 0.35 | 0.32 |
| Green | 0.41 | 0.18 | 0.15 | 0.45 | 0.29 | 0.25 |
| Red | 0.10 | 0.06 | 0.05 | 0.14 | 0.14 | 0.12 |

EXAMPLE 17

Using Samples 601, 602, 604 and 605 obtained in Example 15, a person with Macbeth Chart was photographed.

The time of the photographing was a slightly cloudy day in mid-September, about two in the afternoon, and the place of photographing was outdoors near the Ashigara Factory of Fuji Photo Film Co. The camera used for photographing was Minolta's α-7000 with a 70 mm lens, F-value 3.5, and the distance from the subject was about 3 m. The ISO was 400.

After photographing, each Sample was developed in the same manner as in Example 15 and then printed on Fuji Color High-Tech Paper Type 12.

The Print 602P, obtained by photograph-taking on Sample 602 of the present invention, was sharper in terms of color-reproduction than Prints 601P, 604P and 605P obtained from Comparative Samples 601, 604 and 605, respectively. In order to quantitatively show this result, the reflection density of each of the blue, green and red patches in the Macbeth Chart in Prints 601P, 602P, 604P and 605P was measured with a Macbeth Densitometer. The results are shown in Table 20 below. Next, the density difference between the respective colors was calculated from the results in Table 20, and the values calculated are shown in Table 21 below.

As apparent from the results in Table 21, the color chroma in Sample Print 602P of the present invention is high.

TABLE 20

Reflection Density in Prints 601P, 602P, 604P and 605P

| | Sample No. | | | | | | | | | | | |
|---|---|---|---|---|---|---|---|---|---|---|---|---|
| | 601P | | | 602P | | | 603P | | | 604P | | |
| Part in Object | Blue Patch | Green Patch | Red Patch | Blue Patch | Green Patch | Red Patch | Blue Patch | Green Patch | Red Patch | Blue Patch | Green Patch | Red Patch |
| Cyan Density D (C) | 1.83 | 1.30 | 0.29 | 1.88 | 1.36 | 0.28 | 1.78 | 1.20 | 0.27 | 1.83 | 1.22 | 0.25 |
| Magenta Density D (M) | 1.21 | 0.72 | 1.73 | 1.34 | 0.70 | 1.76 | 1.18 | 0.76 | 1.50 | 1.29 | 0.74 | 1.52 |
| Yellow Density D (Y) | 0.59 | 1.31 | 1.53 | 0.64 | 1.34 | 1.58 | 0.06 | 1.23 | 1.45 | 0.68 | 1.25 | 1.47 |

TABLE 21

| Part in Object | Color Density Difference | 601P | 602P | 604P | 605P |
|---|---|---|---|---|---|
| Blue Patch | D (C)-D (Y) | 1.24 | 1.24 | 1.18 | 1.15 |
| | D (M)-D (Y) | 0.62 | 0.70 | 0.58 | 0.61 |
| Green Patch | D (C)-D (M) | 0.58 | 0.66 | 0.44 | 0.48 |
| | D (Y)-D (M) | 0.59 | 0.64 | 0.47 | 0.51 |
| Red Patch | D (M)-D (C) | 1.44 | 1.48 | 1.28 | 1.27 |
| | D (Y)-D (C) | 1.24 | 1.30 | 1.18 | 1.22 |

EXAMPLE 18

In the same manner as in the preparation of Samples 601 and 602, Samples 701 and 702 were prepared, respectively, except with the following modifications.

(i) The emulsion of the 6th layer was changed to a monodispersed silver iodobromide emulsion with a silver iodide content of 7 mol %, a mean grain size of 1.0 μm and a variation coefficient of 14 %.

(ii) The emulsion of the 9th layer was changed to a monodispersed silver iodobromide emulsion with a silver iodide content of 7 mol %, a mean grain size of 1.0 μm and a variation coefficient of 14%.

(iii) The emulsion of the 12th layer was changed to a monodispersed silver iodobromide emulsion with a silver iodide content of 8 mol %, a mean grain size of 1.3 μm and a variation coefficient of 12%.

Samples 601, 602, 701 and 702 were processed in the same manner as in Example 15, and the photographic characteristics of each Sample were evaluated. The results are shown in Table 22 below.

As apparent from the results in Table 22, graininess can be improved and the graininess deterioration with time can be suppressed by controlling the grain size distribution in each emulsion so as to have a variation coefficient of 16% or less. Accordingly, under such a controlled situation, the effect of the present invention is remarkable.

TABLE 22

The Photographic Characteristics of Samples 601, 602, 701 and 702

| | | | Sample 601 (Comparison) | Sample 602 (The Invention) | Sample 701 (Comparison) | Sample 702 (The Invention) |
|---|---|---|---|---|---|---|
| Fresh Sample | Specific Photographic Characteristic (S) | | 420 | 410 | 420 | 410 |
| | RMS | Blue | 0.036 | 0.041 | 0.034 | 0.038 |
| | | Green | 0.016 | 0.019 | 0.015 | 0.018 |
| | | Red | 0.015 | 0.019 | 0.014 | 0.018 |
| | MTF | Blue | 100 | 110 | 103 | 115 |
| | | Green | 100 | 150 | 102 | 156 |
| | | Red | 100 | 161 | 102 | 162 |
| After Storage for 1 year | Specific Photographic Characteristic (S) | | 398 | 397 | 398 | 397 |
| | RMS | Blue | 0.042 | 0.042 | 0.040 | 0.039 |
| | | Green | 0.021 | 0.022 | 0.020 | 0.020 |
| | | Red | 0.020 | 0.021 | 0.019 | 0.019 |
| | MTF | Blue | 99 | 108 | 100 | 113 |
| | | Green | 98 | 147 | 99 | 154 |
| | | Red | 98 | 159 | 100 | 160 |

EXAMPLE 19

Samples 602 and 603 of the present invention, as obtained in Example 15, were exposed and then processed in the same manner as in Example 5, using the same automatic developing machine.

Even after thus being processed, the results of the Samples 602 and 603 of the present invention were good as in the case of Example 15.

EXAMPLE 20

Samples 602 and 603 of the present invention, as obtained in Example 15, were exposed and then processed in the same manner as in Example 6, using the same automatic developing machine.

Even after thus being processed, the results of the Samples 602 and 603 of the present invention were good as in the case of Example 15.

EXAMPLE 21

Samples 601 to 603 obtained in Example 15 were exposed and then processed in the same manner as in Example 14, using the same automatic developing machine.

Even after thus being processed, the results of Samples 602 and 603 of the present invention were good as in the case of Example 15.

EXAMPLE 22

Three compact cameras, Cardia DL-200 (by Fuji Photo Film Co.), which is provided with a full automatic operative and automatic focusing mechanism, were used for photograph-taking, whereupon the objects were freely selected. A roll of film of 24 exposures, Fuji's color negative film Super HR-100, −200 or −400 was employed in each of the three cameras. In order to reduce the difference in the three cameras as much as possible, the kind of film employed in each camera was exchanged to one another after every completion of the 24 exposures in one roll, so that in total, 144 shots were taken by one camera. After being exposed, the roll films were developed under normal development conditions in the Fuji Color Development Laboratory (Kanagawa, Japan) and then printed on Fuji Color High-tech Paper (EC size). The prints were examined by Fuji's print experts, and the proportion of fuzzy pictures (due to out-of-focusing upon shooting) was counted. In this examination, apparent miss-shooting, for example, such as in the case where the main object was not in the center part of the shot and where the pre-focus lock was not performed, if any, was excluded. The results are shown in Table 23 below.

TABLE 23

| Film used | Super HR-100 | Super HR-200 | Super HR-400 |
|---|---|---|---|
| Out-of-focus proportion | 8% | 6% | 2% |

The Table 23 proves that when the Super HR-400 film, with an ISO 400 was used for photograph-taking, the out-of-focus proportion is almost negligible. This is because the aperture would be stopped down enough with an in elevation of the film speed so as to increase the in focus probability. From this result, it is noted that photographic films having a higher sensitivity than ISO 400 are desired so as to increase the in-focus probability in shooting with compact camera having an automatic focusing mechanism.

EXAMPLE 23

Samples 801 to 803 (color negative photographic papers each having a specific photographic sensitivity as shown below) were prepared. Other characteristics than the specific photographic sensitivity were made almost the same as much as possible in the three Samples.

| Sample No. | 801 | 802 | 803 |
|---|---|---|---|
| Specific Photographic Sensitivity (S) | 403 | 330 | 270 |

Each of these Samples was employed in Minolta's single lens reflex camera α-7000 and used for shooting the Milky Way in Miyako-jima (Okinawa, Japan) on a fine summer night. A standard 50 mm lens was used, and the shutter was opened for 30 seconds with an aperture release. After being developed, the Milky Way was not on the photograph from Sample 803, while the Milky Way was somewhat on the photograph from Sample 802 and was extremely clearly on the photograph from Sample 801.

From these results, it is also noted that the specific photographic sensitivity is preferably 320 or more, and is more desirably 350 or more.

In the same manner as in Example 22, a compact camera Cardia DL-200 was used and Samples 801 to 803 were exposed for objects under the sensitivity (film speed) control of ISO 400, whereupon the objects were freely selected. A total of 144 shots were photographed. After being developed and printed in the same manner as in Example 22, the failure proportion due to under exposure was counted. The results are shown in Table 24.

TABLE 24

| Sample No. | 801 | 802 | 803 |
|---|---|---|---|
| Failure due to Under-exposure | 3% | 5% | 20% |

From the results in Table 24, it is apparent that the specific photographic sensitivity is required to be 20 or more, preferably 400 or more, so as to reduce the under-exposure failure.

As explained in detail above the color negative photographic films of the present invention which are characterized by a combined total of silver contents of from 3.0 g/m$^2$ to 8.0 g/m$^2$ and a specific photographic sensitivity of from 320 to less than 800 have improved sharpness and color reproducibility and in addition, these films have extremely excellent storage stability against variation over the course of time caused by natural radiation.

According to the present invention, therefore, high sensitivity color negative photographic light-sensitive materials can be obtained, which are almost free from the graininess deterioration over the course of time and which have improved sharpness and color-reproductivity and excellent pressure-resistance.

In view of the stability of the photographic materials of the present invention against long term storage under influence of natural radiation, as supported by the above-mentioned experimental data, it is understood that the color negative films of the present invention are not influenced by X-ray checks in airports, etc. without any special countermeasure thereagainst.

While the invention has been described in detail and with reference to specific embodiments thereof, it will be apparent to one skilled in the art that various changes and modifications can be made therein without departing from the spirit and scope thereof.

What is claimed is:

1. A silver halide color negative photographic material having at least one blue-sensitive silver halide emulsion layer, at least two green-sensitive silver halide emulsion layers and at least one red-sensitive silver halide emulsion layer on a support, wherein the highest sensitivity layer among the green-sensitive emulsion layers contains a 2-equivalent high-speed coupler, wherein the combined total of silver contents in the material is from 3.0 g/m$^2$ to 8.0 g/m$^2$ and the specific photographic sensitivity of the material is from 320 to less than 800, and wherein at least one layer selected from at least one emulsion layer among the blue-sensitive emulsion layer, the green-sensitive emulsion layers and the red-sensitive emulsion layer and an adjacent layer contain a DIR compound represented by the following formula (IV).

$$A-X-(L^1)_l-\underset{R^{22}}{\overset{R^{21}}{C}}-W \qquad \text{(IV)}$$

in which A represents a coupler component capable of releasing X and the following group by a coupling reaction with the oxidation product of an aromatic primary amine developing agent;

X represents an oxygen atom, a sulfur atom or a substituted imino group;

$L^1$ represents a substituted or unsubstituted ethylene group; l represents an integer of 1 or 2;

$R^{21}$ and $R^{22}$ each represent a hydrogen atom, an alkyl group or an aryl group;

W represents a component (moiety) capable of inhibitions the development of silver halide;

provided that when l represents 2, the ethylene groups may be the same or different, and that $R^{21}$ and $R^{22}$ may be the same or different.

2. The silver halide color negative photographic material as is claim 1, wherein the specific photographic sensitivity of the material is from 400 to less than 800.

3. The silver halide color negative photograph material as is claim 1, wherein at least one color sensitive emulsion layer among the blue-sensitive emulsion layer, the green-sensitive emulsion layers and the red-sensitive emulsion layer is composed of two or more emulsion layers each having a different sensitivity.

4. The silver halide color negative photographic material as is claim 3, wherein the content of the silver halide in the emulsion layer of the upper layer contains a smaller amount of silver.

5. The silver halide color negative photographic material as is claim 3, wherein the content of the silver halide in the emulsion layer of the highest sensitivity in the color-sensitive emulsion layer is from 0.3 g/m$^2$ to 1.8 g/m$^2$ as silver.

6. The silver halide color negative photographic material as in claim 1, wherein at least one color-sensitive emulsion layer among the blue-sensitive emulsion layer, the green-sensitive emulsion layers and the red-sensitive emulsion layer is composed of three emulsion layers each having a different sensitivity.

7. The silver halide color negative photographic material as in claim 1, wherein at least one color sensitive emulsion layer among the blue-sensitive emulsion layer, the green-sensitive emulsion layers and the red-sensitive emulsion layer contains a 2-equivalent coupler.

8. The silver halide color negative photographic material as in claim 1, wherein at least one color sensitive emulsion layer among the blue-sensitive emulsion layer, the green-sensitive emulsion layers and the red-sensitive emulsion layer each are composed of two or more emulsion layers each having a different sensitivity and the emulsion layer of the highest sensitivity among the respective color-sensitive emulsion layers contains a 2-equivalent coupler.

9. The silver halide color negative photographic material as in claim 1, wherein the 2-equivalent coupler in the green-sensitive emulsion layer is a coupler represented by the following general formula (II):

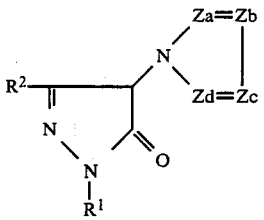

(II)

in which $R^1$ represents an aromatic group, an aliphatic group or a heterocyclic group; $R^2$ represents a substituent; and Za, Zb, Zc and Zd each represent a methine group, a substituted methine group of —N=, and said coupler may be in a form of a polymer at $R^1$, $R^2$ or

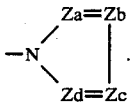

10. The silver halide color negative photographic material as in claim 1, wherein the 2-equivalent coupler in the green-sensitive emulsions layer is a coupler represented by the following general formula (III):

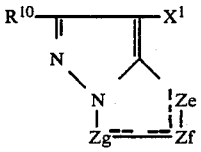

(III)

in which $R^{10}$ represents a hydrogen atom or a substituent; $X^1$ represents a hydrogen atom or a group capable of being released by the coupling reaction with the oxidation product of an aromatic primary amine developing agent; Ze, Zf and Zg each represents a methine group, a substituted methine group, =N— or =NH—;

one of the Ze-Zf bond and the Zf-Zg bond is a double bond and the other is a single bond;

in case the Zf-Zg bond is a carbon-carbon double bond, this may form a part of an aromatic ring;

a dimer or polymer may be formed at $R^{10}$ or $X^1$; and in the case where Ze, Zf or Zg is a substituted methine group, a dimer or polymer may be formed at the substituted methine group.

11. The silver halide color negative photographic material as in claim 1, wherein at least one emulsion layer among the blue-sensitive emulsion layer, the green-sensitive emulsion layer and the red-sensitive emulsion layer contains an emulsion comprising monodispersed silver halide grains with a variation coefficient of 16% or less.

12. The silver halide color negative photographic material as in claim 1, wherein at least one emulsion layer among the blue-sensitive emulsion layer, the green-sensitive emulsion layer and the red-sensitive emulsion layer contains two-layer structure grains comprising a silver iodobromide core part which contains 5 mol % or more silver iodide and a shell part which wraps the core and which comprises silver iodobromide having a lower silver iodide content than the core or comprises silver bromide.

13. The silver halide color negative photographic material as in claim 1, wherein the mean silver iodide content in all of the silver halide emulsion layers is at least 8 mol %.

14. The silver halide color negative photographic material as in claim 1, wherein at least one emulsion layer among the blue-sensitive emulsion layer, the green-sensitive emulsion layers and the red-sensitive emulsion layer contains a nitrogen-containing heterocyclic compound represented by the following general formula (I):

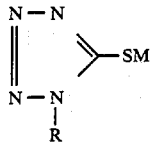

(I)

in which

R represents an aliphatic, aromatic or heterocyclic group substituted by at least one —COOM or —$SO_3M$:

M represents a hydrogen atom, an alkali metal, a quaternary ammonium group or a quaternary phosphonium group.

15. The silver halide color negative photographic material as in claim 1, which contains at least one yellow filter dye as represented by the following formula (VI)

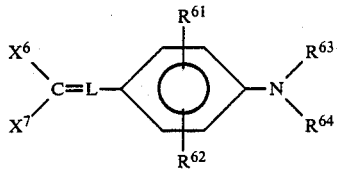

(VI)

in which $X^6$ and $X^7$ may be the same as or different from each other and each represents a cyano group, a carboxyl group, an alkylcarbonyl group, an arylcarbonyl group, an alkoxycarbonyl group, an aryloxycarbonyl group, a carbamoyl group, a sulfonyl group or a sulfamoyl group, except the combination of $X^6$ and $X^7$ being a cyano group and a substituted or unsubstituted alkylcarbonyl group, and a cyano group and a sulfonyl group; $R^{61}$ and $R^{62}$ may be the same or different from each other and each represents a hydrogen atom, a halogen atom, an alkyl group, an alkoxy group, a hydroxyl group, a carboxyl group, a substituted amino group, a carbamoyl group, a sulfamoyl group or an alkoxycarbonyl group;

$R^{63}$ and $R^{64}$ may be the same or different from each other and each represents a hydrogen atom, an alkyl group or an aryl group;

$R^{63}$ and $R^{64}$ may form: a 5- or 6-membered ring; or $R^{61}$ and $R^{63}$, and $R^{62}$ and $R^{64}$ may be linked together to form a 5- or 6-membered ring; and L represents a methine group.

16. The silver halide color negative photographic material as in claim 1, wherein the silver halide grains in the emulsion is from 0.2 μm to 10 μm as the diameter of the corresponding spheres.

17. The silver halide color negative photographic material as in claim 1, wherein said photographic material contains metal impurities, other than gold and iridium, of 2 ppm or less.

* * * * *